US009776451B2

(12) United States Patent
Tanaka et al.

(10) Patent No.: US 9,776,451 B2
(45) Date of Patent: Oct. 3, 2017

(54) BINDING DEVICE

(71) Applicant: LIHIT LAB., INC., Osaka (JP)

(72) Inventors: Kanji Tanaka, Osaka (JP); Yoshiteru Arimoto, Osaka (JP); Hiroyuki Yamashita, Osaka (JP); Hiroshi Nakano, Osaka (JP); Nobuaki Nagawa, Osaka (JP)

(73) Assignee: LIHIT LAB., INC., Osaka (JP)

( * ) Notice: Subject to any disclaimer, the term of this patent is extended or adjusted under 35 U.S.C. 154(b) by 0 days.

(21) Appl. No.: 14/716,867

(22) Filed: May 19, 2015

(65) Prior Publication Data

US 2015/0251483 A1 Sep. 10, 2015

Related U.S. Application Data

(63) Continuation of application No. PCT/JP2014/073669, filed on Sep. 8, 2014.

(30) Foreign Application Priority Data

Sep. 19, 2013 (JP) ..... 2013-194134

(51) Int. Cl.
*B42F 1/00* (2006.01)
*B42F 9/00* (2006.01)

(52) U.S. Cl.
CPC ..... *B42F 1/006* (2013.01); *B42F 9/00* (2013.01); *Y10T 24/202* (2015.01)

(58) Field of Classification Search
CPC ..... B42F 1/006; B42F 9/00; Y10T 24/202; Y10T 24/209
See application file for complete search history.

(56) References Cited

U.S. PATENT DOCUMENTS 3,285,250 A * 11/1966 Ivory ..... B42F 13/02 340/14
3,492,701 A * 2/1970 Kitamura ..... B42F 9/00 24/67.7
4,184,782 A * 1/1980 Giulie ..... B42B 5/04 24/129 R
4,693,625 A * 9/1987 Ohminato ..... B42F 13/12 402/26

(Continued)

FOREIGN PATENT DOCUMENTS

JP 2005-074645 A 3/2005
JP 2006-341566 A 12/2006

(Continued)

*Primary Examiner* — David Upchurch
(74) *Attorney, Agent, or Firm* — Rabin & Berdo, P.C.

(57) ABSTRACT

Provided is a binder in which a binder is provided with a binding member having a pressing portion pressing a material to be bound, an operation member operated so as to pivotally rotate to an open state and a hold state, and a base member the binder is further provided with an engagement body, a projection portion caused to engage with the engagement body, and a supporting portion provided with the engagement body, the supporting portion is configured so as to bend toward the projection portion side and bend in a direction of separating from the projection portion and the locked state is formed by engagement between the engagement body and the projection portion.

10 Claims, 72 Drawing Sheets

(56) References Cited

U.S. PATENT DOCUMENTS

| | | | | | |
|---|---|---|---|---|---|
| 4,730,950 | A * | 3/1988 | Ominato | B42F 13/32 | 402/45 |
| 4,761,091 | A * | 8/1988 | Ominato | B42F 13/38 | 402/22 |
| 5,634,732 | A * | 6/1997 | Ushirooka | B42F 13/14 | 281/21.1 |
| 2002/0009326 | A1* | 1/2002 | Higashino | B42F 9/00 | 402/64 |
| 2004/0056449 | A1* | 3/2004 | Girard | A63C 1/28 | 280/615 |
| 2006/0197312 | A1* | 9/2006 | Girard | A63C 9/20 | 280/613 |
| 2009/0067914 | A1* | 3/2009 | Tanaka | B42F 9/001 | 402/36 |
| 2009/0169289 | A1* | 7/2009 | Inoue | B42F 13/06 | 402/77 |
| 2009/0269126 | A1* | 10/2009 | Tanaka | B42F 13/22 | 402/70 |
| 2011/0200411 | A1* | 8/2011 | Aoi | B42B 5/08 | 412/16 |

FOREIGN PATENT DOCUMENTS

| | | | |
|---|---|---|---|
| JP | 2007-076262 | A | 3/2007 |
| JP | 4288861 | B2 | 7/2009 |
| JP | 5119369 | B1 | 1/2013 |

* cited by examiner

FIG. 12A(1)
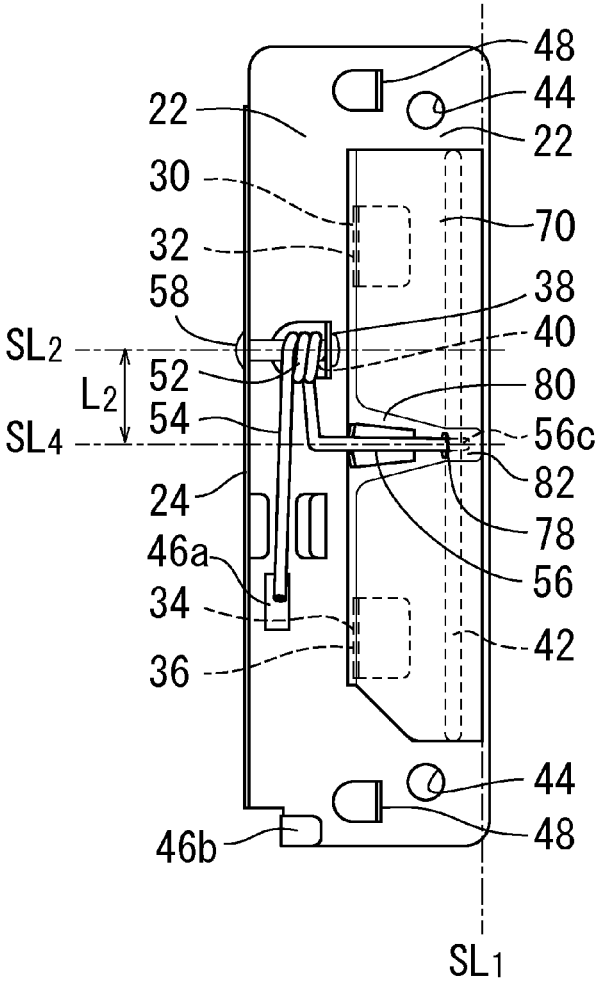
FIG. 12A(2)
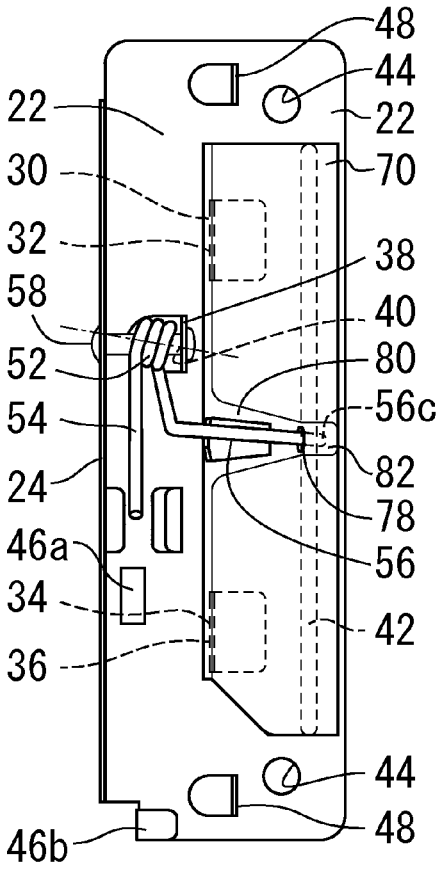

60c
60
60a
60b
100
70
62
48
22
72a
92a
92b
72b
180
120
48

56
80
78
82
86
72
22
84
30
90
48
58
38
52
54

FIG. 34A(1)
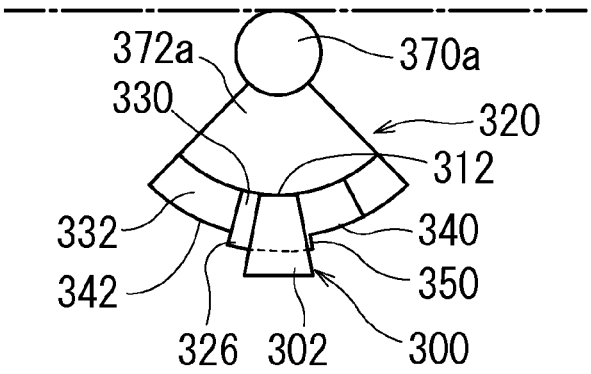
FIG. 34A(2)
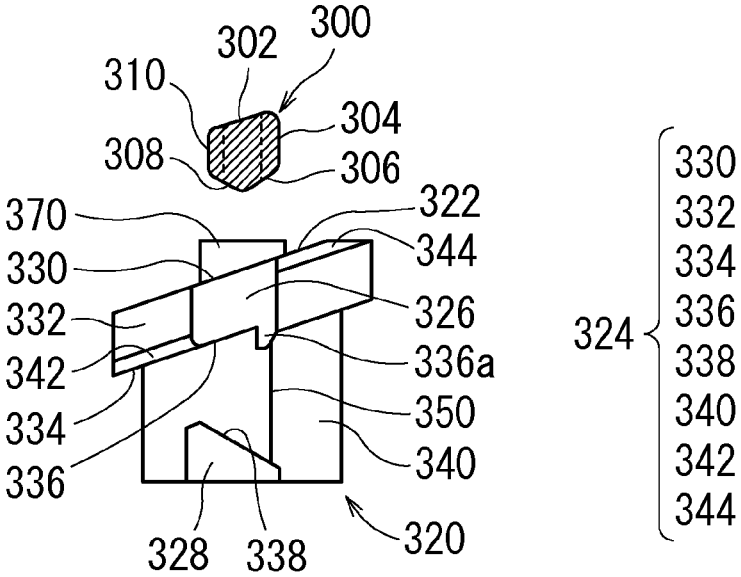
FIG. 34A(3)
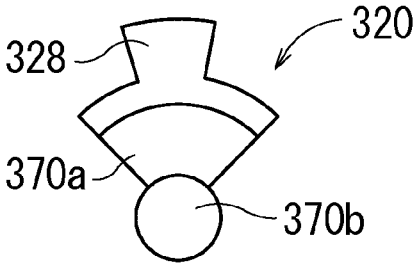

FIG. 34B(1)
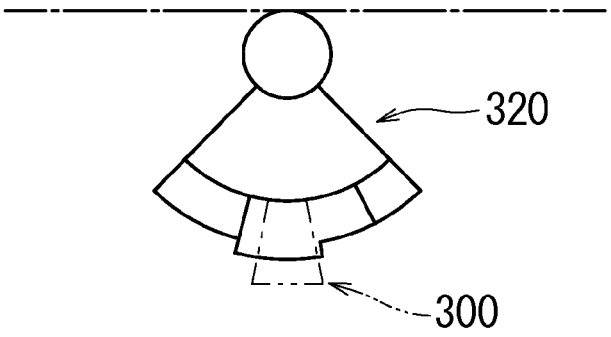
FIG. 34B(2)
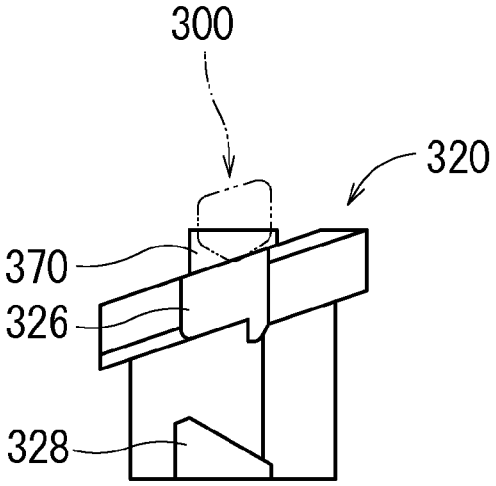
FIG. 34B(3)
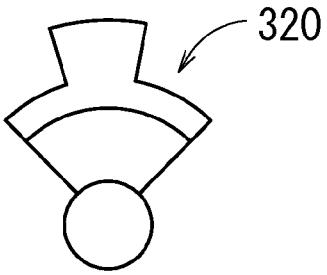

FIG. 34C(1)
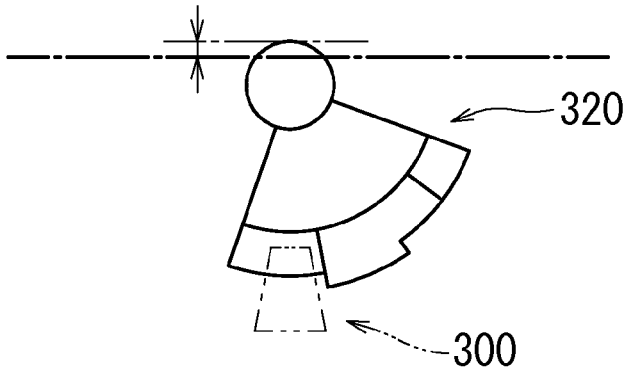
FIG. 34C(2)
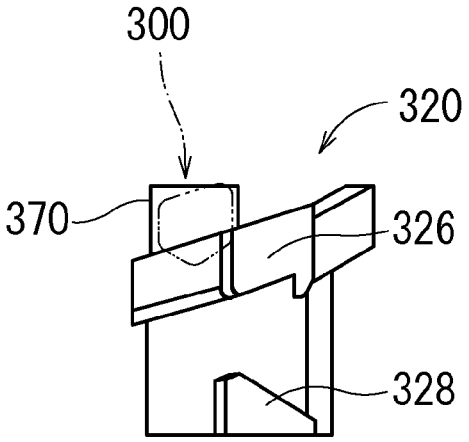
FIG. 34C(3)
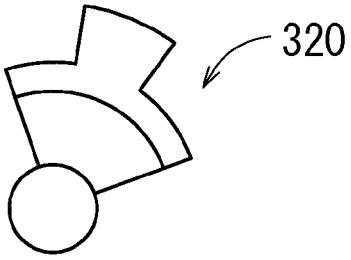

FIG. 34D(1)
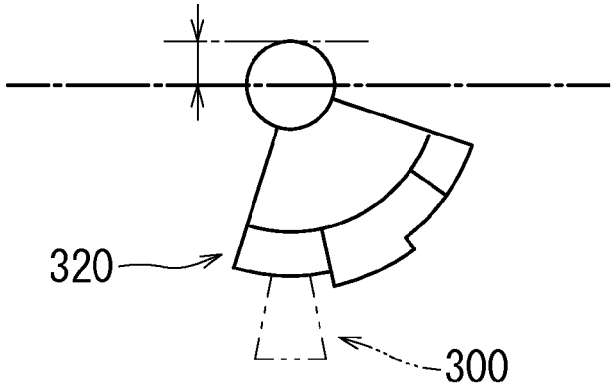
FIG. 34D(2)
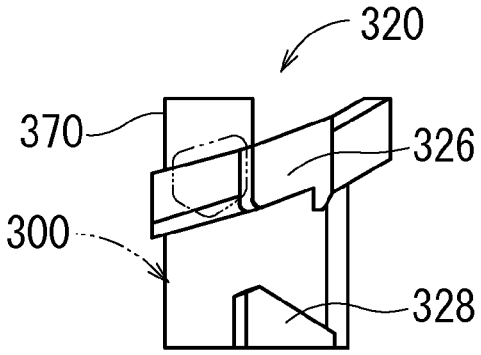
FIG. 34D(3)
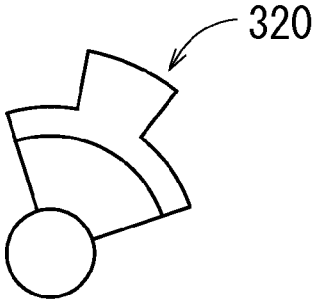

FIG. 34E(1)
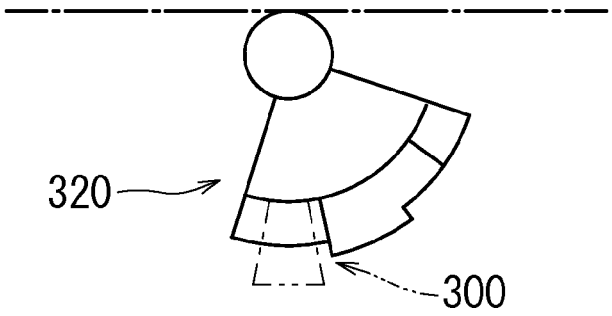
FIG. 34E(2)
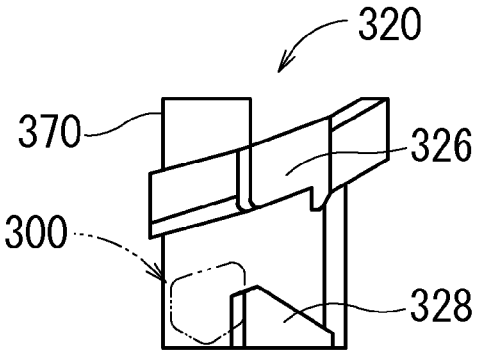
FIG. 34E(3)
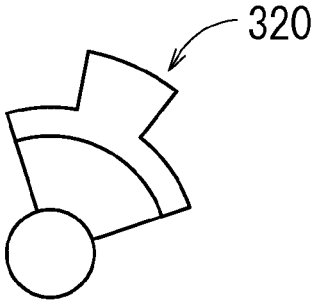

FIG. 34F(1)
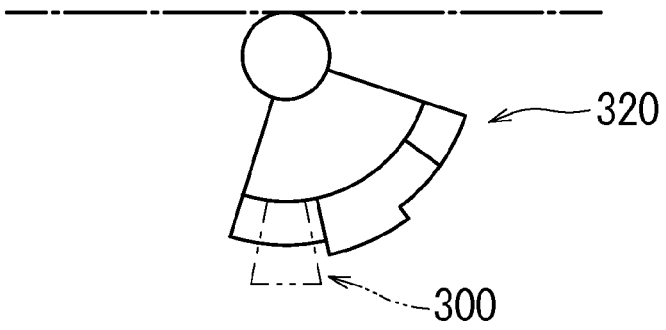
FIG. 34F(2)
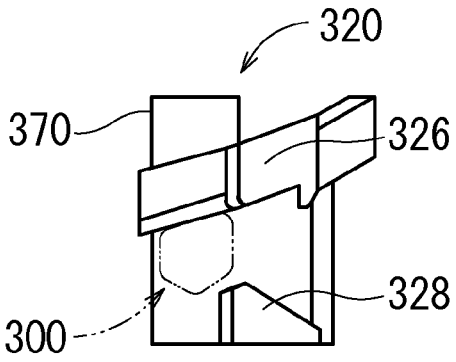
FIG. 34F(3)
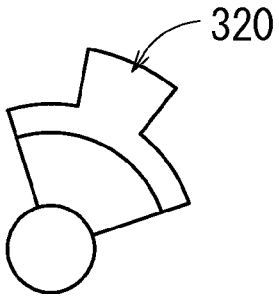

FIG. 34G(1)
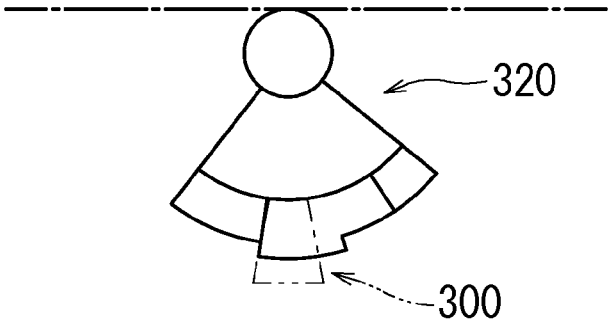
FIG. 34G(2)
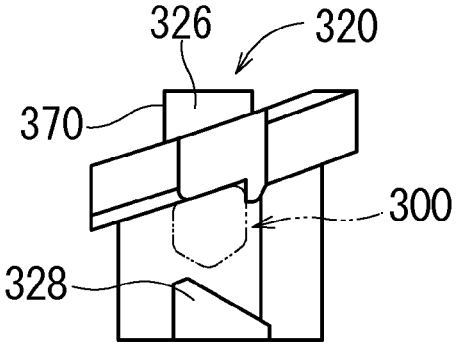
FIG. 34G(3)
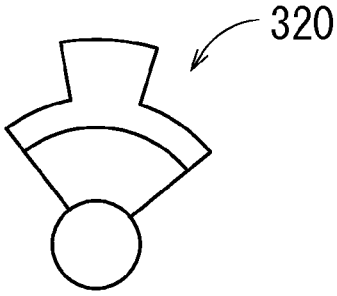

FIG. 34H(1)
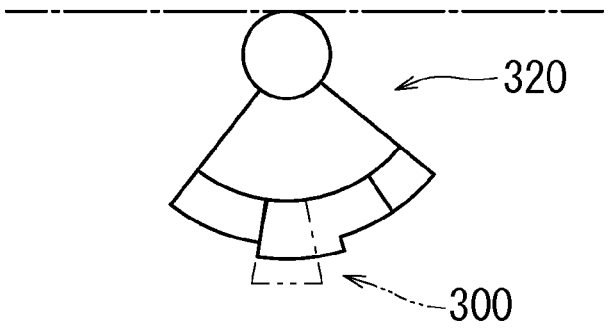
FIG. 34H(2)
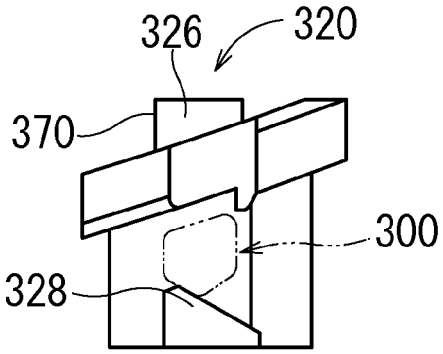
FIG. 34H(3)
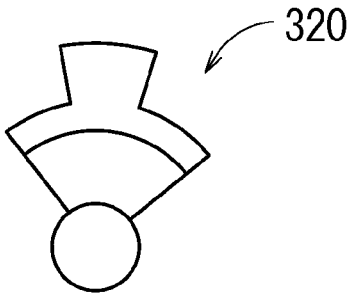

FIG. 34I (1)
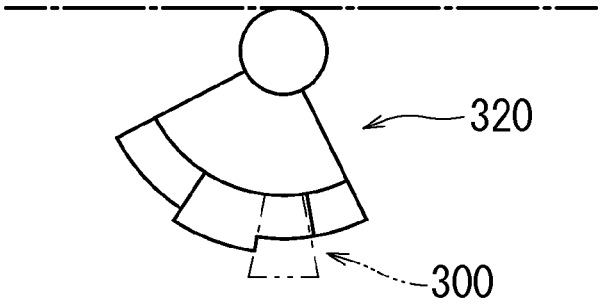
FIG. 34I (2)
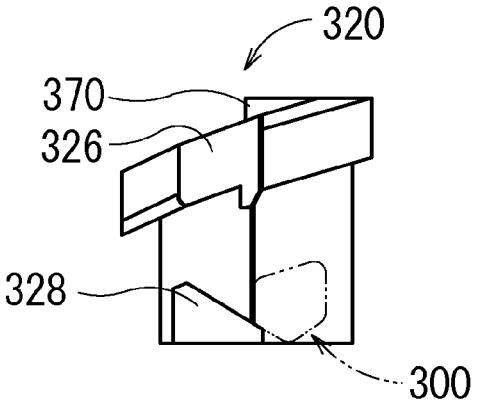
FIG. 34I (3)
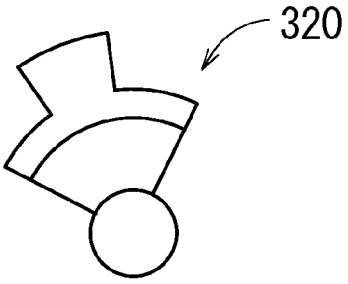

FIG. 34J(1)
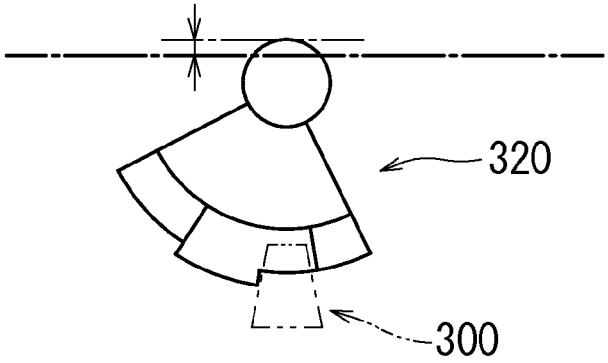
FIG. 34J(2)
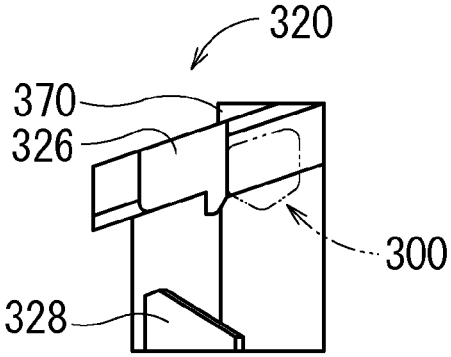
FIG. 34J(3)
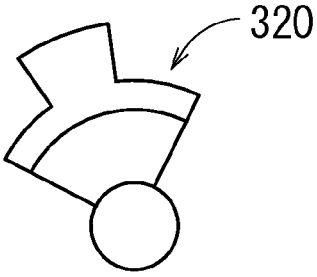

FIG. 34K(1)
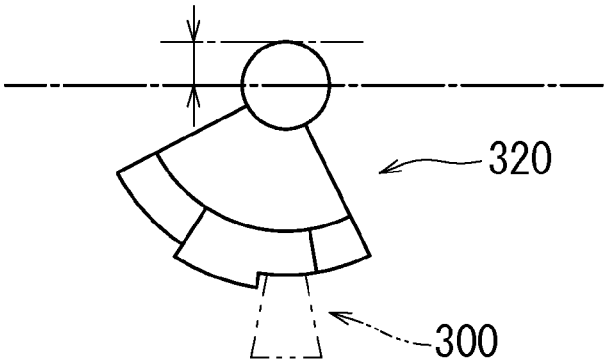
FIG. 34K(2)
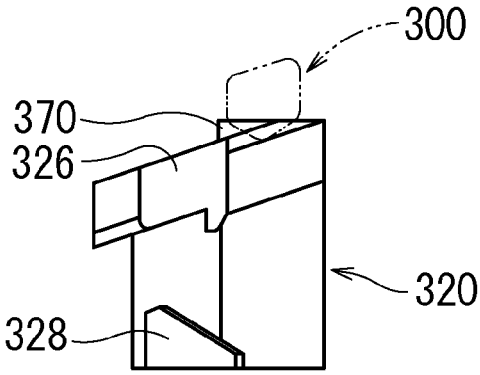
FIG. 34K(3)
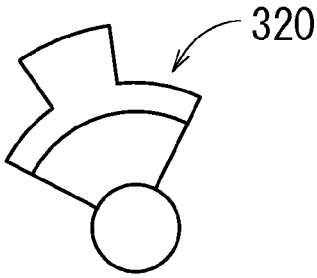

FIG. 34L(1)
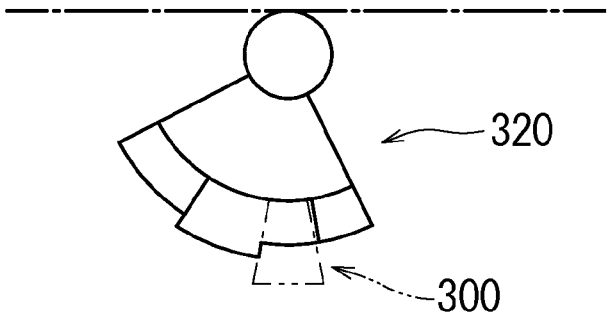
FIG. 34L(2)
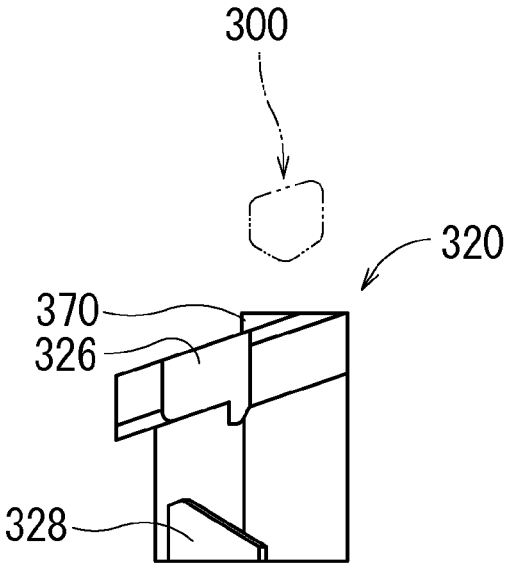
FIG. 34L(3)
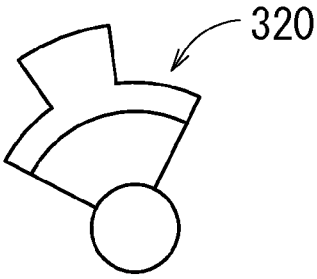

FIG. 39A(1)
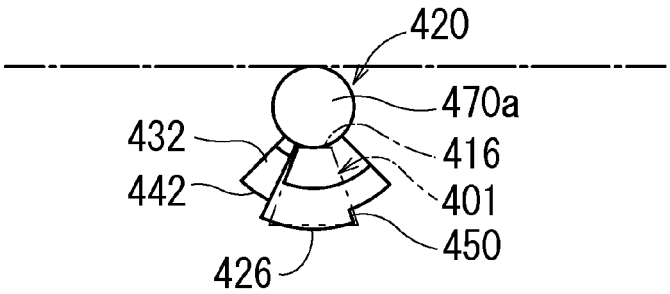
FIG. 39A(2)
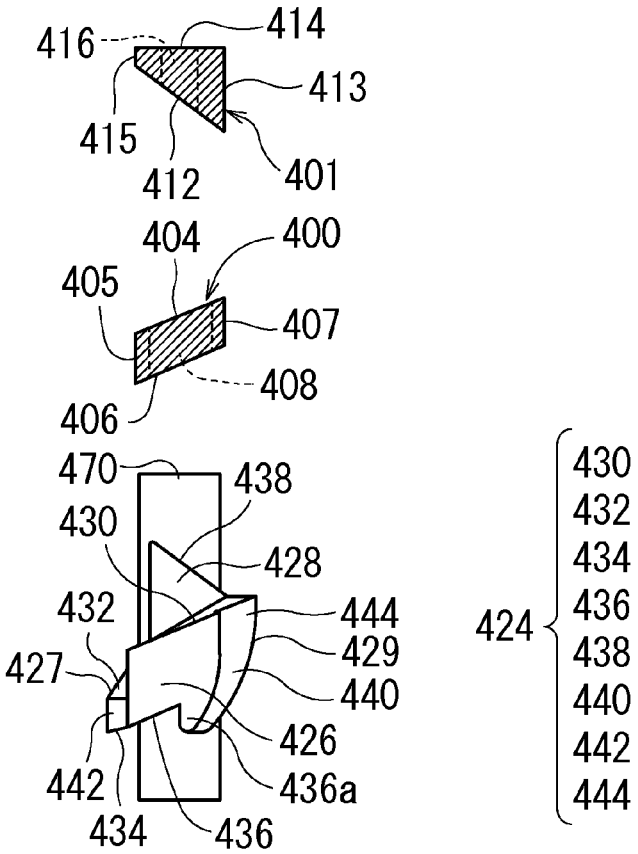
FIG. 39A(3)
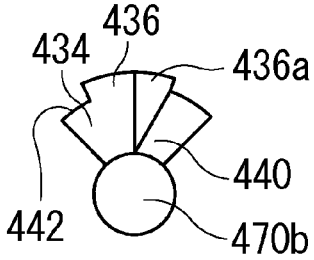

FIG. 39B(1)
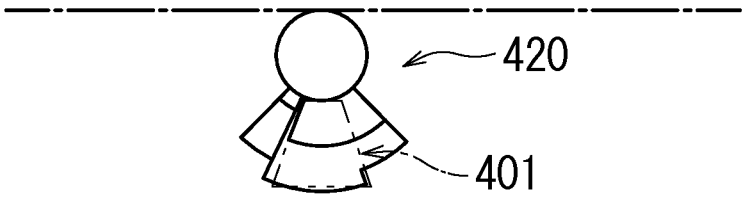
FIG. 39B(2)
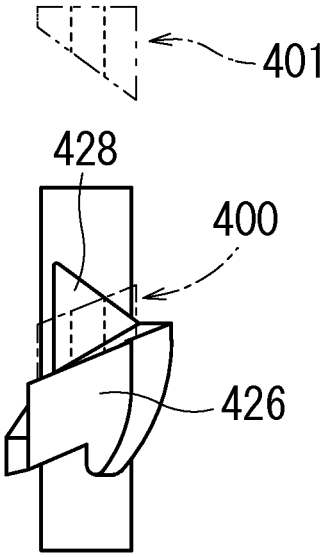
FIG. 39B(3)
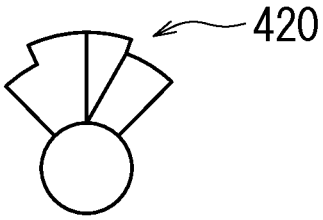

FIG. 39C(1)
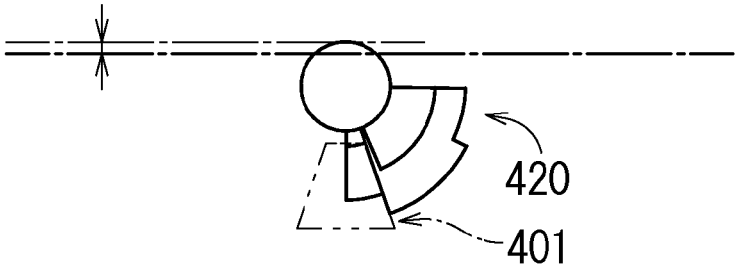
FIG. 39C(2)
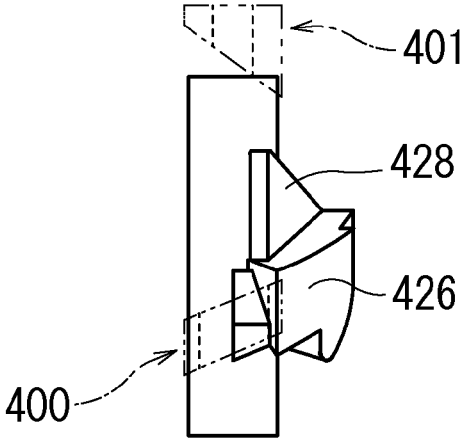
FIG. 39C(3)
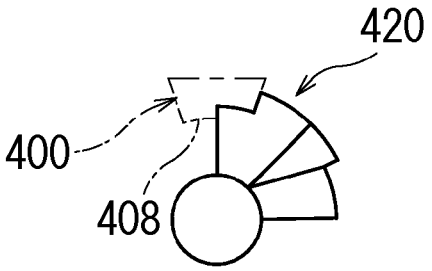

FIG. 39D(1)
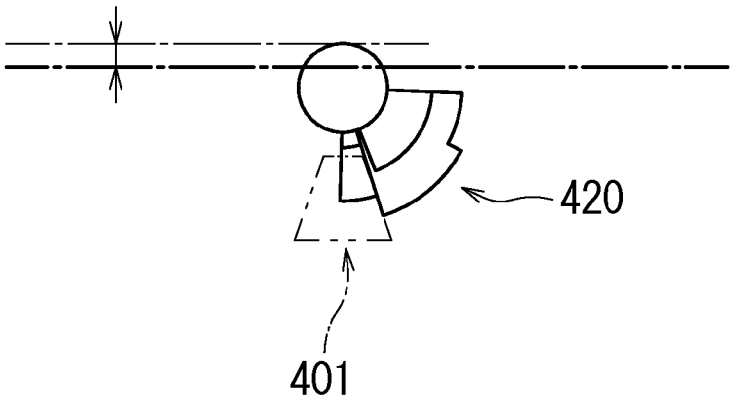
FIG. 39D(2)
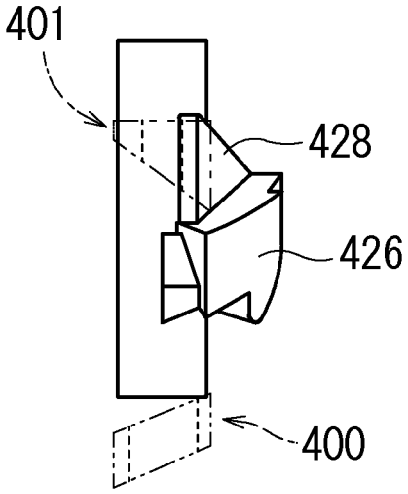
FIG. 39D(3)
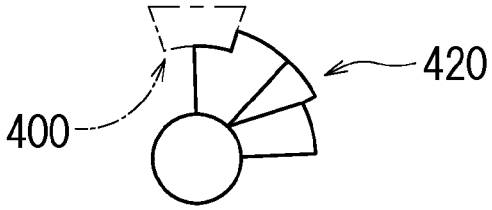

FIG. 39E(1)
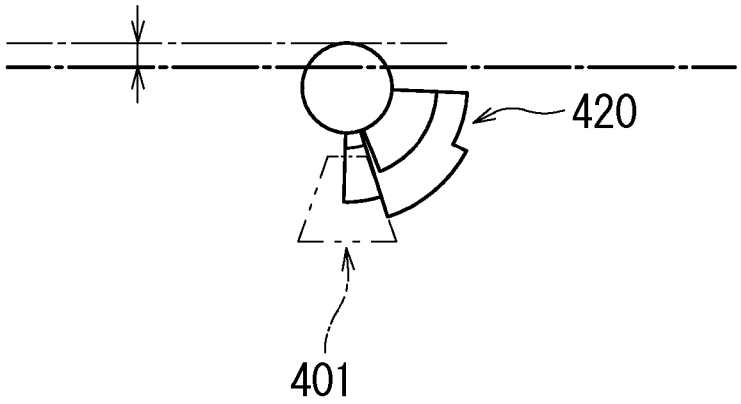
FIG. 39E(2)
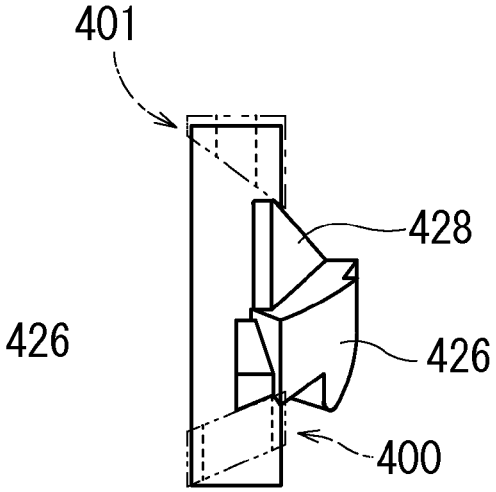
FIG. 39E(3)
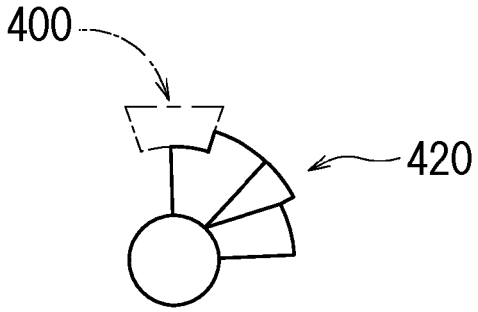

FIG. 39F(1)
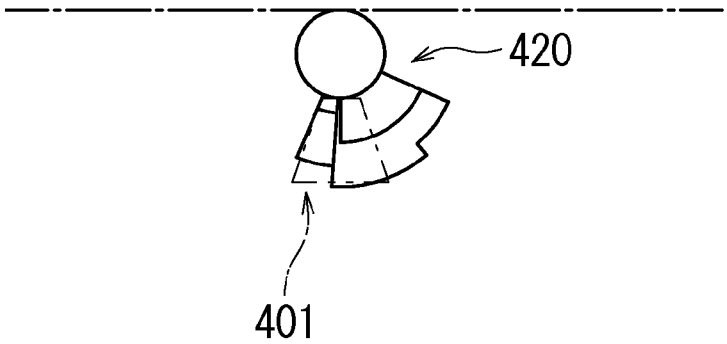
FIG. 39F(2)
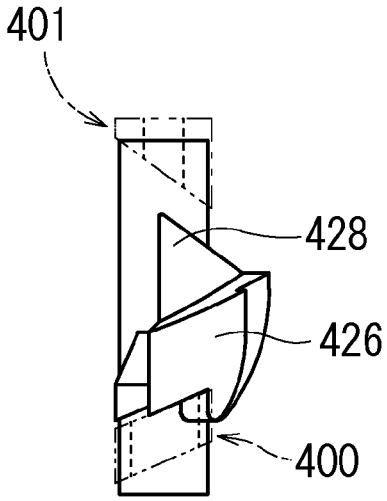
FIG. 39F(3)
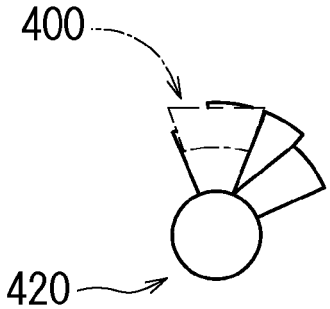

FIG. 39G(1)
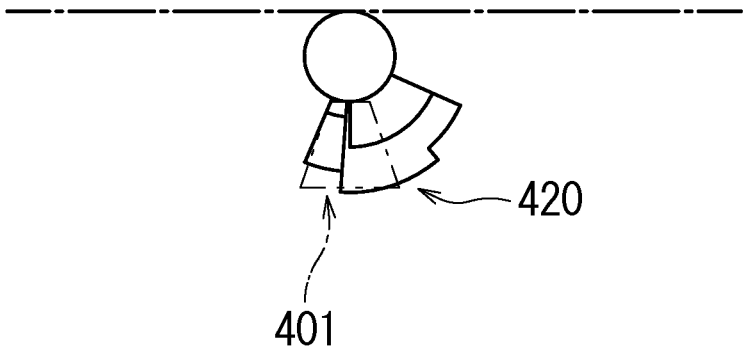
FIG. 39G(2)
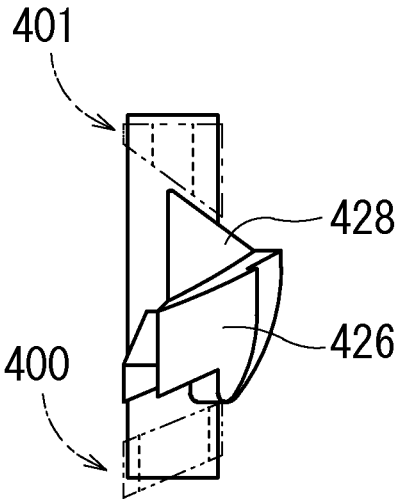
FIG. 39G(3)
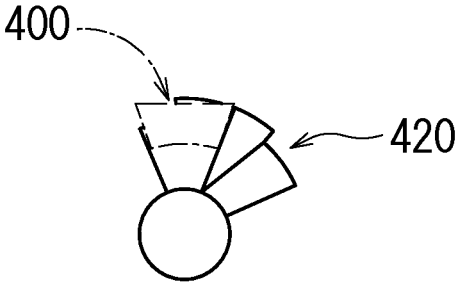

FIG. 39H(1)
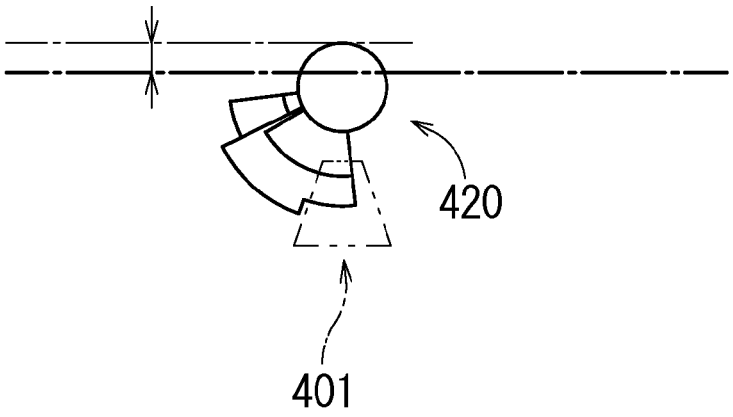
FIG. 39H(2)
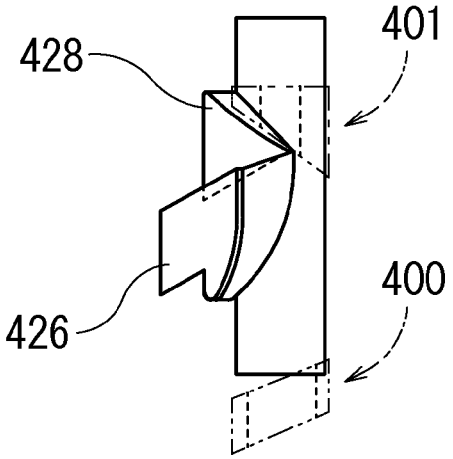
FIG. 39H(3)
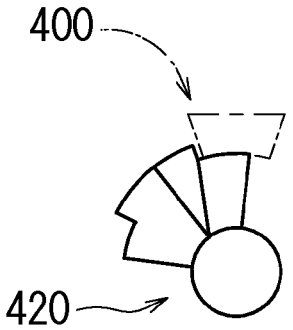

FIG. 39I (1)
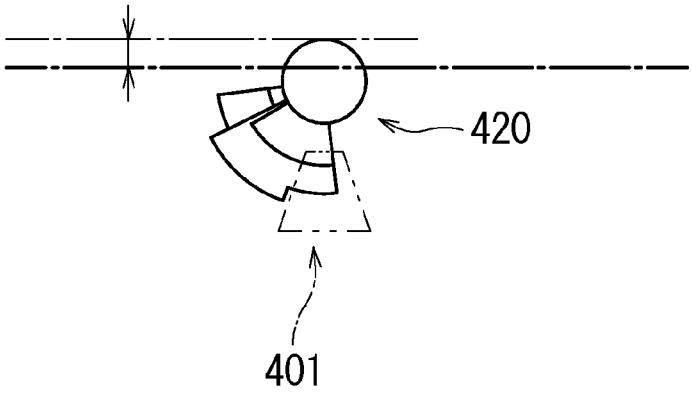
FIG. 39I (2)
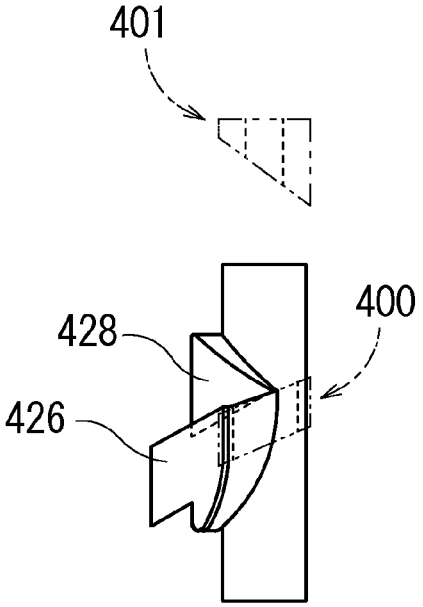
FIG. 39I (3)
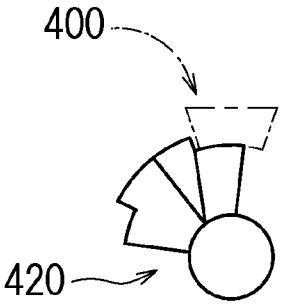

FIG. 39J(1)
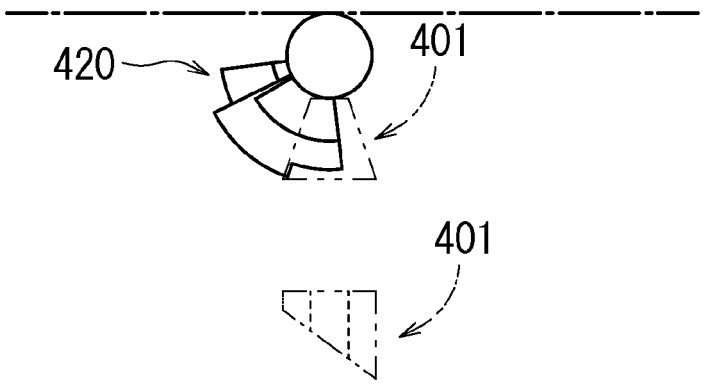
FIG. 39J(2)
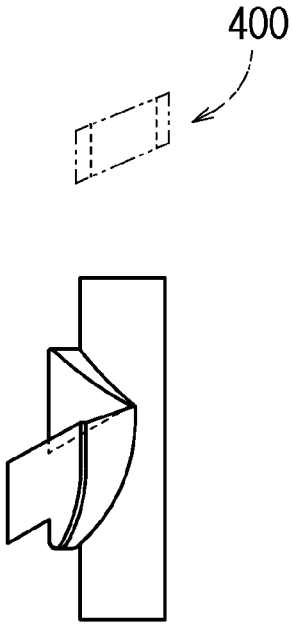
FIG. 39J(3)
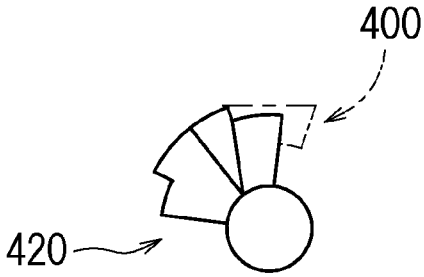

BINDING DEVICE

This application is a continuation under 35 U.S.C. 120 of International Application PCT/JP2014/073669 having the International Filing Date of Sep. 8, 2014, and having the benefit of the earlier filing date of Japanese Application No. 2013-194134, filed Sep. 19, 2013. Each of the identified applications is fully incorporated herein by reference.

TECHNICAL FIELD

The present invention relates to a binding device, and in particular, for example to a binding device for putting materials to be bound, such as documents, therein to bind them by operating an operation member such as an operation lever.

BACKGROUND ART

One example of a conventional binding device constituting the background of the present invention and a file applied therewith is disclosed, for example, in Japanese Patent No. 4288861 (see Patent Document 1). The binding device disclosed in Patent Document 1 is a conventional binding device and it was devised to solve such a problem that when an operation lever is unlocked, a free end side of the operation lever must be applied with a force acting in a horizontal direction departing from a support wall portion simultaneously with pressing the free end side to an installation face side of the operation member, so that locking and unlocking of the operation member can be performed by only applying a force acting in one direction to the operation member.

The binding device of Patent Document 1 is a binding device provided with an operation member provided such that one end side thereof is supported by a base and the other end side thereof is movable as a free end, a pressing member provided so as to be capable of coming close to the base and separating from the same according to movement of the operation member, a spring member provided between the pressing member and the operation member, and a locking means for locking the operation member when the pressing member is set at a binding position, wherein the operation member is provided with a first and second operation regions, and such a configuration is adopted that when the first operation region is operated in a predetermined direction, the operation member is locked to maintain the pressing member at the binding position while the lock is unlocked to allow separation of the pressing member from the base when the second operation region is operated in the predetermined direction, so that a binding device which can obtain convenience of operations can be provided. Further, such a convenience that unlocking is made possible by only operating the second operation region in the same operation direction as the operation direction applied to the first operation region can be obtained. That is, since it becomes unnecessary to perform application of a pressing force to the operation member and application of a force for moving the operation member in a horizontal direction simultaneously unlike the conventional binding device, an operation force to the operation member can be applied securely. In addition, it can be solved that deformation such as torsion is induced to the operation member.

PRIOR ART DOCUMENT

Patent Document

Patent Document 1: Japanese Patent No. 4288861

SUMMARY OF INVENTION

Problem to be Solved by the Invention

In the binding device disclosed in Patent Document 1, though the operation member is operated when locking is performed and when unlocking is performed, the operation regions in the operation member are different. Therefore, it is hard to understand a portion of the operation member to be operated for locking or for unlocking.

Therefore, a principal object of the present invention is to provide a binding device where operations at a locking time and at an unlocking time are easy to understand.

Means for Solving the Problem

A binding device described in claim 1 of the present invention is a binding device including a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, one or plural projection portions caused to engage with the engagement body, and a supporting portion provided with the engagement body, or the binding device is provided with an engagement body, one or plural projection portions caused to engage with the engagement body, and a supporting portion provided with the one or plural projection portions; the operation member is provided on the base member so as to rotate in a direction approximately orthogonal to a principal face of the base member; the supporting portion is configured such that the supporting portion bends toward the side of the projection portion or the engagement body in order to cause the engagement body and the one projection portion or one of the plural projection portion to engage with each other and bends in a direction of separating from the projection portion or the engagement body in order to disengage the engagement body and the projection portion from each other; and the locked state is formed by engagement between the engagement body and the projection portion.

A binding device described in claim 2 is a binding device including a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, one or plural projection portions caused to engage with the engagement body, and a supporting portion provided with the engagement body, or the binding device is provided with an engagement body, one or plural projection portions caused to engage with the engagement body, and a supporting portion provided with one or plural projection portions; the engagement body is provided on one of the operation member or the base member, and the one or plural projection portions are provided on the other of the operation member or the base member; the operation member is provided on the base member so as to rotate in a direction approximately orthogonal to a principal face of the base member; the supporting portion is provided between the operation member and the binding member, and the supporting portion has such a structure that the supporting portion comes close to the operation member at a movement time from the locked state to the unlocked state and separates from the operation member at a movement time from the unlocked state to the locked state; and the locked state is formed by engagement between the engagement body and the projection portion according to a relative movement therebetween.

A binding device of the present invention described in claim 3 is a binding device including a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, an engagement body supporting portion attached with the engagement body, and one or plural projection portions caused to engage with the engagement body; the engagement body and the engagement body supporting portion are provided on one of the operation member and the base member, and the one or plural projection portions are provided on the other of the operation member and the stand portion; the engagement body supporting portion is provided between the operation member and the binding member, and the engagement body supporting portion has such a structure that the supporting portion comes close to the operation member at a movement time from the locked state to the unlocked state and separates from the operation member at a movement time from the unlocked state to the locked state; and the locked state is formed by engagement between the engagement body and the projection portion according to a relative movement therebetween.

A binding device of the present invention described in claim 4 is the binding device according to any one of claims 1 to 3 wherein the engagement body is pivotally or slidably attached to the operation member or the supporting portion, or the engagement body supporting portion; the engagement body is pivotable or slidable within a range where the projection portion necessarily comes in contact with the engagement body at a movement time from the unlocked state to the locked state; and the locked state is formed by engagement between the engagement body and the projection portion at a predetermined position and a predetermined orientation of the projection portion relative to the engagement body.

A binding device of the present invention described in claim 5 is the binding device according to any one of claims 1 to 4, wherein the engagement body is configured such that a follow-up guidance portion moves in response to movement of the projection portion; the follow-up guidance portion is provided with a first slope portion to which the projection portion is pressed at a movement time from the unlocked state to the locked state, a first projection passage portion through which the projection portion passes at a movement time from the unlocked state to the locked state, a projection engagement portion engaging with the projection portion when the locked state is achieved, a second slope portion to which the projection portion is pressed at a movement time from the locked state to the unlocked state, and a second projection passage portion though which the projection portion passes at a movement time from the locked state to the unlocked state; the first projection passage portion is provided to connect to the first slope portion at a lower position on the first slope portion; a projection engagement portion is provided to connect to the first projection passage portion at a position separating from a region provided to connect to the first slope portion of the first projection passage portion; the second slope portion is formed so as to face the projection engagement portion, the second projection passage portion is provided to connect to the second slope portion at a lower position on the second slope portion; and the engagement body can take a first state where when the operation member is pressed down toward the base member in a direction orthogonal to a principal face of the base member, the first projection passage portion is positioned on a track of the projection portion, a second state where when the projection portion moves, the projection portion and the projection engagement portion of the engagement body are caused to engage with each other and the binding member is in the locked state, and a third state where when the operation member is pressed down toward the base member in a direction orthogonal to the principal face of the base member and the projection portion is pressed to the second slope portion so that the engagement body moves in contact with the second slope portion, the second projection passage portion is positioned on the track of the projection portion.

A binding device of the present invention described in claim 6 is the binding device according to any one of claims 1 to 5, wherein a first projection edge portion projects to the projection portion when the projection portion passes through the first projection passage portion; when the one projection or one projection of the plural projection portions passes through the first projection passage portion at a movement time from the unlocked state to the locked state, the one projection or one projection of the plural projection portions is pressed to the first projection edge portion and the engagement body supporting portion swings, and when the projection portion has passed through the first projection edge portion, the engagement body supporting portion is restored; thereafter, the projection portion cannot return reversely through the first projection passage portion; a second projection edge portion projects to the projection portion when the projection portion passes through the second projection passage portion; when the projection portion passes through the second projection passage portion at a movement time from the locked state to the unlocked state, the projection portion is pressed to the second projection edge portion and the engagement body supporting portions swings, and when the projection portion has passed through the second projection edge portion, the engagement body supporting portion is restored; and thereafter, the projection portion cannot return reversely through the second projection passage portion.

A binding device of the present invention described in claim 7 is the binding device according to any one of claims 1 to 6, wherein the projection body supporting portion comprises an engagement body supporting main body having a longitudinal direction extending along a longitudinal direction of the operation member, and an engagement body moving portion or an engagement member receiving portion formed on the engagement body supporting main body; the engagement body supporting main body has a fixing portion of the engagement body supporting portion formed at one end of the engagement body supporting main body in a longitudinal direction thereof, and a free end portion formed at the other end separated from the fixing portion of the engagement body supporting portion, and the engagement body supporting main body is configured so as to bend about the fixing portion of the engagement body supporting portion which is fixed to the engagement body to come close to and separate from the operation member; the engagement body is provided with an engagement body main body coming in sliding contact with the engagement body moving portion or the engagement body receiving portion of the engagement body supporting portion and a follow-up guidance portion for following up the projection portion formed on the engagement body supporting portion; the engagement body is configured so as to move from the locked state to the unlocked state along the engagement body moving portion or the engagement body receiving portion of the engagement body supporting portion according to movement of a projection portion arranged on the follow-up guidance portion; and the engagement body supporting portion is provided with a guidance supporting portion or an engagement body receiving portion formed in the engagement body supporting main body.

Effect of the Invention

According to the invention of claim 1, a binding device comprising: a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, one or plural projection portions caused to engage with the engagement body, and a supporting portion provided with the engagement body, or the binding device is provided with an engagement body, one or plural projection portions caused to engage with the engagement body, and a supporting portion provided with the one or plural projection portions; the operation member is provided on the base member so as to rotate in a direction approximately orthogonal to a principal face of the base member; the supporting portion is configured such that the supporting portion bends toward the side of the projection portion or the engagement body in order to cause the engagement body and the one projection portion or one of the plural projection portion to engage with each other and bends in a direction of separating from the engagement body or the projection portion in order to disengage the engagement body and the projection portion from each other; and the locked state is formed by engagement between the engagement body and the projection portion. Thus a binding device whose locking and unlocking can be performed by only operating the operation member and whose operation is easy to understand can be provided.

According to the invention of claim 2, a binding device comprising: a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, one or plural projection portions caused to engage with the engagement body, and a supporting portion provided with the engagement body, or the binding device is provided with an engagement body, one or plural projection portions caused to engage with the engagement body, and a supporting portion provided with one or plural the projection portions; the engagement body is provided on one of the operation member or the base member, and the one or plural projection portions are provided on the other of the operation member or the base member; the operation member is provided on the base member so as to rotate in a direction approximately orthogonal to a principal face of the base member; the supporting portion is provided between the operation member and the binding member, and the supporting portion has such a structure that the supporting portion comes close to the operation member at a movement time from the locked state to the unlocked state and separates from the operation member at a movement time from the unlocked state to the locked state; and the locked state is formed by engagement between the engagement body and the projection portion according to a relative movement therebetween. Thus a binding device whose locking and unlocking can be performed by only operating the operation member and whose operation is easy to understand can be provided.

According to the invention of claim 3, a binding device comprising: a binding member having a pressing portion pressing and holding a material to be bound; an operation member provided for performing such an operation as to pivot the binding member between a locked state of pressing a material to be bound and an unlocked state; a base member provided with the binding member and the operation member; and a biasing member biasing the binding member in a direction of pressing the material to be bound, wherein the binding device is provided with an engagement body, an engagement body supporting portion attached with the engagement body, and one or plural projection portions caused to engage with the engagement body; the engagement body and the engagement body supporting portion are provided on one of the operation member and the base member and the one or plural projection portions are provided on the other of the operation member and the base member; the engagement body supporting portion is provided between the operation member and the binding member, and the engagement body supporting portion has such a structure that the supporting portion comes close to the operation member at a movement time from the locked state to the unlocked state and separates from the operation member at a movement time from the unlocked state to the locked state; and the locked state is formed by engagement between the engagement body and the projection portion according to a relative movement therebetween. Thus a binding device whose locking and unlocking can be performed by only operating the operation member and whose operation is easy to understand can be provided.

According to the invention of claim 4, the engagement body is pivotally or slidably attached to the operation member or the supporting portion or the engagement body supporting portion; the engagement body is pivotable or slidable within a range where the projection portion necessarily comes in contact with the engagement body at a movement time from the unlocked state to the locked state; and the locked state is formed by engagement between the engagement body and the projection portion at a predetermined position and a predetermined orientation of the projection portion relative to the engagement body. Thus switching between the locked state and the unlocked state can be performed by a simple operation of only pressing down the operation member.

According to the invention of claim 5, the engagement body is configured such that a follow-up guidance portion moves in response to movement of the projection portion; the follow-up guidance portion is provided with a first slope portion to which the projection portion is pressed at a movement time from the unlocked state to the locked state, a first projection passage portion through which the projection portion passes at a movement time from the unlocked state to the locked state, a projection engagement portion engaging with the projection portion when the locked state is achieved, a second slope portion to which the projection portion is pressed at a movement time from the locked state to the unlocked state, and a second projection passage portion though which the projection portion passes at a movement time from the locked state to the unlocked state; the first projection passage portion is provided to connect to the first slope portion at a lower position on the first slope portion; a projection engagement portion is provided to connect to the first projection passage portion at a position separating from a region provided to connect to the first slope portion of the first projection passage portion; the second slope portion is formed so as to face the projection engagement portion, the second projection passage portion is provided to connect to the second slope portion at a lower position on the second slope portion; and the engagement body can take a first state where when the operation member is pressed down toward the base member in a direction orthogonal to a principal face of the base member, the first projection passage portion is positioned on a track of the projection portion, a second state where when the projection portion moves, the projection portion and the projection engagement portion of the engagement body are caused to engage with each other and the binding member is in the locked state, and a third state where when the operation member is pressed down toward the base member in a direction orthogonal to the principal face of the base member and the projection portion is pressed to the second slope portion so that the engagement body moves in contact with the second slope portion, the second projection passage portion is positioned on the track of the projection portion. Thus operations for performing switching between the locked state and the unlocked state can be set to the same operation and as the same operation, a simple operation of only performing pressing down can be adopted.

According to the invention of claim 6, a first projection edge portion projects to the projection portion when the projection portion passes through the first projection passage portion; when the one projection or one projection of the plural projection portions passes through the first projection passage portion at a movement time from the unlocked state to the locked state, the one projection or one projection of the plural projection portions is pressed to the first projection edge portion and the engagement body supporting portion swings, and when the projection portion has passed through the first projection edge portion, the engagement body supporting portion is restored; thereafter, the projection portion cannot return reversely through the first projection passage portion; a second projection edge portion projects to the projection portion when the projection portion passes through the second projection passage portion; when the projection portion passes through the second projection passage portion at a movement time from the locked state to the unlocked state, the projection portion is pressed to the second projection edge portion and the engagement body supporting portions swings, and when the projection portion has passed through the second projection edge portion, the engagement body supporting portion is restored; and thereafter, the projection portion cannot return reversely through the second projection passage portion. Thus switching between the locked state and the unlocked state can be performed securely even at any position within a range where the engagement body is swingable or slidable.

According to the invention of claim 7, the engagement body supporting portion comprises an engagement body supporting main body having a longitudinal direction extending along a longitudinal direction of the operation member, and an engagement body moving portion or an engagement body receiving portion formed on the engagement body supporting main body; the engagement body supporting main body has a fixing portion of the engagement body supporting portion formed at one end of the engagement body supporting main body in a longitudinal direction thereof, and a free end portion formed at the other end separated from the fixing portion of the engagement body supporting portion, and the engagement body supporting main body is configured so as to bend about the fixing portion of the engagement body supporting portion which is fixed to the engagement body to come close to and separate from the operation member; the engagement body is provided with an engagement body main body coming in sliding contact with the engagement body moving portion or the engagement body receiving portion of the engagement body supporting portion and a follow-up guidance portion for following up the projection portion formed on the engagement body main body; the engagement body is configured so as to move from the locked state to the unlocked state along the engagement body moving portion or the engagement body receiving portion of the engagement body supporting portion according to movement of a projection portion arranged on the follow-up guidance portion; and the engagement body supporting portion is provided with a guidance supporting portion or an engagement body pivoting portion formed in the engagement body supporting main body. Thus switching between the locked state and unlocked state can be performed easily by a simple operation of only pressing down the operation member.

The above objects and other objects, features, merits of the present invention will become further apparent from the following explanation of the mode for carrying out the invention made with reference to the drawing.

In the explanation of the present invention, the near side in a binding device attached to a cover of a file is called "front side", the far side is called "back side", a direction from the near side to the far side is called "longitudinal direction, a direction intersecting the longitudinal direction is called "a widthwise direction", directions of up-and-down axes intersecting the longitudinal direction (a front and back axis) and the widthwise direction (a left and right axis) are called, "up direction", "down direction", and "up-and-down direction" or "height direction", the term "up" of the up direction, the down direction, and the up-and-down direction indicates an upper side and the term "down" of the up direction, the down direction, and the up-and-down direction indicates a lower side (see FIG. 55).

BRIEF DESCRIPTION OF THE DRAWINGS

FIG. 12A are views for explaining states of a biasing member in a hold state and an open state of the binding device, FIG. 12A(1) is a view for explaining the state of the biasing member in the hold state, and FIG. 12A(2) is a view for explaining the state of the biasing member in the open state;

FIGS. 34A (1) to 34A(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34B(1) to 34B(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34C(1) to 34C(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34D(1) to 34D(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34E(1) to 34E(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34F(1) to 34F(3) are views for explaining a relationship between a projection portion and an engagement body of an operation member in a binding device provided with a rotary lock mechanism according to a third embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34G(1) to 34G(3) are views for explaining a relationship between the projection portion and the engagement body of an operation member in a binding device provided with a rotary lock mechanism according to the third embodiment in a locked state, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34H(1) to 34H(3) are views for explaining a relationship between the projection portion and the engagement body of an operation member in a binding device provided with a rotary lock mechanism according to the third embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34I(1) to 34I(3) are views for explaining a relationship between the projection portion and the engagement body of an operation member in a binding device provided with a rotary lock mechanism according to the third embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34J(1) to 34J(3) are views for explaining a relationship between the projection portion and the engagement body of an operation member in a binding device provided with a rotary lock mechanism according to the third embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34K(1) to 34K(3) are views for explaining a relationship between the projection portion and the engagement body of an operation member in a binding device provided with a rotary lock mechanism according to the third embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 34L(1) to 34L(3) are views for explaining a relationship between the projection portion and the engagement body of an operation member in a binding device provided with a rotary lock mechanism according to the third embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39A(1) to 39A(3) are views for explaining a relationship between a projection portion and an engagement body of an operation member in a binding device provided with a rotary lock mechanism according to a fourth embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39B(1) to 39B(3) are views for explaining a relationship between a projection portion and an engagement body of an operation member in a binding device provided with a rotary lock mechanism according to a fourth embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39C(1) to 39C(3) are views for explaining a relationship between a projection portion and an engagement body of an operation member in a binding device provided with a rotary lock mechanism according to a fourth embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39D(1) to 39D(3) are views for explaining a relationship between a projection portion and an engagement body of an operation member in a binding device provided with a rotary lock mechanism according to a fourth embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39E(1) to 39E(3) are views for explaining a relationship between a projection portion and an engagement body of an operation member in a binding device provided with a rotary lock mechanism according to a fourth embodiment at a movement time from an unlocked state to a locked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39F(1) to 39F(3) are views for explaining a relationship between a projection portion and an engagement body of an operation member in a binding device of another embodiment provided with a rotary lock mechanism according to the fourth embodiment in a locked state, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39G(1) to 39G(3) are views for explaining a relationship between the projection portion and then engagement body of the operation member in the binding device of another embodiment provided with a rotary lock mechanism according to the fourth embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39H(1) to 39H(3) are views for explaining a relationship between the projection portion and then engagement body of the operation member in the binding device of another embodiment provided with a rotary lock mechanism according to the fourth embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39I(1) to 39I(3) are views for explaining a relationship between the projection portion and then engagement body of the operation member in the binding device of another embodiment provided with a rotary lock mechanism according to the fourth embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

FIGS. 39J(1) to 39J(3) are views for explaining a relationship between the projection portion and then engagement body of the operation member in the binding device of another embodiment provided with a rotary lock mechanism according to the fourth embodiment at a movement time from a locked state to an unlocked state in a time-series order, where a view shown in an upper side is a plan diagrammatical view of the projection portion and the engagement body of the operation member, a view shown in a central portion is a side diagrammatical view of the projection portion and the engagement body of the operation member, and a view shown in a lower side is a bottom face diagrammatical view of the projection portion and the engagement body of the operation member;

MODE FOR CARRYING OUT THE INVENTION

Figure 1:
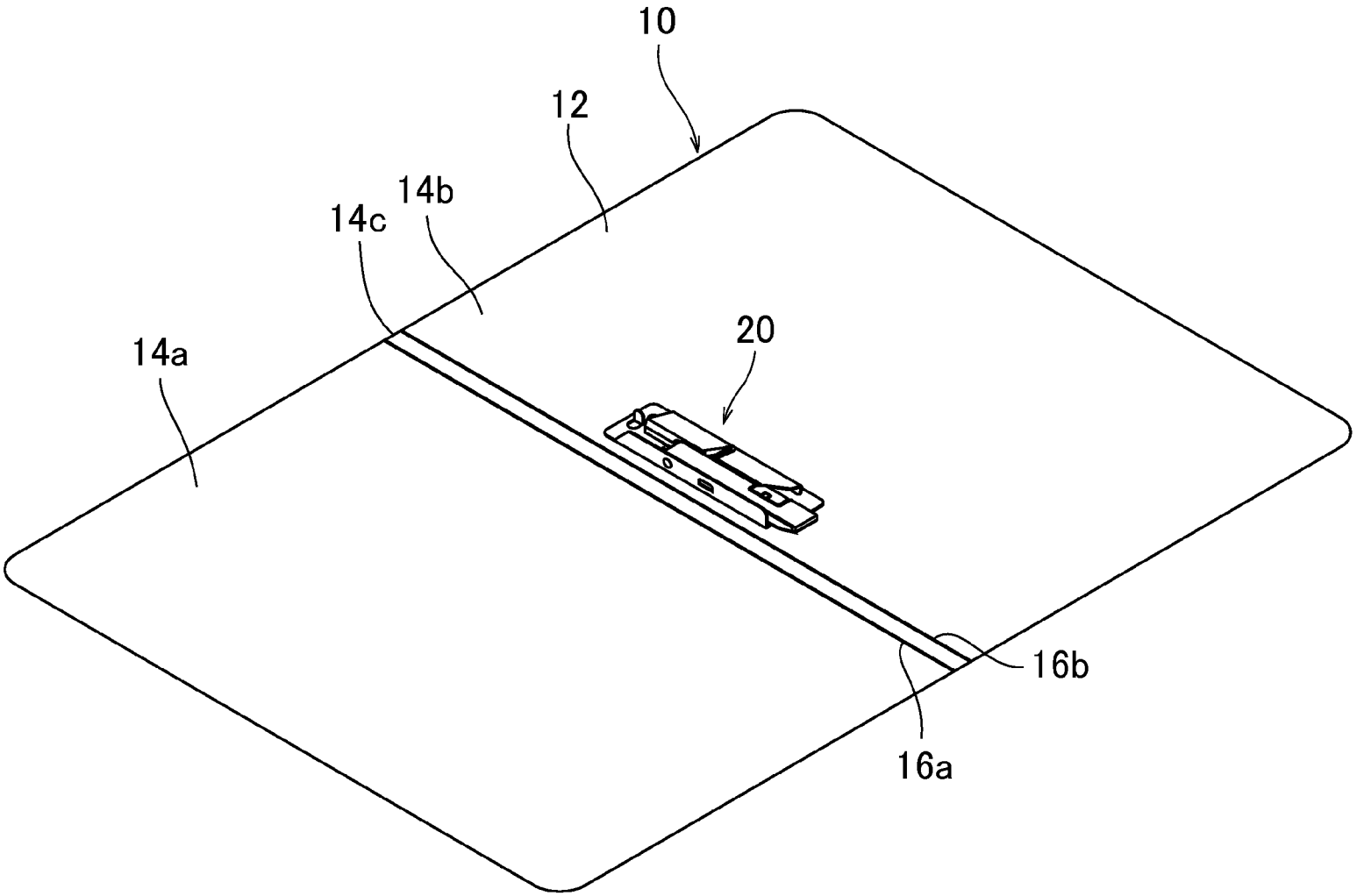
FIG. 1 is a perspective view of a file attached with a binding device which is a first embodiment of the present invention.
Figure 2:
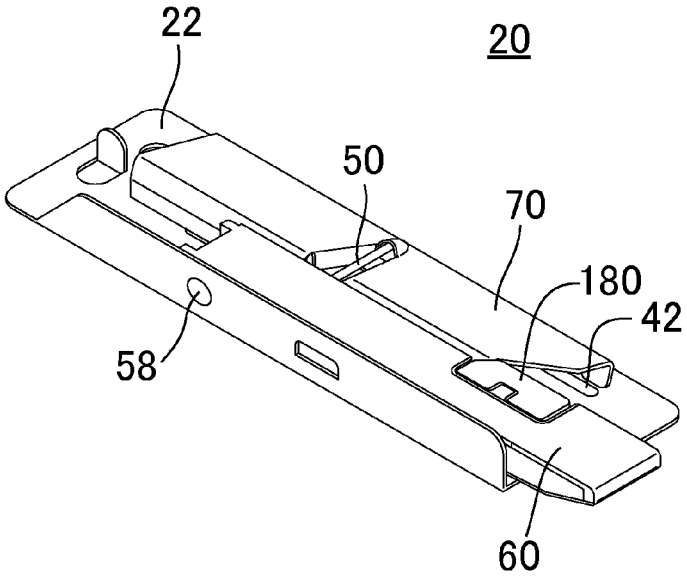
FIG. 2 is a perspective view showing the binding device which is the first embodiment of the present invention.
Figure 3:
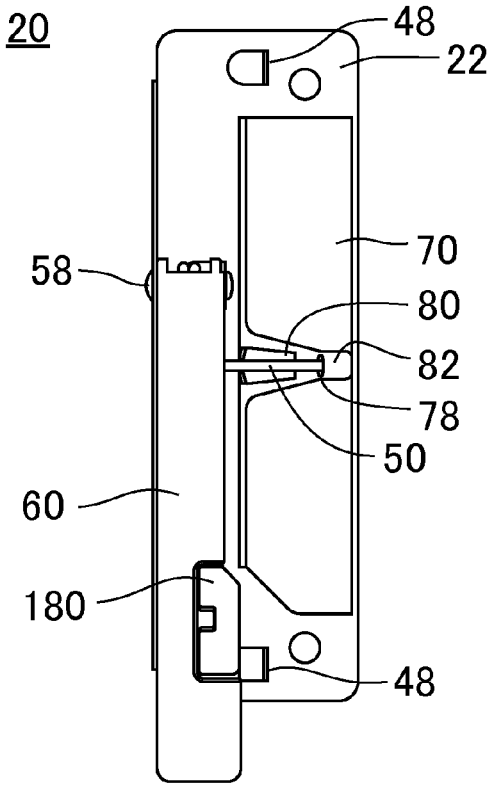
FIG. 3 is a plan diagrammatical view of the binding device shown in FIG. 1.
Figure 4A:
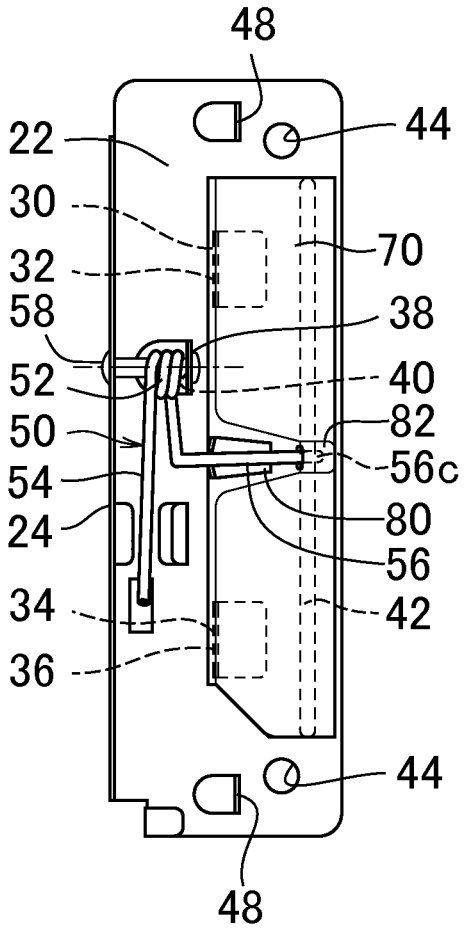
FIGS. 4A and 4B are views for explaining a positional relationship of respective members in the binding device shown in FIG. 1.
Figure 4B:
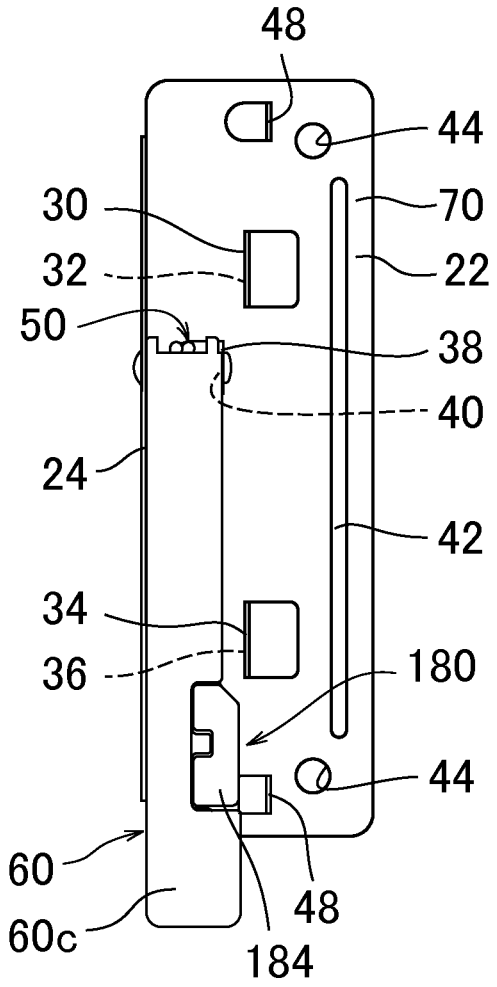
Figure 5:
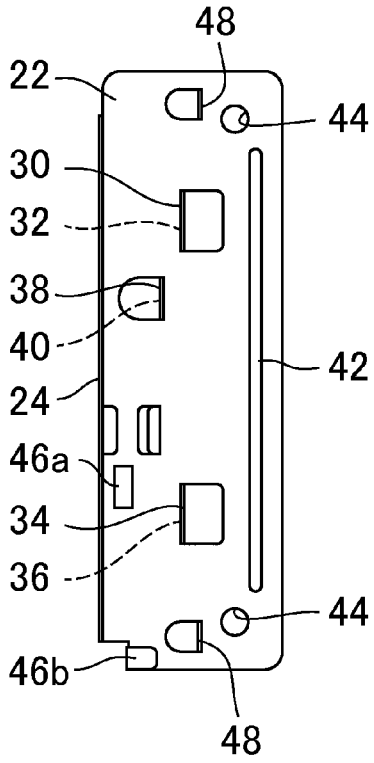
FIG. 5 is a plan diagrammatical view of a stand member of the binding device shown in FIG. 1.
Figure 6A:
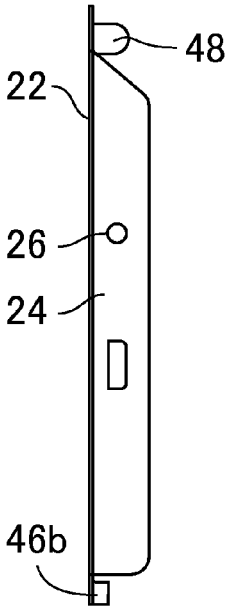
FIGS. 6A and 6B are side diagrammatical views of the stand member of the binding device shown in FIG. 1.
Figure 6B:
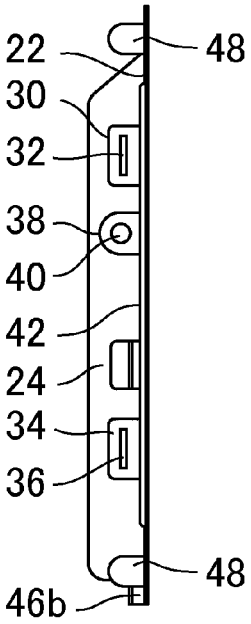
Figure 7:
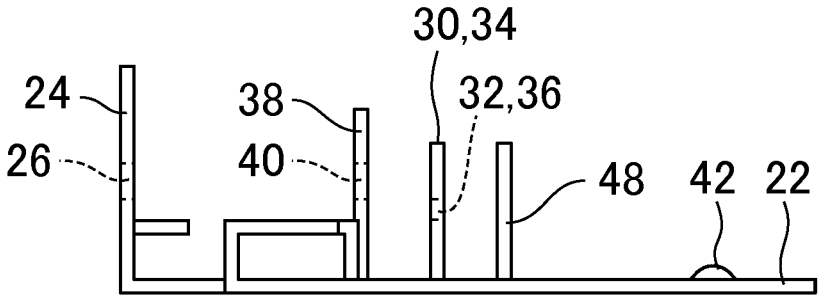
FIG. 7 is a front diagrammatical view of the stand member of the binding device shown in FIG. 1.
Figure 8A:
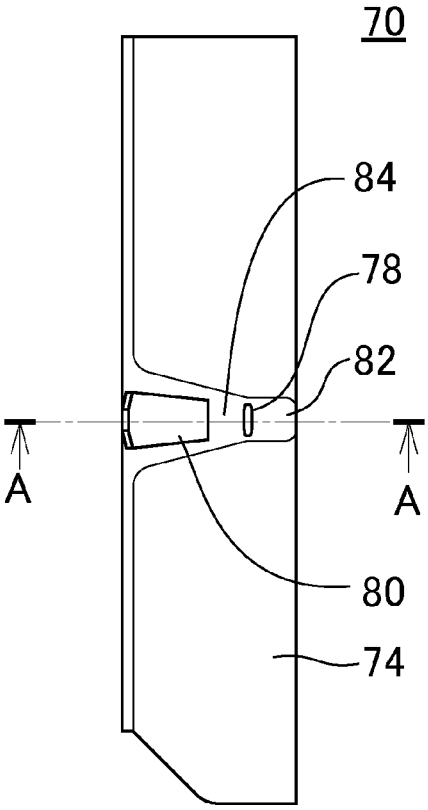
FIGS. 8A and 8B are plan diagrammatical views of a binding member of the binding device shown in FIG. 1.
Figure 8B:
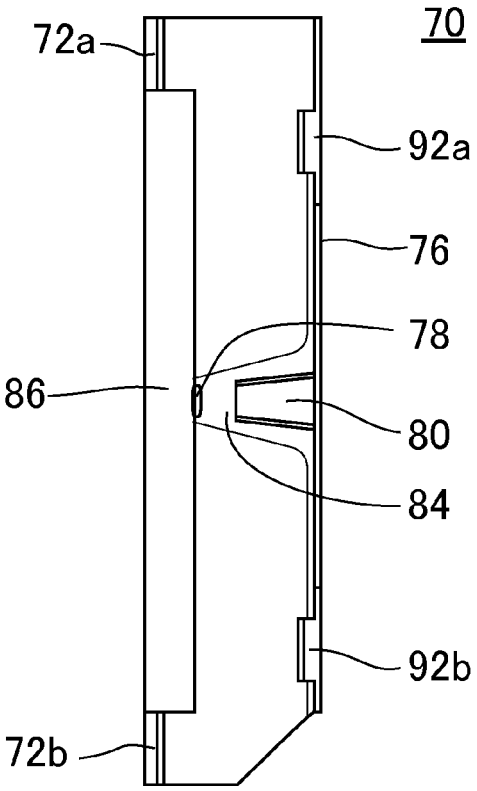
Figure 9A:
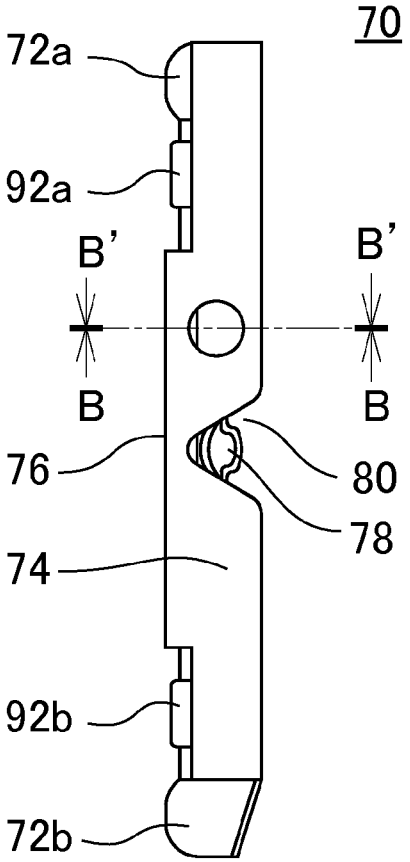
FIGS. 9A and 9B are side diagrammatical views of the binding member of the binding device shown in FIG. 1.
Figure 9B:
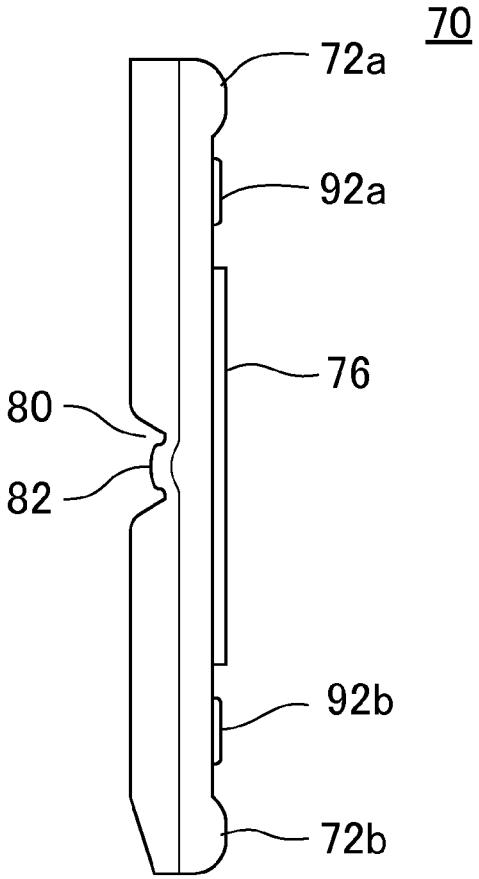
Figure 10A:
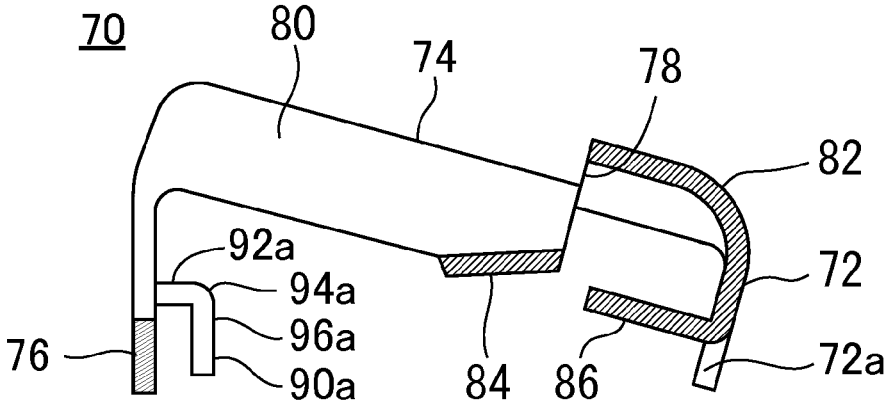
FIG. 10A is a sectional diagrammatical view of the binding member of the binding device shown in FIG. 8A, and FIGS. 10B and 10C are sectional diagrammatical views of the binding member of the binding device shown in FIG. 9A.
Figure 10B:
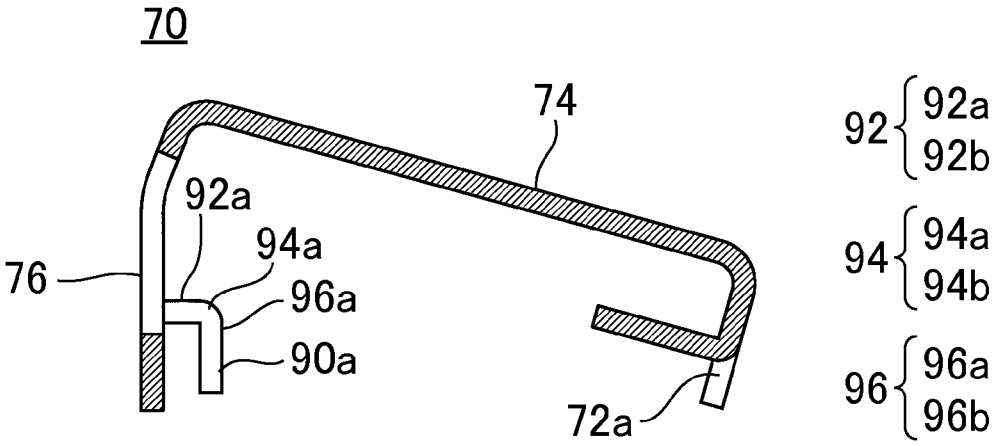
Figure 10C:
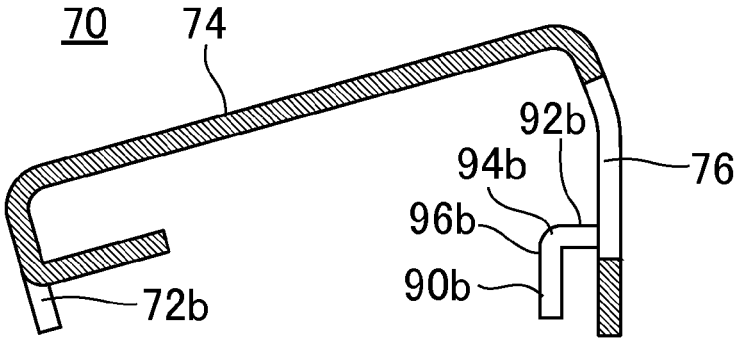
Figure 11A:
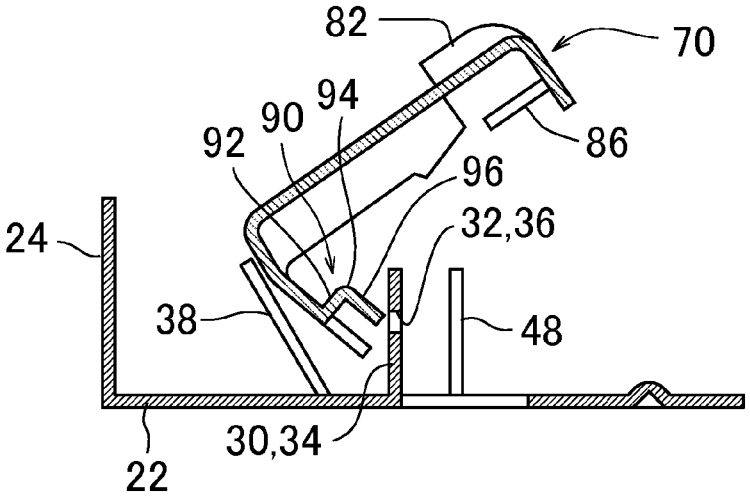
FIGS. 11A to 11C are sectional diagrammatical views for explaining how to assemble the stand member and the binding member shown in FIG. 1 with each other.
Figure 11B:
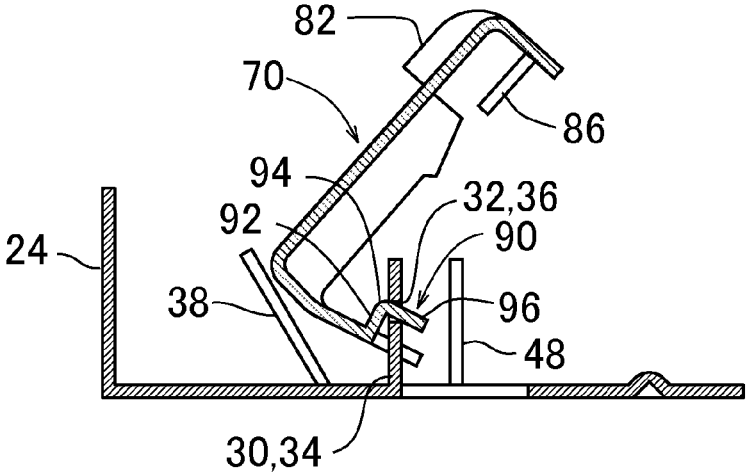
Figure 11C:
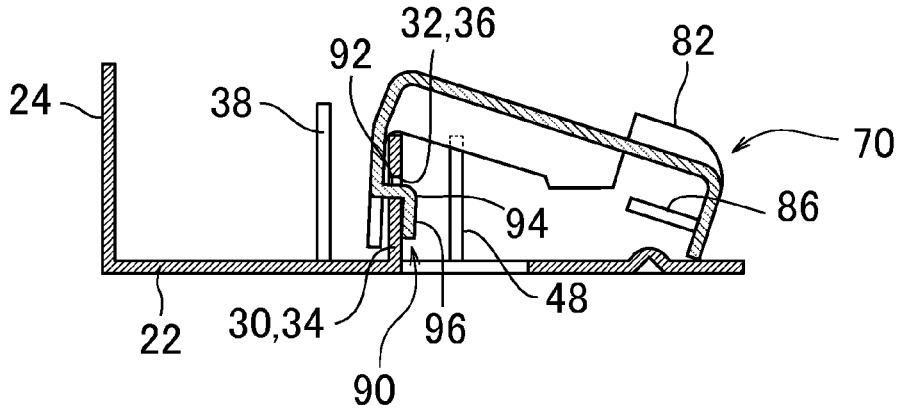
Figure 12B:
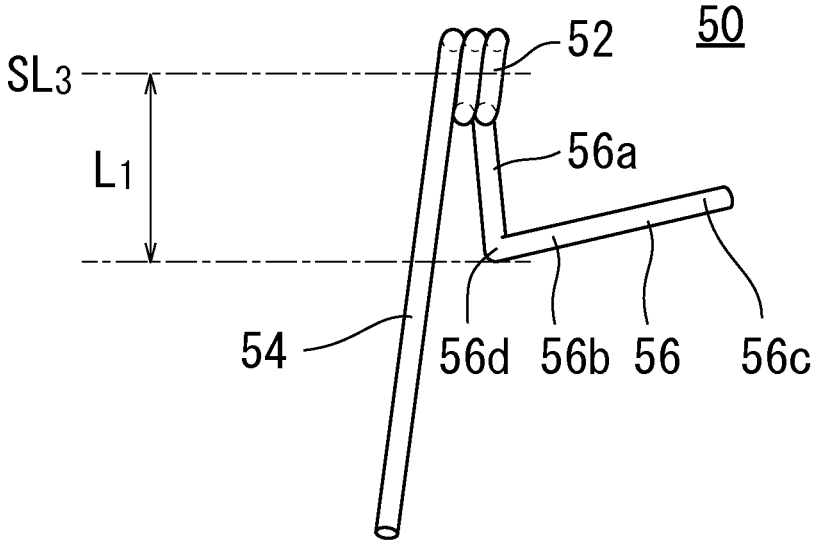
FIG. 12B is a view showing the biasing member.

FIG. 1 is a perspective view of a file attached with a binding device which is a first embodiment of the present invention. FIG. 2 is a perspective view showing the binding device which is the first embodiment of the present invention. FIG. 3 is a plan diagrammatical view of the binding device shown in FIG. 1. FIGS. 4A and 4B are views for explaining a positional relationship of respective members in the binding device shown in FIG. 1. FIG. 5 is a plan diagrammatical view of a stand member of the binding device shown in FIG. 1. FIGS. 6A and 6B are side diagrammatical views of the stand member of the binding device shown in FIG. 1. FIG. 7 is a front diagrammatical view of the stand member of the binding device shown in FIG. 1. FIGS. 8A and 8B are plan diagrammatical views of a binding member of the binding device shown in FIG. 1. FIGS. 9A and 9B are side diagrammatical views of the binding member of the binding device shown in FIG. 1. FIG. 10A is a sectional diagrammatical view of the binding member of the binding device shown in FIG. 8A, and FIGS. 10B and 10C are sectional diagrammatical views of the binding member of the binding device shown in FIG. 9A. FIGS. 11A to 11C are sectional diagrammatical views for explaining how to assemble the stand member and the binding member shown in FIG. 1 with each other. FIGS. 12A(1) and 12A(2) are views for explaining states of a biasing member in a hold state and an open state of the binding device, FIG. 12A(1) is a view for explaining the state of the biasing member in the hold state, and FIG. 12A(2) is a view for explaining the state of the biasing member in the open state. FIG. 12B is a view showing the biasing member.

In general, a binding device 20 for binding a material to be bound X such as papers is attached to an inner face of a cover body 12 of a file 10.

The cover body 12 is provided with a front cover 14*a*, a back cover 14*b*, and a spine cover 14*c*, and is provided with a folded portion 16*a* formed between the front cover 14*a* and the spine cover 14*c* and a folded portion 16*b* formed between the back cover 14*b* and the spine cover 14*c*.

The binding device 20 is provided with a base plate 22 serving as a plate-shaped base member, and a binding member 70 having a pressing portion for pressing and holding the material to be bound X by a biasing force of a spring member 50 serving as a biasing member on the base member.

The binding device 20 is provided with an operation lever 60 which is an operation member attached to the stand member so as to be movable (openable and closable) to a holding state (locked state) where the binding member 70 presses the material to be bound X and to an open state (unlocked state) where the binding member 70 separates from the material to be bound X, and a locking means for putting the operation lever 60 in the locked state Further, the binding device 20 is provided with the spring member 50 serving as the biasing member mounted on the base member, coupled to the operation lever 60 and coupled to the binding member 70, and biasing the binding member 70 in a direction of pressing the material to be bound X.

The base plate 22 is provided with binding member supporting portions (a first binding member supporting portion 30 and a second binding member supporting portion 34) in the vicinity of a region where the operation lever 60 is mounted.

The binding member 70 is provided with an engagement portion 90 for swinging so as to open and close between the hold state (locked state) of pressing the material to be bound X and the open state (unlocked state) of separating from the material to be bound X.

The engagement portion 90 constitutes a binding member supporting mechanism for pivotally attaching the binding member 70 to the base plate 22.

The spring member 50 serving as the biasing member is coupled to the binding member 70 such that one portion (a spring first end portion 56) thereof extends toward a pressing portion 72 of the binding member 70 to operate the binding member 70 to pivot the same about the engagement portion 90 to the hold state of pressing the material to be bound X and to the open state of separating from the material to be bound X.

The spring member 50 and the binding member 70 constitutes a material-to-be-bound pressing mechanism for pressing the material to be bound X.

The base plate 22 which is the plate-shaped main body constituting the base member formed of a thin plate made of metal is provided with a bearing portion constituting an operation member attaching portion at a linear longitudinal end edge at one end portion (left end portion) of the base plate 22 in a widthwise direction thereof, and the bearing portion is composed of a bearing plate 24 having an erected face portion erected to the base plate 22 and a bearing plate 38 having a face parallel to a face of the bearing plate 24, as shown in FIG. 5 to FIG. 7.

The bearing plate 24 is formed integrally with the base plate 22, and the bearing plate 38 is formed to erect from the bearing plate 22.

The bearing plate 24 is formed so as to extend continuously from the near side end edge of the base plate 22 to the far side end edge thereof in the longitudinal direction.

A circular pivot shaft fixing through-hole 26 constituting an operation member attaching portion is formed on one end side (the far side) of the bearing plate 24 in the longitudinal direction.

Regarding the pivot shaft fixing through-hole 26, a periphery of the pivot shaft fixing through-hole 26 on the bearing plate 24 is formed such that the far side thereof projects outward (to a side opposite to a face to which the operation lever 60 is attached) and the near side thereof projects inward (to the side to which the operation lever 60 is attached) in such a manner that the erected face portion of the bearing plate 24 facing the operation lever 60 and an axial direction of a shaft 58 fixing the operation lever 60 to the bearing plate 24 intersect obliquely, so that the operation lever 60 and the erected face portion of the bearing plate 24 are formed to be inclined to each other.

The first binding member supporting portion 30 is arranged in order to support the binding member 70 at a farther side beyond the far side end of the operation lever 60.

Further, a bearing plate 38 having a face parallel to the face of the bearing plate 24 is formed between these first binding member supporting portion 30 and second binding member supporting portion 34 on a side nearer the bearing plate 24 than a line connecting a holding hole 32 of the first binding member supporting portion 30 and a holding hole 36 of the second binding member supporting portion 34 and on a side spaced from the bearing plate 24 by a proper distance. The bearing plate 38 is formed by forming a U-shaped cut in the base plate 22 and raising this portion, and is wholly formed to obliquely intersect the erected face portion of the bearing plate 24 serving as the bearing portion of the operation lever 60. That is, formation is made such that the axial direction of the shaft 58 for fixing the operation lever 60 to the bearing plate 24 obliquely intersects the erected face portion of the bearing plate 24 serving as the bearing portion of the operation lever 60 and becomes parallel to the periphery of the pivot shaft fixing through-hole 26.

A circular through-hole 40 is formed in the bearing plate 38, and the pivot shaft fixing through-hole 26 of the bearing plate 24 and the through-hole 40 of the bearing plate 38 are arranged so as to face each other. That is, the line connecting the holding hole 32 of the first binding member supporting portion 30 and the holding hole 36 of the second binding member supporting portion 34 and the line connecting the pivot shaft fixing through-hole 26 of the bearing plate 24 and the through-hole 40 of the bearing plate 38 are formed so as to intersect each other obliquely.

At least two binding member supporting portions (the first binding member supporting portion 30 and the second binding member supporting portion 34) are provided in a projecting fashion with a proper distance from the bearing plate 24 and with an interval therebetween in the longitudinal direction of the operation member 60 serving as an operation member. The first binding member supporting portion 30 is formed on the far side of a formation portion of the pivot shaft fixing through-hole 26 on the bearing plate 24 such that a principal face of the first binding member supporting portion 30 supporting the binding member 70 becomes parallel to the principal face of the bearing plate 24. The holding hole 32 which is rectangular in a front view is formed in the first binding member supporting portion 30.

Further another second binding member supporting portion 34 having a face parallel to the principal face of the first binding member supporting portion 30 is formed in order to support the binding member 70 on a nearer side than the far side of the operation lever 60. The holding hole 36 which is rectangular in a front view is formed in the second binding member supporting portion 34.

The first binding member supporting portion 30 and the second binding member supporting portion 34 are formed by forming a U-shaped cut in the base plate 22 and raising this portion.

A pair of holding hole 32 and holding hole 36 positioned in front and behind are rectangular in a front view, extend in the longitudinal direction of the base plate 22 and are formed at the same height from the upper face of the base plate 22.

These first binding member supporting portion 30 and second binding member supporting portion 34 are plate-shaped bodies arranged in parallel in the longitudinal direction of the binding member 70. Arrangement is performed such that a line connecting the principal face of the first binding member supporting portion 30 and the principal face of the second binding member supporting portion 34 become parallel to the principal face of the bearing plate 24 positioned on the side of the base plate 22, and faces of a plurality of binding member supporting portions (the first binding member supporting portion 30 and the second binding member supporting portion 34) are arranged in parallel to a plane spreading in the longitudinal direction of the binding member 70 toward the side of the binding member 70.

The binding member 70 has a pressing portion 72 for pressing the material to be bound X, a bridging portion 74 provided to connect to the pressing portion 72, and a standing portion 76 formed on an opposite side of the bridging portion 74 to the pressing portion 72.

[Binding Member Supporting Mechanism]

The binding member supporting mechanism for pivotally attaching the binding member 70 to the base plate 22 is composed of the engagement portion 90 provided on the standing portion 76 so as to project toward the pressing portion 72 side, the first binding member supporting portion 30 and the second binding member supporting portion 34.

As the engagement portion 90 of the binding member 70, at least two portions are formed on the standing portion 76 which is an end edge opposite to the pressing portion 72 for pressing the material to be bound X so as to be spaced from each other in the longitudinal direction.

The engagement portions 90 are formed with supporting projection portions 92 so as to be caused to engage with the holding hole 32 of the first binding member supporting portion 30 and the holding hole 36 of the second binding member supporting portion 34, and be capable of swinging the binding member 70.

The supporting projection portion 92 is an approximately L-shaped portion in section or an approximately J-shaped portion in section provided so as to project from the standing portion 76 which is the end edge of the binding member 70 opposite to the pressing portion 72. The supporting projection portion 92 is provided with a plate-shaped supporting base portion 94 intersecting the standing portion 76 perpendicularly and a plate-shaped hanging portion 96 intersecting the supporting base portion 94 perpendicularly and parallel to the standing portion 76.

The holding hole 32 and the holding hole 36 are positioned at the same height spaced from the principal face of the base plate 22 by the same distance, and all the supporting base portions 94 of a plurality of engagement portions 90 engaged with the holding hole 32 and the holding hole 36 to be supported are constituted so as to be positioned at the same height spaced from the principal face of the base plate 22 by the same distance.

Further, the supporting projection portions 92 are held in a lower portion of a region of the end edge side of the binding member 70 facing the pressing portion 72 for pressing the material to be bound X such that the supporting base portions 94 are caused to engage with lower portions of the holding hole 32 and the holding hole 36 and can swing the binding member 70

The supporting projection portions 92 hang down from the lower portions of the holding hole 32 and the holding hole 36 downward such that the hanging portions 96 which are distal end sides extending from the regions (the supporting base portions 94) caused to engage with the lower portions of the holding hole 32 and the holding hole 36 do not get out of the holding hole 32 and the holding hole 36 at a swinging time of the binding member 70.

The supporting projection portions 92 are provided so as to project toward the side of the pressing portion 72 with a space from the end edge facing the pressing portion 72 of the binding member 70 such that they can be inserted from their distal ends into the holes of the holding hole 32 and the holding hole 36 in a state where the first binding member supporting portion 30 and the second binding member supporting portion 34 have been provided so as to project toward the arrangement side of the binding member 70 in the base plate 22 serving as the base member.

The standing portions 76 of the binding member 70 are formed with the supporting projection portions 92 at lower portions of the left and right ends thereof and are cut in a region formed with the supporting projection portions 92 such that they do not constitute blocks when the supporting projection portions 92 are inserted into and caused to engage with the holding hole 32 of the first binding member supporting portion 30 and the holding hole 36 of the second binding member supporting portion 34. Since spaces obtained by forming a cut between the lower end of the bridging portion 74 and the supporting projection portions 92 are provided, the supporting projection portions 92 can be attached to the first binding member supporting portion 30 and the second binding member supporting portion 34 without abutting on regions erected on the principal face of the base plate 22 in a projecting fashion (see FIG. 9A).

In this embodiment, regarding the supporting projection portions 92, a pair of supporting portions 92 positioned in front and behind are arranged in parallel along the longitudinal direction of the binding member 70 with a space corresponding to the space between the first binding member supporting portion 30 and the second binding member supporting portion 34. The supporting members 92 are plate-shaped bodies where a first supporting projection portion 92*a* on the near side and a second supporting projection portion 92*b* on the far side have the same shape.

The first supporting projection portion 92*a* and the second supporting projection portion 92*b* are both bent from the end edge of the biding member 70 toward the pressing portion 72 to be formed with the supporting base portions 94 and are bent from the supporting base portions 94 downward to be formed with the hanging portions 96. A shape formed by the standing portion 76, the first supporting projection portion 92*a* and the second supporting projection 92*b* is an approximately h-shaped in a front view.

The first supporting projection portion 92*a* is provided with a plate-shaped first supporting base portion 94*a* intersecting the standing portion 76 perpendicularly and a plate-shaped first handing portion 96*a* intersecting the first supporting base portion 94*a* perpendicularly and parallel to the standing portion 76

The second supporting projection portion 92*b* is provided with a plate-shaped second supporting base portion 94*b* intersecting the standing portion 76 perpendicularly and a plate-shaped second hanging portion 96*b* intersecting the second supporting base portion 94*b* perpendicularly and parallel to the standing portion 76.

The first supporting projection portion 92*a* and the second supporting projection portion 92*b* are projected from the standing portion 76 by the same length. The first supporting projection portion 92*a* and the second supporting projection portion 92*b* are formed so as to project in a horizontal direction when the binding member 70 is attached to the first binding member supporting portion 30 and the second binding member supporting portion 34. Therefore, the first supporting projection portion 92*a* and the second supporting projection portion 92*b* are positioned at the same height spaced from the principal face of the base plate 22 by the same distance when they are attached to the first binding member supporting portion 30 and the second binding member supporting portion 34.

The first supporting projection portion 92*a* and the second supporting projection portion 92*b* are formed such that the first supporting base portion 94*a* and the second supporting base portion 94*b* has the same height, and the holding hole 32 of the first binding member supporting portion 30 and the holding hole 36 of the second binding member supporting portion 34 caused to engage with the first supporting projection portion 92*a* and the second supporting projection portion 92*b* are formed to have the same height.

Thus, the binding member 70 attached to the first binding member supporting portion 30 and the second binding member supporting portion 34 is configured such that a grounding portion 72*a* of the pressing portion 72 on the far side and a grounding portion 72*b* on the near side are parallel to the base plate 22 so that they simultaneously press the material to be bound X at the same pressing force.

Further, the first supporting projection portion 92*a* and the second supporting projection portion 92*b* are formed such that the first supporting projection portion 92*a* and the second supporting projection portion 92*b* can be inserted from the distal ends of the respective hanging portions 96 into the respective holes of the holding hole 32 and the holding hole 36 in a state where the binding member supporting portions (the first binding member supporting portion 30 and the second binding member supporting portion 34) have been provided on the base plate 22 serving as the base member in a projecting fashion.

In this embodiment, since spaces between the bearing plate 38, and the first binding member supporting portion 30 and the second binding member supporting portion 34 are made narrow so as to arrange the binding member 70 so as to be nearer the operation lever 60 side, the bearing plate 38 is slightly fallen toward the first binding member supporting portion 30 side so as to be spaced from the first binding member supporting portion 30 and the second binding member supporting portion 34 before the first supporting projection portion 92*a* and the second supporting projection portion 92*b* are inserted into the holding hole 32 and the holding hole 36, respectively (see FIG. 11A).

The first binding member supporting portion 30 and the second binding member supporting portion 34 are erected from the base plate 22 toward the arrangement side of the binding member 70 to be provided to be perpendicular to the principal face of the base plate 22 in a standing fashion (see FIG. 11A).

The first supporting projection portion 92*a* and the second supporting projection portion 92*b* are respectively inserted into the holding hole 32 and the holding hole 36 by allocating the lower end of the first hanging portion 96*a* which is the distal end of the first supporting projection portion 92*a* to a hole edge of the holding hole 32 of the first binding member supporting portion 30 and allocating the lower end of the second hanging portion 96*b* which is the distal end of the second supporting projection portion 92*b* to a hole edge of the holding hole 36 of the second binding member supporting portion 34 and pulling the pressing portion 72 in a direction separating from the first binding member supporting portion 30 and the holding hole 32 (a direction of separating from the bearing plate 24) (see FIG. 11B).

The bearing plate 38 which has been slightly inclined is caused to stand up to be perpendicular to the principal face of the base plate 22 after the binding member 70 has been coupled to the first binding member supporting portion 30 and the second binding member supporting portion 34 (see FIG. 11C).

Further, a ridge 42 is formed on the other end side (the right end portion) of the base plate 22 in the widthwise direction. The ridge 42 is formed in parallel with a proper distance in the widthwise direction of the base plate 22. A pair of base plate-fixing through-holes 44 for attaching the binding device 20 to a file or the like are formed on both sides of the base plate 22 in the longitudinal direction on the far side and the near side, so that the binding device 20 is attached to the file or the like by inserting and fitting rivets into the base plate-fixing through-holes 44.

[Material-to-be-Bound Pressing Mechanism]

A shaft 58 is inserted into the pivot shaft-fixing through-hole 26 of the bearing plate 24 and the through-hole 40 of the bearing plate 38, and the spring member 50 composed of a torsion coil spring and the operation lever 60 serving as the operation member are attached to the shaft 58.

The operation lever 60 is provided with a lock mechanism for obtaining a locked state on the base plate 22.

The lock mechanism is provided with an engagement body 120 provided on the side of the operation lever 60 (the side opposite to the bearing plate 24), an engagement body supporting portion 180 attached with the engagement body 120, and a projection portion 100 provided on the operation lever 60.

The spring member 50 serving as the biasing member is configured such that one portion thereof extends from the side of the operation lever 60 serving as the operation member toward the pressing portion 72 of the binding member 70 to operate the pressing portion 72 of the binding member 70 so as to move the same to a hold state of pressing the material to be bound X and to an open state of separating from the material to be bound X about the side of the operation lever 60 serving as the operation member of the binding member 70.

The binding member 70 has the pressing portion 72 having a widthwise direction extending from the side of the operation lever 60 serving as the operation member and has the pressing portion 72 on approximately the same straight line as a straight line SL1 including an end edge of the binding member 70 on the opposite side to the operation lever 60 serving as the operation member in a plan view of the binding member 70, and the one portion of the spring member 50 serving as the biasing member extends in the widthwise direction of the binding member 70 to be positioned in the vicinity of the straight line SL1 including the end edge of the binding member 70 and be positioned in the vicinity of the central portion m of the binding member 70 in the longitudinal direction.

The spring member 50 has a winding portion 52 wound on an outer periphery of the shaft 58, a first end portion 56 extending from one end (right end portion) of the winding portion 52 to the side of the binding member 70, and a second end portion 54 extending from the other end (left end portion) of the winding portion 52 on the side of the bearing plate 24 to the side of the operation lever 60 straightly.

The shaft 58 and the winding portion 52 of the spring member 50 are bridged between the bearing plate 24 and the bearing plate 38 so as to intersect the bearing plate 24 obliquely.

The one portion (the spring first end portion 56) of the spring member 50 serving as the biasing member is formed so as to move in the up direction, namely, in a direction where the bearing plate 24 stands up, when the operation lever 60 serving as the operation member is operated such that the binding member 70 moves from the holding state of pressing the material to be bound X to the open state of separating from the material to be bound X in an opening and closing manner.

The spring member 50 is configured such that the one portion (the spring the first end portion 56) extends toward the pressing portion 72 of the binding member 70 so that the spring member 50 pivots the binding member 70 about the engagement portion 90 in order to open and close the binding member 70 to the hold state of pressing the material to be bound X and to the open state of separating from the material to be bound X.

The spring second end portion 54 of the spring member 50 is formed such that it extends straightly from the upper end on the rear side to the near side on the side of the bearing plate 24 of the winding portion 52, and when the distal end of the spring second end portion 54 is not subjected to an external force, the distal end extends obliquely upwardly to the near side.

The spring first end portion 56 is provided with a spring standing portion 56*a* extending from the lower end of the spring first end portion 56 on the near side on the bearing plate 38 side of the winding portion 52 to the opposite side to the bearing plate 24, a spring bridging portion 56*b* extends from an upper end of the spring standing portion 56*a* extending upward obliquely downward such that when the spring first end portion 56 is not subjected to an external force, the spring bridging portion 56*b* forms an approximately L shape, and a spring catching portion 56*c* is formed on the side of a free end of the spring bridging portion 56*b*.

The spring first end portion 56 which is not subjected an external force and the spring second end portion 54 (particularly, the spring standing portion 56*a*) which is not subjected to an external force are formed in an approximately V shape extending in directions where they separate from each other to expand from the winding portion 52 to the distal ends thereof.

The shaft 58 for fixing the operation lever 60 and the spring member 50 to the base plate 22 is disposed in a section from the central portion m of the binding member 70 in the longitudinal direction to the far side end edge, and the shaft 58 is disposed to be closer to the central portion m, namely, in the vicinity of a first biasing member receiving portion 80, than the far side end edge of the binding member 70 in the longitudinal direction. The central portion m of the binding member 70 in the longitudinal direction means the center of a line connecting the far side end edge and the near side end edge of the binding member 70.

Further, the spring member 50 has a corner portion 56*d* bent approximately at a right angle in the first end portion 56 extending from the winding portion 52 to the binding member 70. When the binding device 20 is put in the hold state, the spring standing portion 56*a* extending from the winding portion 52 of the spring member 50 to the corner portion 56*d* is parallel to the longitudinal direction of the binding device 20, and the spring bridging portion 56*b* from the spring catching portion 56*c* which is the distal end of the spring 50 to the corner portion 56*d* is parallel to the widthwise direction of the binding device 20.

A length L1 from the corner portion 56*d* to the center of the winding member 52 (namely, a length approximately equal to the length of the spring standing portion 56*a*) is approximately equal to a length L2 between a straight line SL2 extending in the extension direction of the shaft 58 and the central line of the binding member 70 in the longitudinal direction (see FIG. 12B).

The central line of the binding member 70 in the longitudinal direction indicates a straight line SL4 running through the central portion m (the central portion of the line connecting the far side end edge and the near side end edge of the binding member 70) in the widthwise direction of the binding member 70.

The base plate 22 has the bearing plate 24 serving as a shaft fixing portion pivotally supporting one end of the shaft 58 and the bearing plate 38 formed at a position slightly shifted toward the far side beyond the pivot shaft fixing through-hole 26 of the bearing plate 24 and serving as the shaft fixing portion pivotally supporting the other end of the shaft 58.

Regarding the shaft 58 bridged between the pivot shaft fixing through-hole 26 of the bearing plate 24 and the through-hole 40 of the bearing plate 38 to be fixed, a portion thereof on the side of the bearing plate 38 which is the binding member 70 side thereof is fixed to the through-hole 40 of the bearing plate 38 at a position rotated on a horizontal plane about the bearing plate 24 side of the shaft 58 in a direction of separating from the free end of the operation lever 60.

The shaft 58 fixing the operation lever 60 and the spring member 50 to the base plate 22 can change the slope of the straight line SL2 extending in the extension direction of the shaft 58 to the straight line on the center axis SL3 of the winding portion 52 of the spring member 50 between the hold state and the open state (see FIGS. 12A(A) and 12A(B)).

That is, an inner diameter of the winding portion 52 is provided with a slight clearance between the same and an outer diameter of the shaft 58. Further, a length from the bearing plate 24 of the base plate 22 to the bearing plate 38 is set to be sufficient to the width of the winding portion 52 (a width of the winding portion 52 in the widthwise direction of the binding device 20) in the center axis direction of the winding portion 52. With such a configuration, the winding portion 52 can be inclined to the extension direction of the shaft 58.

Here, explanation will be made through comparison with the case where a configuration where the inclination of the center axis of the winding portion 52 of the spring member 50 cannot be changed to the shaft 58 is adopted.

When the binding device 20 is put in the hold state, the spring bridging portion 56*b* is approximately parallel to the center axis of the winding portion 52, namely, the shaft 58, and the spring bridging portion 56*b* is positioned at the central portion of the binding member 54 in a plan view of the binding device 20 and has been inserted into the through-hole 78.

When the binding device 20 moves from the hold state to the open state, the spring bridging portion 56*b* is rotated about the center axis of the wining portion 52, namely, the shaft 58 to move slightly to the upper right as the binding device 20 is viewed from the right side.

On the other hand, when the binding device 20 moves from the hold state to the open state, the through-hole 78 of the binding member 70 moves to just above as the binding device 20 is viewed from the right side according to pivoting of the binding member 70 about the line connecting the pair of first supporting projection portion 92*a* and the second supporting projection portion 92*b* positioned front and behind.

However, when the slope of the center axis of the winding portion 52 of the spring member 50 cannot be changed to the shaft 58, the spring bridging portion 56*b* of the spring member 50 and the through-hole 78 of the binding member 70 are different in moving direction when the binding device 20 moves from the hold state to the open state, so that there is a possibility that when the binding device 20 moves from the open state to the hold state while a state where the spring bridging portion 56*b* has been inserted into the through-hole 78 is maintained, a load acts on a contact portion between the spring bridging portion 56*b* and the through-hole 78. Therefore, a smooth movement between the open state and the hold state may become difficult.

However, since the binding device 20 of the present invention has a configuration where the slope of the center axis of the winding portion 52 can be changed to the shaft 58, even when the binding device 20 moves from the hold state to the open state, the center axis of the winding portion 52 moves according to movement of the through-hole 78 to just above as the binding device 20 is viewed from the right side, so that the binding device 20 can move from the hold state to the open state without imparting a large load at the contact portion between the spring bridging portion 56*b* and the through-hole 78 while the state where the spring member 50 has been inserted in the through-hole 78 is maintained.

The shaft 58 for fixing the operation lever 60 and the spring member 50 to the base plate 22 is arranged in a section from the central portion m of the binding member 70 to the far side end edge thereof, and the shaft 58 is arranged nearer the central portion m, namely in the vicinity of the first biasing member receiving portion 80, than the far side end edge in the longitudinal direction, but explanation will be here made through comparison with the case where the shaft 58 is not arranged at the central portion m of the binding member 70 in the longitudinal direction but in the vicinity of the far side edge.

When the shaft 58 is arranged in the vicinity of the far side end edge, the length from the straight line in the extension direction of the shaft 58 to the central line of the binding member 70 in the longitudinal direction becomes large, resulting in a binding device having a configuration where the length L1 from the corner portion 56*d* to the center of the winding portion 52 (namely, a length approximately equal to the spring standing portion 56*a*) which is approximately equal to the former length is also large.

As described previously, in the case where the binding device 20 has the configuration where the slope of the center axis of the winding portion 52 cannot be changed to the shaft 58, when the binding device 20 moves from the hold state to the open state, the spring bridging portion 56*b* is rotated about the center axis of the winding portion 52, namely, the shaft 58, so that the binding device 20 moves slightly to the upper right as viewed from the right side, but when the length L1 (radius L1) from the center axis SL3 of the winding portion 52 to the corner portion 56*d* becomes large, the movement distance of the binding device 20 to the upper right becomes large accordingly as viewed from the right side. Even if the configuration where the slope of the center axis SL3 of the winding portion 52 can be changed to the shaft 58 is adopted, when the movement distance is large, the winding portion 52 must be inclined largely correspondingly, but since there is a limitation regarding the slope of the winding portion 52 to the shaft 58*d*, when the binding device 20 moves from the hold state to the open state, a large load is imparted to the contact portion between the spring bridging portion 56*b* and the through-hole 78.

However, since the binding device 20 of the present invention is configured such that the shaft 58 is arranged near to the central portion m of the binding member 70 in the longitudinal direction, namely, in the vicinity of the first biasing member receiving portion 80, than the far side end edge of the binding member 70 so that the length L2 (radius L1) from the center axis SL3 of the winding portion 52 to the corner portion 56*d* is made small, the binding device 20 can move smoothly from the hold state to the open state without imparting a large load to the contact portion between the spring bridge portion 56*b* and the through-hole 78.

In the spring member 50, the winding portion 52 is mounted about the shaft 58 between the bearing plate 24 serving as the shaft fixing portion and the bearing plate 38 so as to be approximately parallel to the base plate 22, and the spring second end portion 54 which is not subjected to the external force extends in the longitudinal direction of the base plate 22 along the inside of the bearing plate 24 and is fixed to the operation lever 60 approximately in parallel to the longitudinal direction of the operation lever 60.

That is, the spring second end portion 54 which is not subjected to the external force is fixed to the operation lever 60 in a direction of pivoting the operation lever 60 so as to perform unlocking from the locked state in order to transition from the hold state of pressing the material to be bound X and to the open state of separating from the material to be bound X, namely, along the pivoting track face of the operation lever 60. Therefore, the spring member 50 can move smoothly without being subjected to undesirable interference so that movement of the operation lever 60 such as an upward movement and a downward movement also becomes smooth.

When transition to the hold state (locked state) where the binding member 70 presses the material to be bound X is performed according to pivoting of the operation lever 60 and when transition to the open state (unlocked state) where the binding member 70 separates from the material to be bound X is performed according thereto, namely, when opening and closing are performed, the spring first end portion 56 of the spring member 50 is pivoted, but the winding portion 52 is shrunk and loosened accordingly. Therefore, the inner diameter of the winding portion 52 is configured such that a slight clearance between the same and the outer diameter of the shaft 58 is provided. The winding portion 52 is mounted on an outer peripheral face of the shaft 58.

That is, the winding portion 52 extends from the spring second end portion 54 side toward the spring first end portion 56 side so as to intersect the longitudinal direction of the operation lever 60 obliquely, and the side of the spring first end portion 56 of the spring member 50 is fixed to the base plate 22 at a position near the far side beyond the side of the spring second end portion 54.

When an external force does not act on the spring member 50, the spring second end portion 54 is formed so as to push up the free end of the operation lever 60 about the shaft 58 serving as a pivot shaft portion, and the spring first end portion 56 is formed so as to bring the binding member 70 near the surface of the base plate 22.

Since the spring second end portion 54 is fixed to the operation lever 60 so as to be approximately parallel to the longitudinal direction of the operation lever 60, when the operation lever 60 is pressed down toward a fallen-down state, the spring member 50 performs pressing-down in a direction approximately parallel to the bearing plate 24, namely, in the vertical direction to being capable of causing the projection portion 100 constituting the lock mechanism to engage with the engagement body 120.

The binding member 70 which is approximately rectangular in a plan view is formed to extend on the base plate 22 in the longitudinal direction of the base plate 22 to be attached to the base plate 22 in parallel to the bearing plate 24 such that the longitudinal end edge of the binding member 70 opposite to the bearing plate 24 comes close to and separates from the surface of the base plate 22.

The binding member 70 is formed of, for example, a sheet of metal plate. The binding member 70 has, for example, a length shorter than the distance between the first binding member supporting portion 30 and the second binding member supporting portion 34, and it is formed to have such a bent shape as to expand upward in the widthwise direction (approximately L shape in section).

The binding member 70 is bifurcated to both sides of the binding member 70 in the longitudinal direction on the bearing plate 24 side of the binding member 70 in the widthwise direction so that the engagement portions 90 projecting toward the side opposite to the bearing plate 24 side are formed.

These engagement portions 90 are fitted into the holding hole 32 of the first binding member supporting portion 30 serving as a pivot shaft portion receiver and the holding hole 36 of the second binding member supporting portion 34 serving as a pivot shaft portion receiver.

The holding hole 36 of the second binding member supporting portion 34 on the near side is formed to have the same height as the holding hole 32 of the first binding member supporting portion 30 on the far side from the base plate 22, and the first supporting projection portion 92*a* on the far side caused to engage with the holding hole 32 on the far side and the second supporting projection portion 92*b* on the near side caused to engage with the holding hole 36 on the near side are caused to engage with each other at the same height position.

Therefore, the binding member 70 can be pivoted about the line connecting the pair of first supporting projection portion 92*a* and second supporting projection portion 92*b* positioned front and behind and serving as a rotation center.

The operation lever 60 extends between the bearing plate 24 and the engagement portion 90 along the bearing plate 24 and the line connecting the first supporting projection portion 92*a* and the second supporting projection 92*b*.

Further, when the operation lever 60 is locked by pressing the free end of the operation lever 60 on the near side and causing the projection portion 100 to engage with the engagement body 120 of the engagement body supporting portion 180, the second supporting projection portion 92*b* of the binding portion 70 on the near side and the first supporting projection portion 92*a* on the far side are positioned at the same height, so that presses to the material to be bound X are simultaneously started regarding the relationship with a position where the spring engagement portion 56*c* of the spring member 50 presses the bridging portion 74 of the binding member 70 (in the vicinity of the central portion m of the binding member 70 in the longitudinal direction), so that forces of pressing the material to be bound X on the far side and that on the near side are balanced to become equivalent.

It should be noted that the engagement portions 90 are formed so as to bend in the widthwise direction such that the strength of the engagement portions 90 is enhanced and the engagement portions 90 are easily rotated within the holding hole 32 and the holding hole 36. By fitting the engagement portions 90 projecting from the binding member 70 into the holding hole 32 of the first binding member supporting portion 30 and the holding hole 36 of the second binding member supporting portion 34 in this manner, the number of parts can be reduced as compared with the case where the binding member 70 is pivotally held using rotation shafts which are separate parts.

As shown in FIG. 8A to FIG. 10C, the binding member 70 is formed with the standing portion 76 extending from the engagement portion 90 side obliquely upward on the opposite side to the bearing plate 24, the plate-shaped bridging portion 74 extending from an upper end of the standing portion 76 obliquely downward (an angle of about 22 degrees to the horizontal plane), and the pressing portion 72 formed at the free end of the bridging portion 74 by folding a portion from the near side end edge of the bending member 70 to the far side end edge obliquely downward (an angle of about 15 degrees to the vertical plane). The pressing portion 72 is formed such that when pressing the material to be bound X such as a document, the pressing portion 72 can press the material to be bound X such as a document while slightly bending to the bridging portion 74 side.

The pressing portion 72 is formed so as to continue from the near side end edge of the bridging portion 74 up to the far side end edge. The pressing portion 72 is formed such that a grounding region grounded on the material to be bound X and formed at the free end is separated to a grounding portion 72*a* on the far side and a grounding portion 72*b* on the near side and the grounding portion 72*a* on the far side and the grounding portion 72*b* on the near side have approximately the same grounding area.

The binding member 70 is formed such that the entire thereof is a plate-shaped body approximately rectangular in a plan view and curved in an approximately trapezoidal shape in a front view, the pressing portion 72 is formed on one end side portion of the binding member 70 in the widthwise direction so as to extend downward, and a pair of engagement portions 90 are formed on the other end side portion in the widthwise direction (the bearing plate 24 side portion) so as to be parallel to each other on the other end side portion and extend toward the pressing portion 72 direction. The pressing portion 72 extends in the longitudinal direction of the base plate 22.

The binding member 70 has a widthwise direction extending from the side of the operation lever 60 serving as the operation member, has the pressing portion 72 in the vicinity of a reference plane Pxz passing through the end edge of the binding member 70 opposite to the operation lever 60 serving as the operation member in a plan view of the binding member 70, and the spring first end portion 56 which is the one portion of the spring member 50 serving as the biasing member extends in the widthwise direction of the binding member 70 to be positioned in the vicinity of the reference plane Pxz passing through the end edge of the binding member 70.

The reference plane Pxz is a vertical plane orthogonal to the principal face of the base plate 22.

The binding member 70 has the through-hole 78 for inserting the spring first end portion 56 of the spring member 50 serving as the biasing member 50 at the central portion m of the binding member 70 in the longitudinal direction and in the vicinity of the reference plane Pxz passing through the end edge of the binding member 70 opposite to the spring member 50 serving as the biasing member. The binding member 70 further has the first biasing member receiving portion 80 formed with a receiving space portion by cutting at the central portion of the binding member 70 in the longitudinal direction and between the end edge of the binding member 70 on the side of the spring member 50 serving as the biasing member and the through-hole 78 in a plan view of the binding member 70.

The first biasing member receiving portion 80 is formed such that the spring member 50 can move without interfering with the binding member 70 when movement is performed between the locked state and the unlocked state.

The first biasing member receiving portion 80 is formed such that the standing portion 76 side is broad and is narrowed toward the pressing portion 72 side in such a manner that the spring first end portion 56 of the spring member 50 does not come contact with the binding member 70 in movement between the open state and the hold state.

The binding member 70 has the second biasing member receiving portion 82 formed so as to expand upward at the central portion m of the binding member 70 in the longitudinal direction and between the end edge of the binding member 70 opposite to the spring member 50 serving as the biasing member and the through-hole 78 in a plan view of the binding member 70.

The binding member 70 has, in a region facing the first biasing member receiving portion 80, a biasing member end portion holding portion 86 formed in order to engage the spring first end portion 56 of the spring member 50 serving as the biasing member and cover the same by recessing the binding member 70 downward.

The biasing member end portion holding portion 86 is a plate-shaped body provided at the lower end of the second biasing member receiving portion 82 to project toward the standing portion 76 side, and it is configured so as to engage the spring first end portion 56 of the spring member 50 in the open state while it is formed so as to cover the spring first end portion 56 of the spring member 50 in the hold state.

Figure 32A:
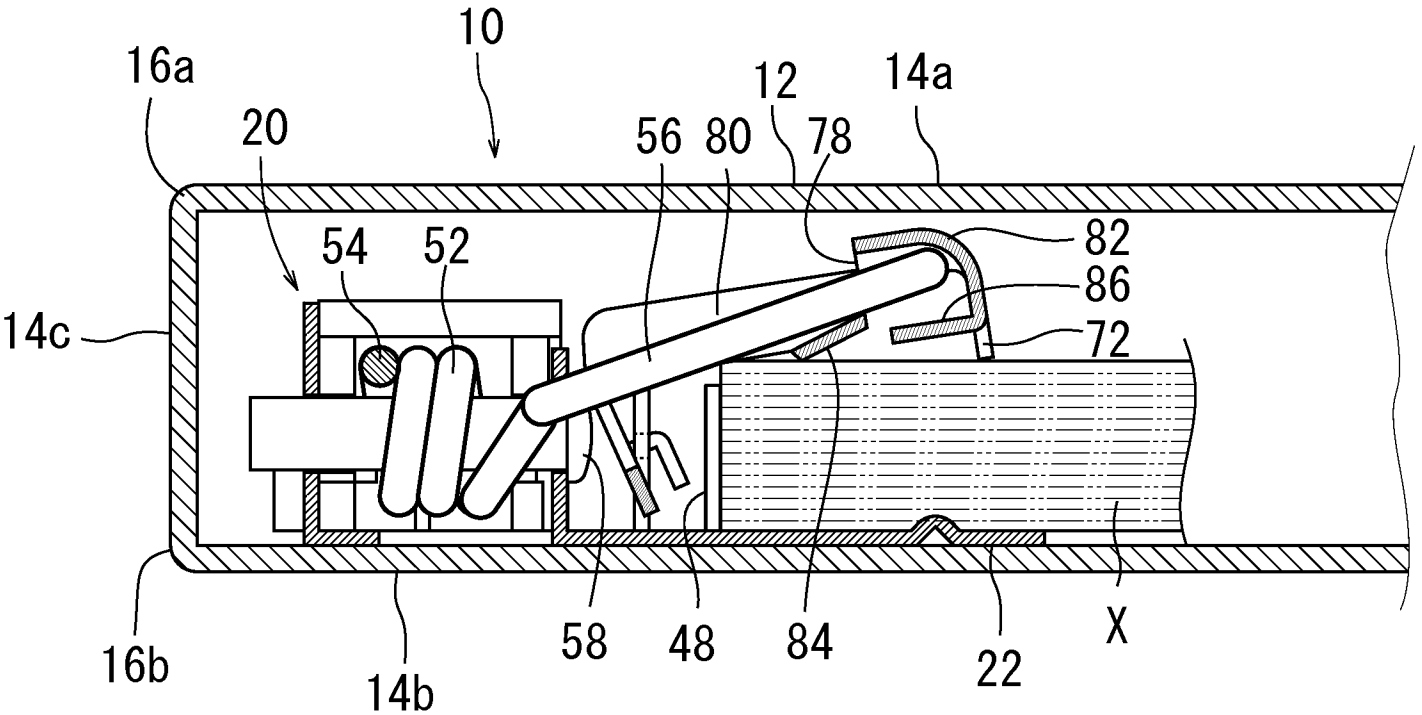
FIG. 32A is a sectional diagrammatical view of a file attached with a binding device in a state where a thick material to be bound has been bound and locked.
Figure 32B:
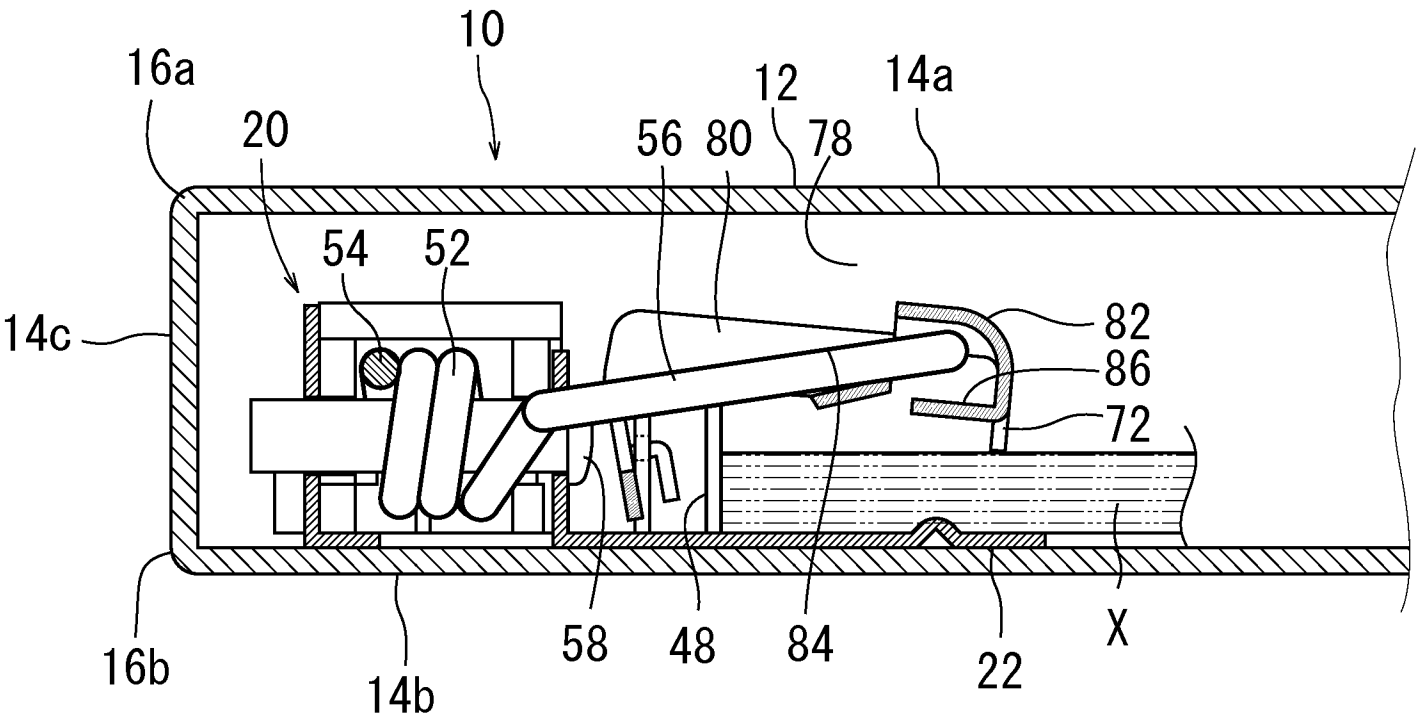
FIG. 32B is a sectional diagrammatical view of a file attached with a binding device in a state where a thin material to be bound has been bound and locked.

The biasing member end portion holding portion 86 is configured so as to become approximately parallel to the principal face of the base plate 22 at locked times when the thickness of the material to be bound X is thick and when the thickness is thin (see FIG. 32A and FIG. 32B).

The biasing member end portion holding portion 86 is configured so as not to be engaged with the spring first end portion 56 of the spring member 50 at locked times when the thickness of the material to be bound X is thick and when the thickness is thin (see FIG. 32A and FIG. 32B).

The binding member 70 has a biasing member end portion catching portion 84 for catching the spring first end portion 56 of the spring member 50 in the locked state nearer to the standing portion 76 side than the biasing member end portion holding portion 86 above the biasing member end portion holding portion 86.

The biasing member end portion catching portion 84 is a plate-shaped body provided in a section from the pressing portion 72 side end of the first biasing member receiving portion 80 to the through-hole 78.

The biasing member end portion catching portion 84 is configured so as to become approximately parallel to the principal face of the base plate 22 at the locked time when the thickness of the material to be bound X is thin and catch the spring first end portion 56 of the spring member 50 (see FIG. 32B).

The biasing member end portion catching portion 84 is configured so as to intersect the principal face of the base plate 22 obliquely at the locked time when the thickness of the material to be bound X is thick and catch the spring first end portion 56 of the spring member 50 (see FIG. 32A).

The biasing member end portion catching portion 84 is configured so as to be recessed downward and hold the spring first end portion 56 of the spring member 50.

The standing portion 76 is formed with the first biasing member receiving portion 80 by partially cutting the central portion m of the biasing member 70 in the longitudinal direction (in a direction from the near side end to the far side end).

The bridging portion 74 is recessed downward (in a downward direction) at the central portion m of the bridging portion 70 in the longitudinal direction (a direction from the near side end to reach the far side end), so that the first biasing member receiving portion 80 for receiving the first end portion 56 of the spring member 50 is formed.

The spring member 50 is provided such that the spring first end portion 56 is formed in a shape similar to an inner face of the binding member 70, the spring standing portion 56*a* of the spring member 50 stands up along the standing portion 76 of the binding member 70, and the spring bridging portion 56*b* of the spring member 50 extends along the first biasing member receiving portion 80 of the binding member 70 so that the spring catching portion 56*c* of the spring member 50 is caught by and fixed to the biasing member end portion catching portion 84 or the biasing member end portion holding portion 86 of the binding member 70.

The second biasing member receiving portion 82 is formed with a fan-shaped, rectangular, semi-circular, or circular through-hole 78, the spring first end portion 56 of the spring member 50 is loosely fitted into the through-hole 78 from the biasing member end portion holding portion 86 side and a distal end portion (spring catching portion 56*c*) of the spring first end portion 56 of the spring portion 50 is prevented from coming off from the through-hole 78.

The through-hole 78 is formed to have a size slightly larger than the outer shape of the spring first end portion 56 of the spring member 50 and a shape where the spring first end portion 56 of the spring member 50 can be loosely fitted into the through-hole 78, and it is configured such that a clearance where the spring member 50 can slightly move in the through-hole 78 is provided.

In this embodiment, the binding member 70 is formed with a top portion t where the standing portion 76 and the bridging portion 74 have been connected to each other nearer to the bearing plate 24 side than the central portion c of the binding member 70 in the widthwise direction, it is formed with the biasing member end portion catching portion 84 and the biasing member end portion holding portion 86 nearer to the pressing portion 72 side than the top portion t, and it is bored with the through-hole 78 approximately at the central of the binding member 70 in the widthwise direction (a front-back direction) of the biasing member end portion catching portion 84 and the biasing member end portion holding portion 86 (see FIGS. 9A, 9B, 13A, and 13B).

The through-hole 78 has a lower edge e formed below the top portion t and above the biasing member end portion holding portion 86.

The pressing portion 72 is formed above the engagement portion 90 in the height direction (a vertical direction) (see FIGS. A, 9B, 13A, and 13B).

The through-hole 78 is formed at a position near the pressing portion 72 in the vicinity of the central portion of the binding member 70 in the longitudinal direction between the engagement portions 90 formed at the front end and the back end of the binding member 70 (between the first supporting projection portion 92*a* and the second supporting projection portion 92*b* on the far side)

It should be noted that a linear rib may be formed in the pressing portion 72 continuously in the longitudinal direction in order to prevent deformation due to a force generated when the pressing member 72 presses the material to be bound X such as a document, or a linear rib may also be formed in the bridging portion 74 in order to prevent deformation due to a force generated when the pressing member 72 presses the material to be bound X such as a document.

Figure 13A:
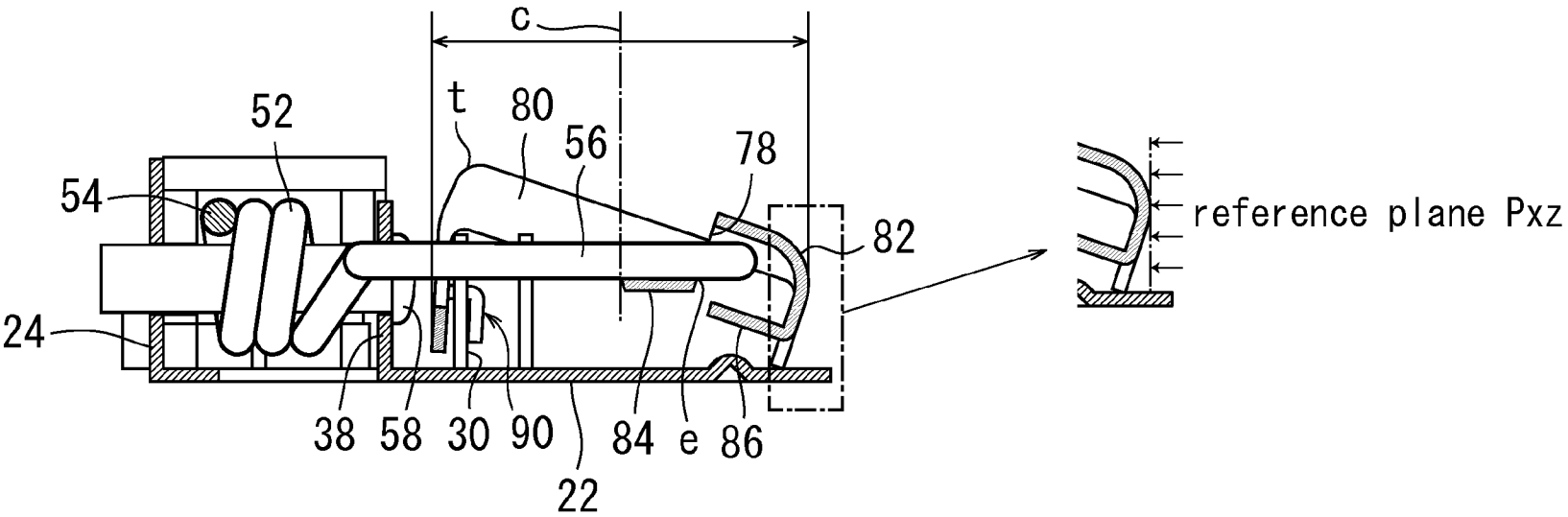
FIGS. 13A and 13B are sectional diagrammatical views for explaining operation states of the biasing member, the binding member and the operation member.
Figure 13B:
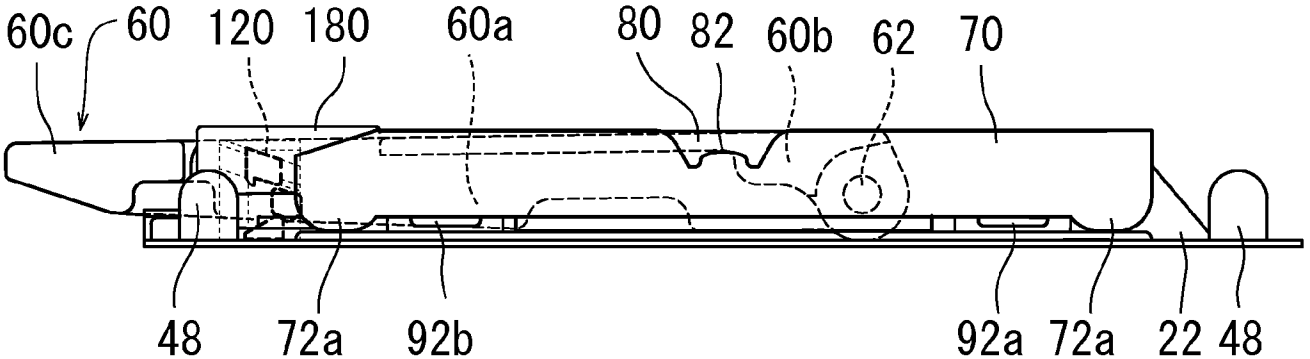

As shown in FIGS. 13A and 13B, the spring member 50 is arranged such that the spring standing portion 56*a* faces in a direction close to a horizontal direction and the spring catching portion 56*c* faces in a direction close to the horizontal direction in a state where the binding device 20 has been closed (the hold state). The spring standing portion 56*a* is not higher than the height of the spine cover 14*c* (namely, a length between the folded portion 16*a* and the folded portion 16*b*) (see FIG. 32).

As shown in FIGS. 14A to 15B, the spring first end portion 56 of the spring member 50 comes in contact with the lower end of the through-hole 78 in the locked time.

Figure 14A:
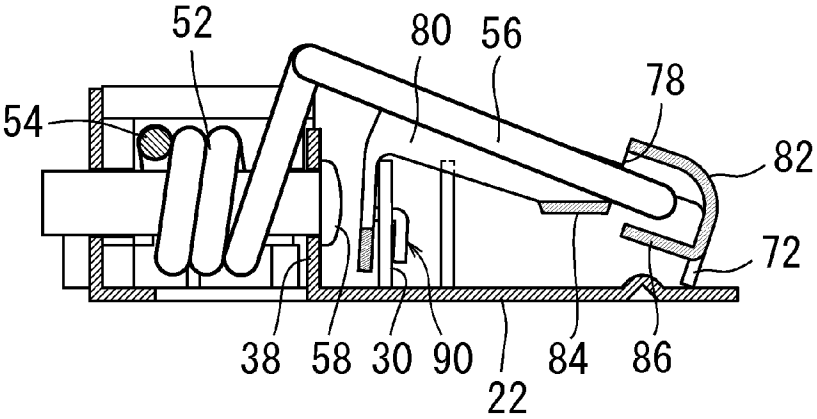
FIGS. 14A and 14B are sectional diagrammatical views for explaining operation states of the biasing member, the binding member and the operation member.
Figure 14B:
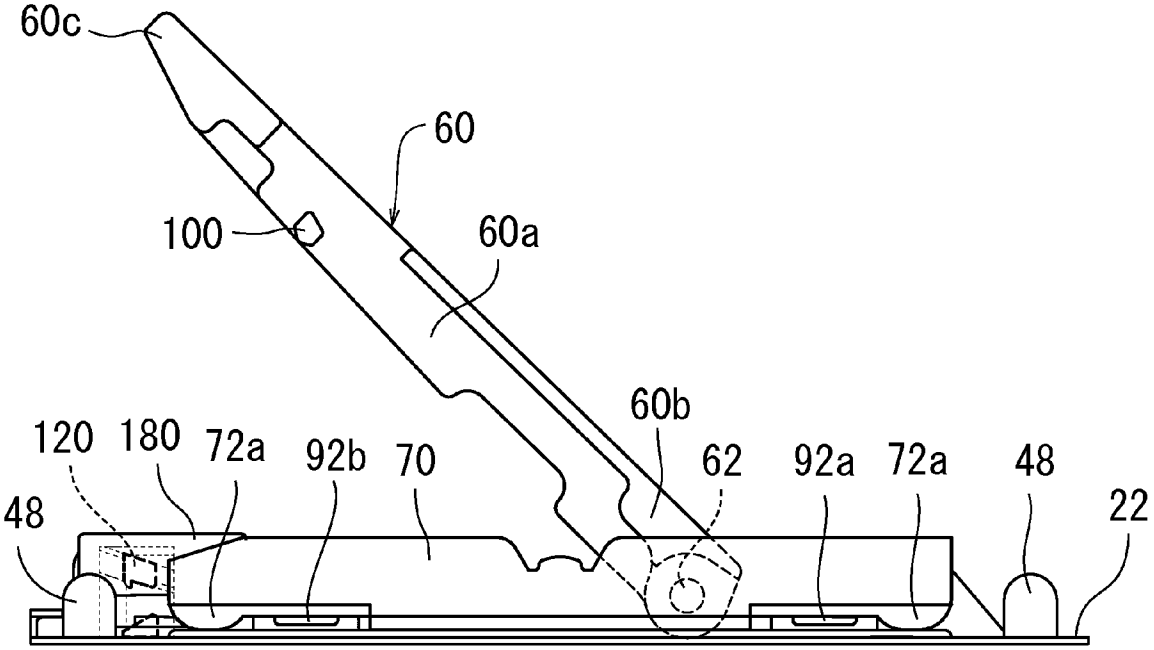

As shown in FIGS. 14A and 14B, the spring member 50 is disposed such that the near side of the spring standing portion 56*a* slightly rises, the spring standing portion 56*a* faces obliquely upward, and the spring catching portion 56*c* faces slightly downward in a state where the binding device 20 has been slightly opened (open state).

Figures 15A, 15B:
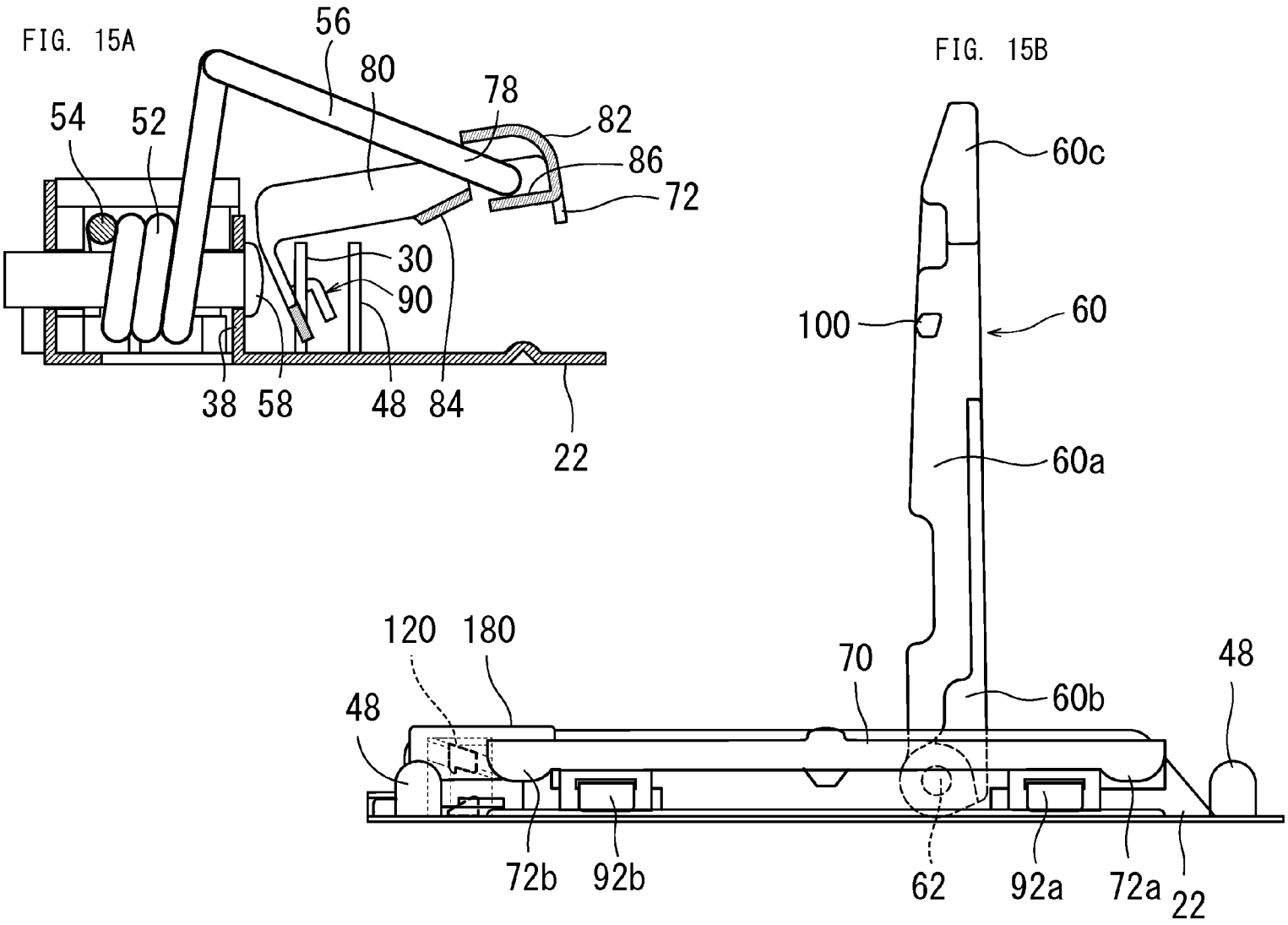
FIGS. 15A and 15B are sectional diagrammatical views for explaining operation states of the biasing member, the binding member and the operation member.
Figure 16A:
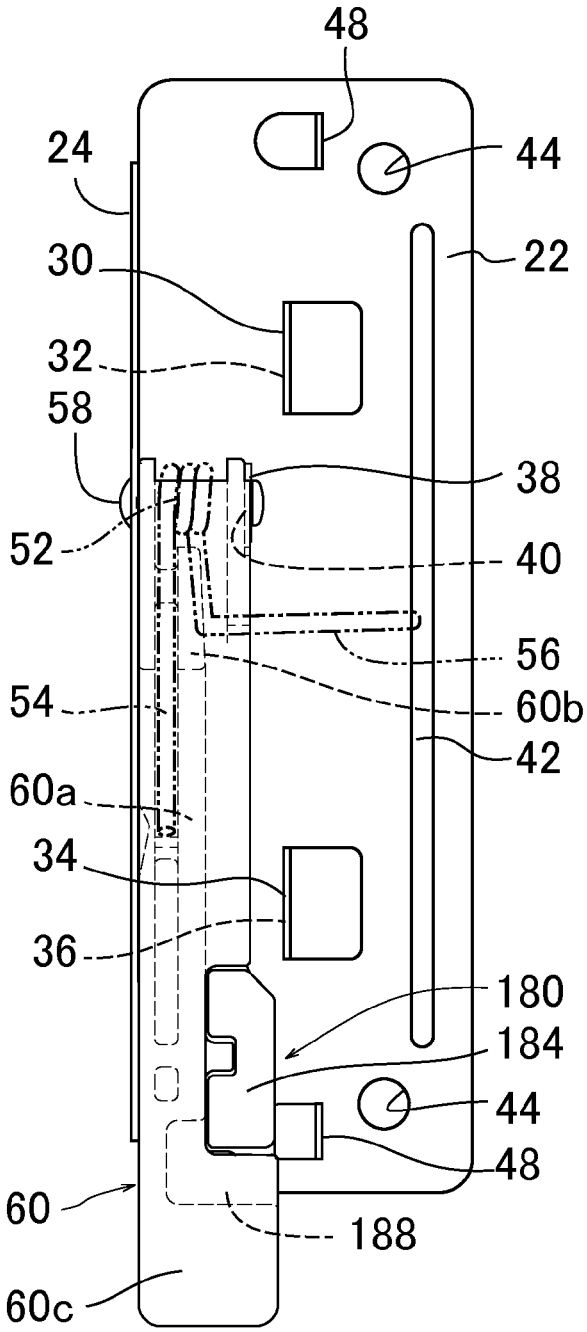
FIGS. 16A to 16C are views for explaining the stand member, the operation member and an engagement body supporting member of the binding device shown in FIG. 1.
Figure 16B:
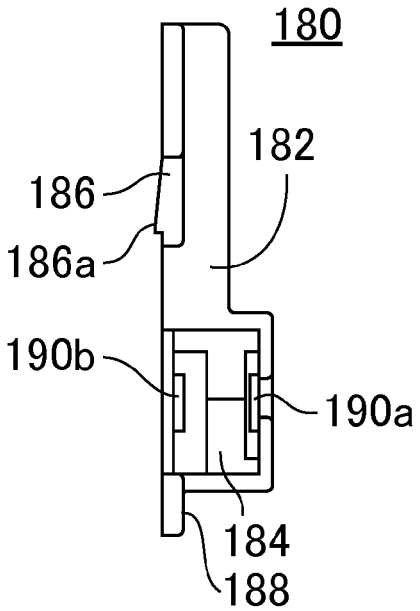
Figure 16C:
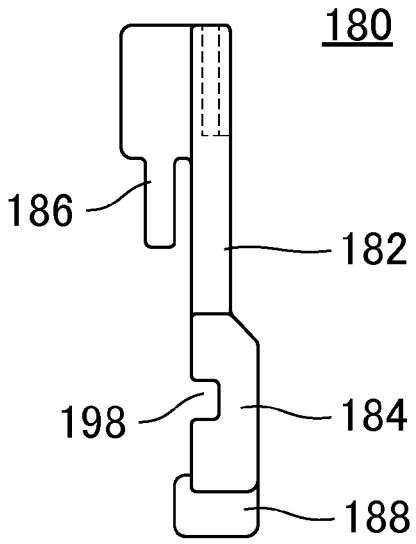
Figure 17A:
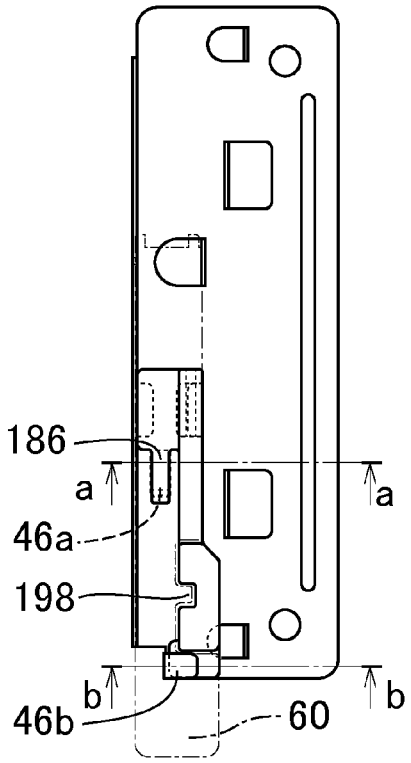
FIGS. 17A to 17C are views for explaining the stand member, the operation member and an engagement body supporting member of the binding device shown in FIG. 1.
Figure 17B:
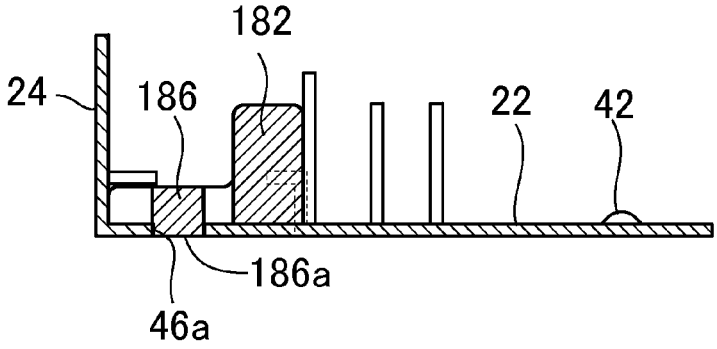
Figure 17C:
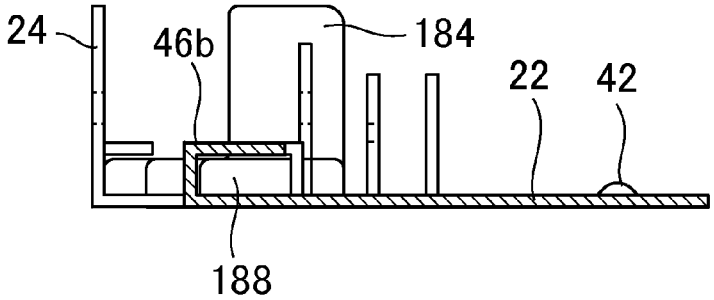
Figure 18A:
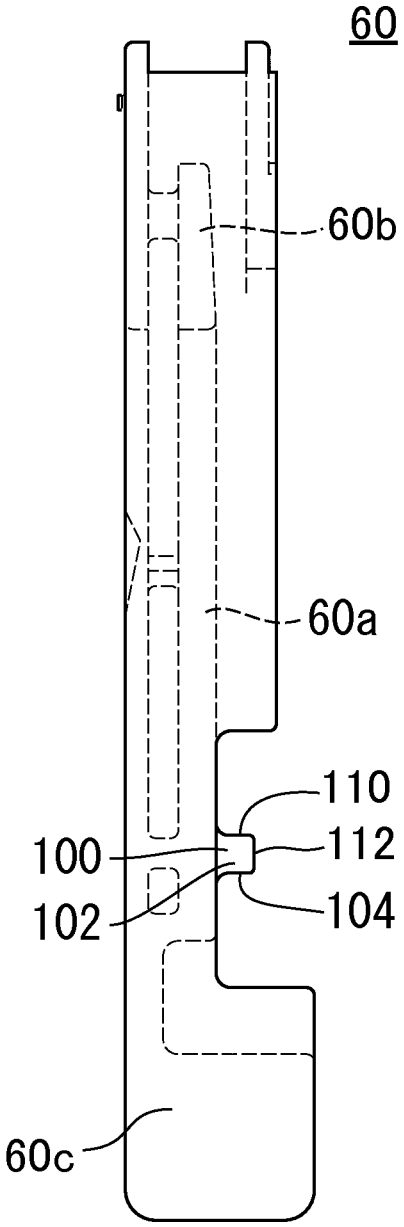
FIGS. 18A and 18B are a plan diagrammatical view and a side diagrammatical view of the operation member of the binding device shown in FIG. 1.
Figure 18B:
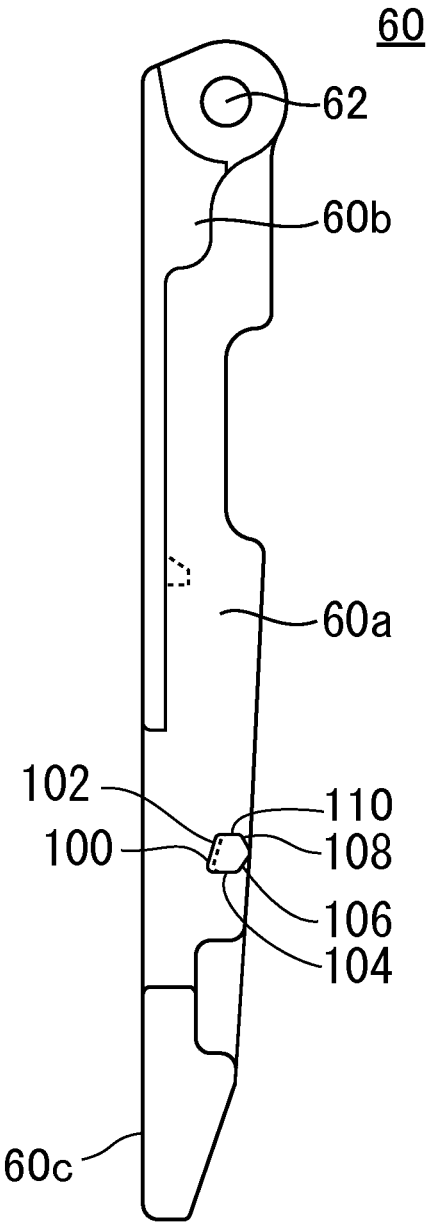
Figure 19A:
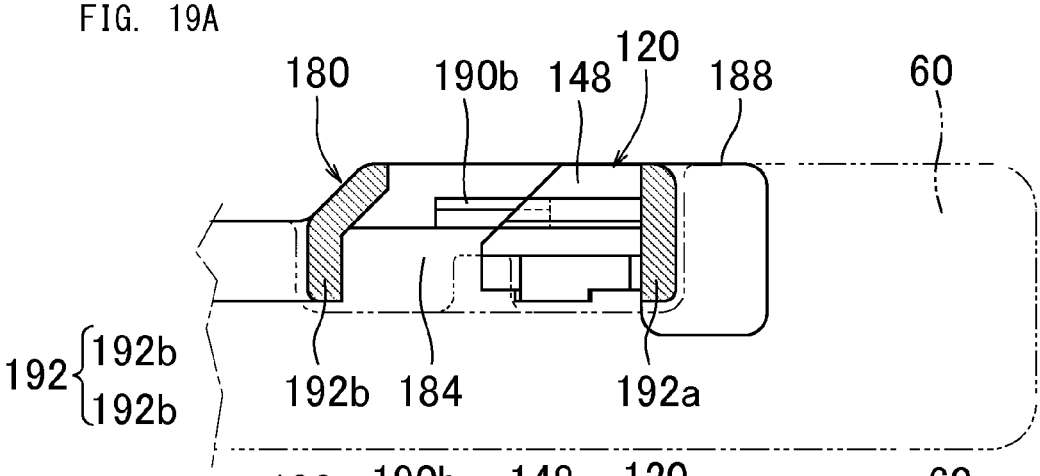
FIGS. 19 A to 19C are plan diagrammatical views for explaining an operation state of an engagement body in the engagement body supporting member, including a partial sectional view.
FIG. 19D is a sectional view of the engagement body supporting member and the engagement body.
Figure 19B:
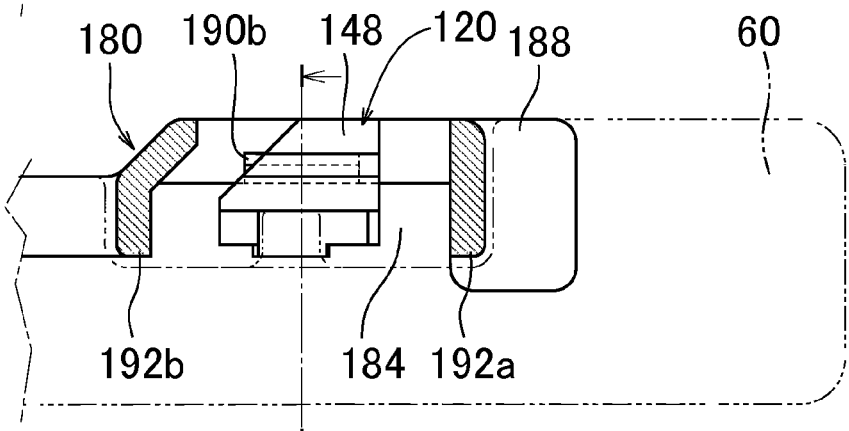
Figure 19C:
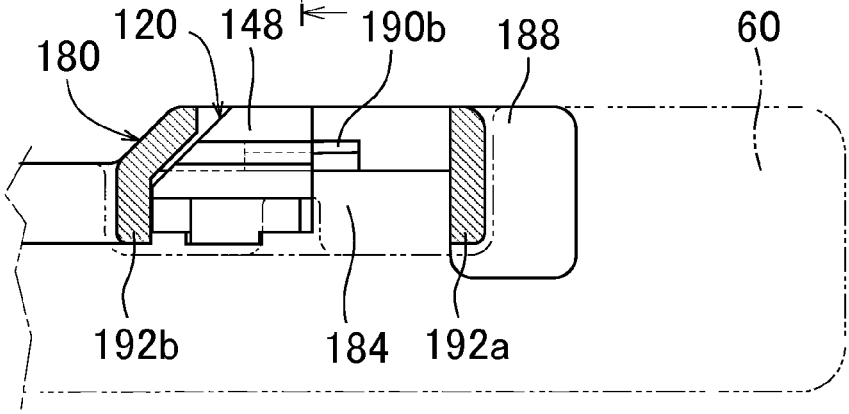
Figure 19D:
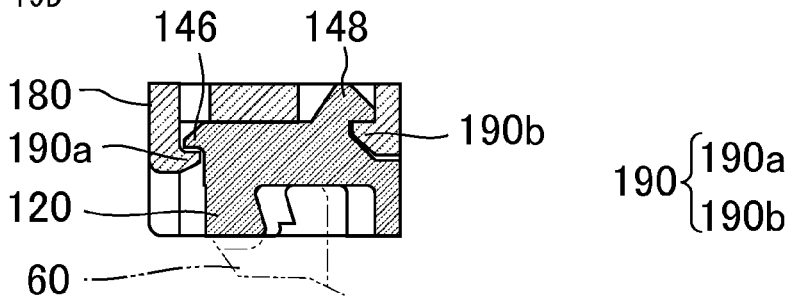
Figure 20:
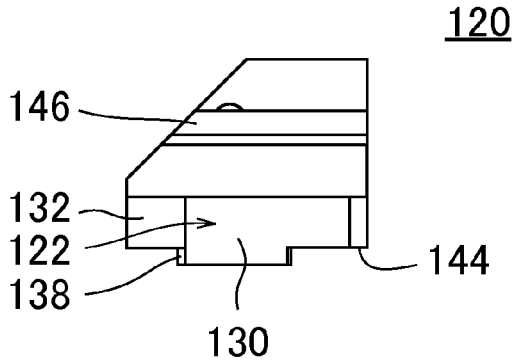
FIG. 20 is a plan diagrammatical view of the engagement body of the binding device shown in FIG. 1.
Figure 21:
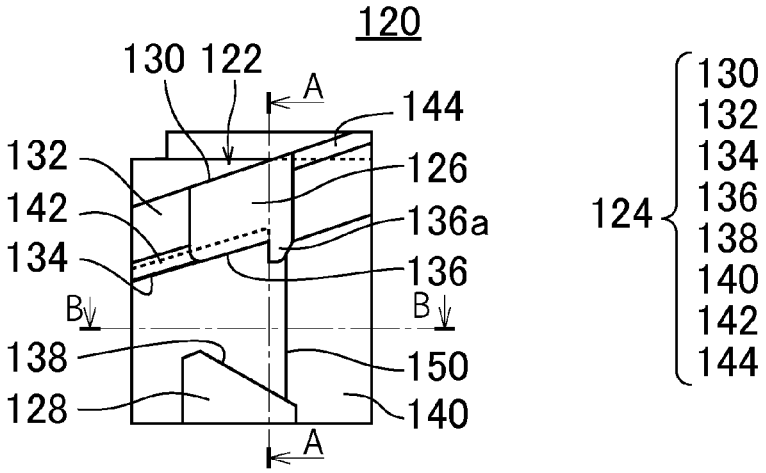
FIG. 21 is a side diagrammatical view of the engagement body of the binding device shown in FIG. 1.
Figure 22:
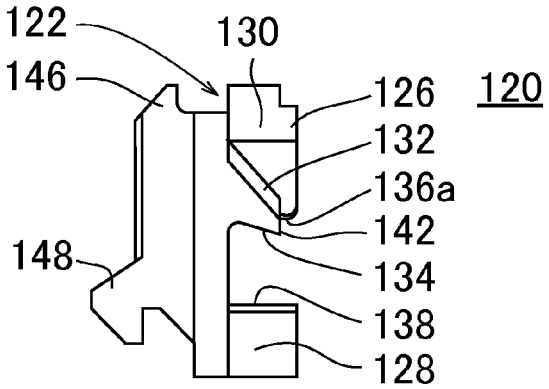
FIG. 22 is a front diagrammatical view of the engagement body of the binding device shown in FIG. 1.
Figure 23:
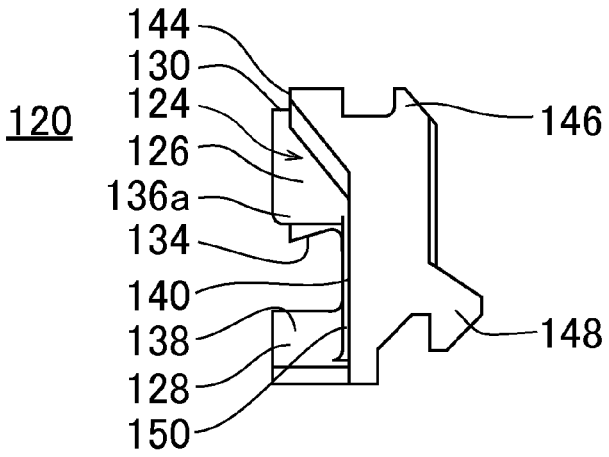
FIG. 23 is a rear diagrammatical view of the engagement body of the binding device shown in FIG. 1.
Figure 24:
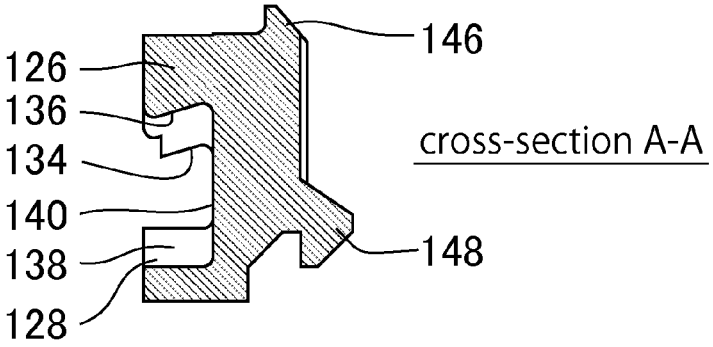
FIG. 24 is sectional diagrammatical view of the engagement body of the binding device shown in FIG. 21.
Figure 25:
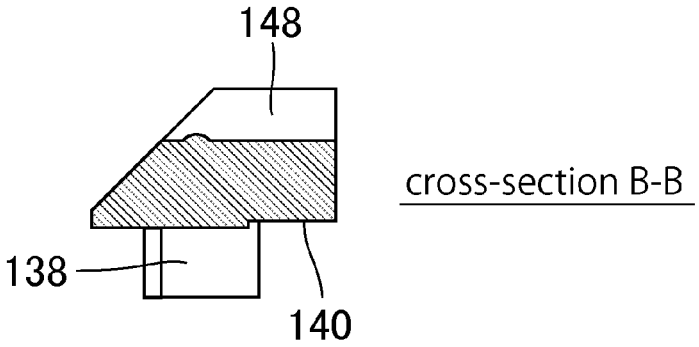
FIG. 25 is sectional diagrammatical view of the engagement body of the binding device shown in FIG. 21.

As shown in FIGS. 15A and 15B, the spring member 50 takes such a state that the spring standing portion 56*a* faces in the vertical direction, and the spring catching portion 56*c* rotates toward the far side so that the spring catching portion 56*c* has been stood approximately obliquely in the state where the binding device 20 has been fully opened (the open state).

As shown in FIGS. 32A and 32B, the spring first end portion 56 of the spring member 50 comes in contact with the upper edge of the through-hole 78 and/or the inner face of the second biasing member receiving portion 82 at a transition time to the open state.

The operation lever 60 is formed of synthetic resin, a metal plate, or the like in an elongated shape, it is formed in an approximately L shape in a section or an approximately U shape in section in order to enhance the strength of the operation lever 60, and the operation lever 60 is provided with a first vertical side wall 60*a* on the bearing plate 24 side and a second vertical side wall 60*b* formed in parallel to the first vertical side wall 60*a* and spaced therefrom by a fixed distance.

Circular lever through-holes 62 are formed in the first vertical side wall 60*a* and the second vertical side wall 60*b* on one end side (the far side) of the operation lever 60 in the longitudinal direction. The shaft 58 is inserted into the lever through-hole 62 of the operation lever 60 and the winding portion 52 of the spring member 50 arranged inside the first vertical side wall 60*a* to be attached to the bearing plate 24 and the bearing plate 38.

The spring second end portion 54 of the spring member 50 is arranged along inside of the operation lever 60 and is fixed between the first vertical side wall 60*a* and the second vertical side wall 60*b* of the operation lever 60.

[Lock Mechanism]

Next, the lock mechanism for locking the operation lever 60 in the hold state will be described.

The projection portion 100 for fixing, namely, locking the operation lever 60 in the hold state to the base plate 22 is provided in the first vertical side wall 60*a* of the operation lever 60.

The engagement body 120 caused to engage with the projection portion 100 for locking and the engagement body supporting portion 180 attached with the engagement body 120 are provided on the binding member 70 side of the operation lever 60.

The locked state is formed by engagement between the engagement body 120 and the projection portion 100.

The engagement body 120 is rotatably or slidably attached to the engagement body supporting portion 180, and the locked state for locking to the hold state of pressing the material to be bound X is formed by engagement between the engagement body 120 and the projection 100 with predetermined position and orientation of the engagement body 120 relative to the engagement body supporting portion 180.

The engagement body supporting portion 180 attached with the engagement body 120 has a structure where when the projection portion 100 of the operation lever 60 and the engagement body 120 move from the locked state to the unlocked state and when they move from the unlocked state to the locked state, the engagement body supporting portion 180 is swung to come close to or separate from the projection portion 100 side of the operation lever 60 on a plane parallel to the principal face of the base plate 22.

The engagement body 120 is slidably attached to the engagement body supporting body 180, and at a transition time from the unlocked state to the locked state, it is slidable relative to the engagement body supporting portion 180 within a range where the projection portion 100 necessarily comes in contact with the engagement body 120.

The engagement body supporting portion 180 is provided with an engagement body supporting main body 182 having a longitudinal direction extending along the longitudinal direction of the operation lever 60 serving as the operation member and an engagement body moving portion 184 formed on the engagement body supporting main body 182.

The engagement body supporting main body 182 has a supporting portion fixing portion 186 of the engagement body supporting portion 180 formed at one end thereof in the longitudinal direction and a free end portion 188 formed at the other end of the engagement body supporting portion 180 spaced from the supporting portion fixing portion 186 of the engagement body supporting portion 180.

The engagement body supporting portion 180 is constituted of synthetic resin having an elasticity with a restoring force so as to bend about the supporting portion fixing portion 186 of the fixed engagement body supporting portion 180 to come close to or separate from the projection portion 100 of the operation lever 60 serving as the operation member.

In this embodiment, the engagement body supporting portion 180 is fixed by inserting a fixing projection portion 186*a* of the supporting portion fixing portion 186 formed on a bottom face of the supporting portion fixing portion 186 at one end portion of the engagement body supporting main body 182 into a fixing recessed portion 46*a* formed on an upper face of the base plate 22.

The free end portion 188 of the engagement body supporting portion 180 is configured so as to be slidably inserted into a holding projection portion 46*b* formed on the upper face of the base plate 22 so that the engagement body supporting main body 182 is bent.

In the engagement body supporting portion 180, a guidance supporting portion 190 is formed in the engagement body supporting main body 182 in order to make the engagement body 120 slidable to the engagement body supporting portion 180 within the range where the projection portion 100 necessarily comes in contact with the engagement body 120.

The guiding supporting portion 190 is provided with a first guidance supporting portion 190*a* formed on an upper portion of the engagement body supporting main body 182 and a second guidance supporting portion 190*b* formed on a wall face of a lower portion of the engagement body supporting main body 182 opposite to the operation lever 60.

Further, the engagement body supporting portion 180 is provided with an engagement body movement restricting portion 192 for limiting a sliding range of the engagement body 120 in the longitudinal direction of the engagement body supporting main body 182.

The engagement body movement restricting portion 192 is provided with a first engagement body movement restricting portion 192*a* formed toward the engagement body moving portion 184 on the near side of the engagement body moving portion 184 and a second engagement body movement restricting portion 192*b* formed toward the engagement body moving portion 184 on the far side of the engagement body moving portion 184.

In this embodiment, the engagement body supporting body 180 is formed in a boring manner, in the longitudinal direction of the prismatic engagement body supporting main body 182 which is rectangular in a plan view, with the engagement body moving portion 184 for moving the engagement body 120 in the longitudinal direction of the engagement body supporting main body 182

The engagement body supporting main body 182 has an opening portion 198 allowing passage of the projection portion 100 at an upper portion thereof (namely, a wall face opposite to the base plate 22), and the opening portion 198 communicates with the engagement body moving portion 184.

When the operation lever 60 is caused to hang down for locking, the projection portion 100 of the operation lever 60 passes through the opening portion 198 to reach above the engagement body 120 of the engagement body moving portion 184.

When the operation lever 60 is raised for unlocking, the projection portion 100 of the operation lever 60 passes through the opening portion 198 to reach above the engagement body supporting portion 180.

The engagement body 120 is provided with an engagement body main body 122 brought in sliding contact with the engagement body moving portion 184 of the engagement body supporting portion 180 and a follow-up guidance portion 124 for moving following the projection portion 100 formed on the engagement body main body 122, and it is configured so as to move from the locked state to the unlocked state along the engagement body moving portion 184 of the engagement body supporting portion 180 according to movement of the projection portion 100 arranged on the follow-up guidance portion 124.

The follow-up guidance portion 124 of the engagement body 120 is provided with a first slope portion 130 to which the projection portion 100 is pressed at a movement time from the unlocked state to the locked state, a first projection passage portion 132 through which the projection portion 100 passes at the movement time from the unlocked state to the locked state, a projection guidance portion 134 which guides the projection portion 100 at movement time from the unlocked state to the locked state, a projection engagement portion 136 which is caused to engage with the projection portion 100 at a movement time to the locked state, a second slope portion 138 to which the projection portion 100 is pressed at a movement time from the locked state to the unlocked state, and a second projection passage portion 140 through which the projection portion 100 passes at the movement time from the locked state to the unlocked state.

The first slope portion 130 is formed on an upper face of a first block 126 formed above the engagement body main body 122 and an upper portion of a second projection edge portion 144, namely, on the opening portion 198 side.

The first projection passage portion 132 is formed on a side portion of the first block 126, namely along a wall face on the far side.

A first projection edge portion 142 is formed on the first projection passage portion 132 so as to project to the projection portion 100 passing through the first projection passage portion 132.

The second projection edge portion 144 is formed on the second projection passage portion 140 so as to project to the projection portion 100 passing through the second projection passage portion 140.

The first projection passage portion 132 is provided at a lower position on the first slope portion 130 so as to connect to the first slope portion 130, the projection guidance portion 134 is provided so as to connect to a position on the first slope portion 130 separated from the region of the first slope portion 130 provided so as to connect to the first projection passage portion 132, and the projection engagement portion 136 is provided so as to connect subsequently to the projection guidance portion 134.

The projection engagement portion 136 is formed below the first block 126 on the base plate 22 side, namely, below a wall face of the lower portion of the first block 126.

The second slope portion 138 is formed so as to face the projection engagement portion 136, and the second projection passage portion 140 is provided so as to connect to the second slope portion 138 at a lower position on the second slope portion 138.

The second slope portion 138 is formed at an upper portion of the second block 128 formed on a lower portion of the engagement body main body 122, namely, on the opening portion 198 side.

A projection passage step difference portion 150 recessed deeper than a region between the projection engagement portion 136 and the second slope portion 138 is formed between the projection portion 136, the near side of the second slope portion 138, and the second projection passage portion 140.

The second projection passage portion 140 is formed in a region on the near side of the projection passage step difference portion 150 recessed deeper than the region between the projection engagement portion 136 and the second slope portion 138, and it is formed along a wall face of the first block 126 on the near side.

The engagement body 120 is provided with guidance coupling portions (a first guidance coupling portion 146 and a second guidance coupling portion 148) to be guided while coming in sliding contact with the guidance supporting portion 190 of the engagement body supporting portion 180.

The first guidance coupling portion 146 is provided with an engagement step portion for engagement with the engagement step portion of the first guidance supporting portion 190*a*, and the engagement step portion of the first guidance coupling portion 146 and the engagement step portion of the first guidance supporting portion 190*a* are planar and are configured so as to be slidable.

The second guidance coupling portion 148 is provided with an engagement step portion for engagement with the engagement step portion of the second guidance supporting portion 190*b*, and the engagement step portion of the second guidance coupling portion 148 and the engagement step portion of the second guidance supporting portion 190*b* are planar and are configured so as to be slidable.

In this embodiment, the engagement body 120 is configured such that the first guidance coupling portion 146 is slidably coupled to the first guidance supporting portion 190*a* formed on the upper portion of the engagement body supporting main body 182 of the engagement body supporting portion 180, and the second guidance coupling portion 148 is slidably coupled to the second guidance supporting portion 190*b* formed on a wall face of the lower portion of the engagement body supporting main body 182 opposite to the operation lever 60, so that the engagement body 120 is slid in the longitudinal direction of the engagement body supporting main body 182 within the engagement body moving portion 184.

The engagement body 120 is configured on its face side facing the operation lever 60 side such that the follow-up guidance portion 124 is provided in the engagement body main body 122 in a bored manner and the projection portion 100 inserted into the follow-up guidance portion 124 can be moved.

The engagement body 120 can take a first state where the first projection passage portion 132 is positioned on a track of the projection portion 100, a second state where the projection portion 100 and the engagement body 120 are caused to engage with each other and the binding member 70 is put in a locked state, and a third state where the second projection passage portion 140 is positioned on the track of the projection portion 100.

The engagement body 120 is slidable to the engagement body supporting portion 180 and is slidable in a such a range that the first slope portion 130 is necessarily positioned on the track of the projection portion 100 when the engagement body 120 does not take the first state where the first projection passage portion 132 is positioned on a track of the projection portion 100.

The projection portion 100 is provided with a first face 102 having a slope formed on an upper portion thereof, a second face 104 continuing to a lower portion of the first face 102 via a corner portion, a third face 106 continuing, via a corner portion, to a portion of the second face 104 which does not continue to the first face 102, a fourth face 108 continuing, via a corner portion, to a portion of the third face 106 which does not continue to the second face 104, and a fifth face 110 continuing, via a corner portion, to a portion of the fourth face 108 which does not continue to the third face 106.

The projection portion 100 is formed in a prismatic body with a polygonal shape in section, the above-described side faces constitute side faces of the prismatic body, and is provided with a bottom face 112 of a prismatic body and side faces of the prismatic body.

The first face 102, the second face 104, the third face 106, the fourth face 108, and the fifth face 110 are formed on the side faces of the prismatic body.

The first face 102 is a slope which becomes lower toward the far side of the operation lever 60, the second face 104 is a vertical flat face in a state where the operation lever 60 has made horizontal, the third face 106 is a slope flat face which becomes lower toward the far side of the operation lever 60, the fourth face 108 is a slope flat face which becomes higher toward the far side of the operation lever 60, and the fifth face 110 is a vertical flat face in a state where the operation lever 60 has made horizontal, so that an approximately pentagonal shape is formed.

The first face 102 is a slope inclined upward toward the bottom face 112, a necked portion is formed between the first face 102 and the bottom face, and a necked portion is also formed between the first face 102 and the vertical wall face of the operation lever 60.

The bottom face 112 faces the vertical wall face of the engagement body moving portion 184 of the engagement body supporting portion 180, and it is a vertical flat face for sliding contact.

The projection portion 100 is formed such that the bottom face of the prismatic body faces a face of the engagement body 120 facing the operation lever 60 serving as the operation member and the side face of the prismatic body comes in sliding contact with the follow-up guidance portion 124 of the engagement body 120.

Next, explanation about a procedure of changing the operation lever 60 in the open state to the hold state and changing the lock mechanism in the locked state will be made.

When the operation lever 60 serving as the operation member is pressed down toward the base plate 22 in a direction approximately orthogonal to the principal face of the base plate 22 serving as the base member in order to switch the lock mechanism to the locked state, the projection portion 100 of the operation lever 60 reaches below the opening portion 198, namely, above the engagement body 120 positioned on the base plate 22 side through the opening portion 198 at the upper portion of the engagement body supporting portion 180.

A corner portion between the third face 106 and the fourth face 108 of the projection portion 100 which is a leading end when the projection portion 100 advances through the opening portion 198 is pressed to the first slope portion 130, the engagement body 120 is moved from a lower side of the slope of the first slope portion 130 to a higher side thereof by a pressing-down force of the operation lever 60. The engagement body 120 reaches above the first projection passage portion 132 to take the first state.

When the operation lever 60 serving as the operation member is further pressed down, the projection portion 100 passes through the first projection passage portion 132 along the wall face of the first block 126 of the engagement body 120 in the first state to reach the position of the wall face of the second block 128 on the first projection passage portion 132 side.

When a force for pressing down the operation lever 60 is slightly weakened, the projection portion 100 abuts on the lower face of the first projection edge portion 142, namely, the wall face on the side of the base plate 22 due to a restoring force of the spring member 50.

When the projection portion 100 of the operation lever 60 presses down the lower face of the first projection edge portion 142 due to the restoring force of the spring member 50, the engagement body 120 moves to a lower side of the slope of the first projection edge portion 142, and further moves to a lower side of the slope of the projection engagement portion 136.

The first face 102 of the projection portion 100 reaches below the projection engagement portion 136 so that engagement body 120 takes the second state.

The engagement body 120 and the projection portion 100 are caused to engage with each other due to movement of the engagement body 120 to the second state, so that the locked state is formed.

The engagement body 120 is caused to engage with the projection portion 100 due to the restoring force of the spring member 50 in the second state, so that the locked state is maintained.

When the operation lever 60 serving as the operation member in the hold state is pressed down to the base plate 22 side in order to unlock the lock mechanism, the projection portion 100 in the locked state is pressed to the second slope portion 138 so that engagement body 120 is moved to an upper side of the slope of the second slope portion 138 to reach the second projection passage portion 140 side of the second block 128. The engagement body 120 takes the third state.

When the pressing-down force of the operation lever 60 is weakened, the projection portion 100 rises along the projection passage step difference portion 150 guiding the projection portion 100 due to the restoring force of the spring member 50.

The projection portion 100 passes through the second projection portion 140 of the engagement body 120 in the third state to get over the second projection edge portion 144 and move above the opening portion 198 of the engagement body supporting portion 180, so that unlocking is performed and the operation lever 60 is put in the open state.

In this embodiment, the projection portion 100 and the engagement body 120 are formed in the following manner.

(1) The first slope portion 130 stopped at the lower end of the opening portion 198 is provided with a gentle slope lowering from the near side toward the far side.

The first block 126 is formed with a slope at an upper portion thereof. The second projection edge portion 144 is formed with a slope portion at an upper portion thereof, and is formed with a slope continuing to the slope on the upper face of the first block 126.

Therefore, the upper face of the first block 126 and the continuing slope of the upper portion of the second projection edge portion 144 constitute the first slope portion 130. The slope of the upper face of the first block 126 and the slope of the upper portion of the second projection edge portion 144 which constitute the first slope portion 130 have substantially the same inclination angle.

Figure 26A:
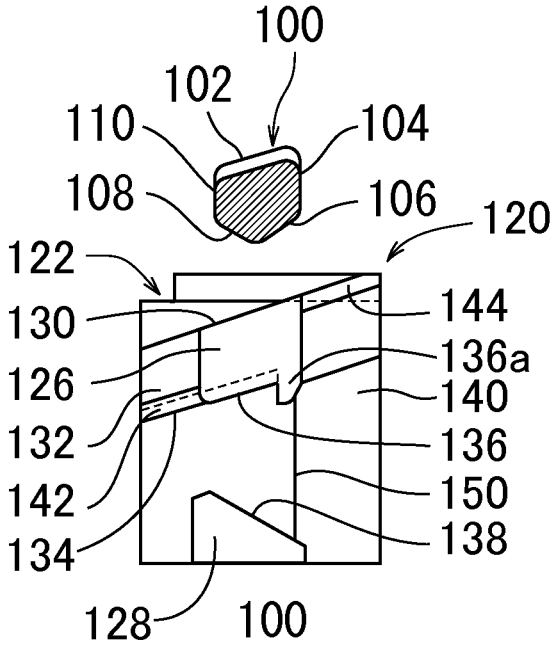
FIGS. 26A to 26C are views for explaining relationships between a projection portion and the engagement body of the operation member at movement times from an unlocked state to a locked state and from the locked state to the unlocked state in a time-series order.
Figure 26B:
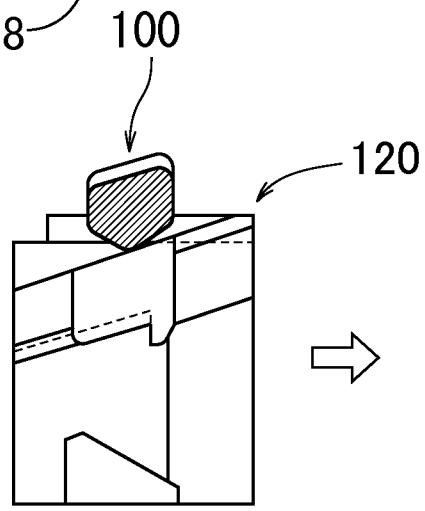
Figure 26C:
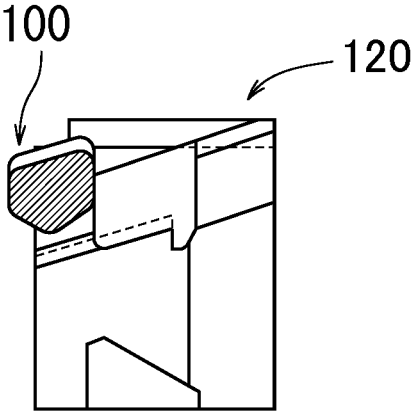
Figure 27A:
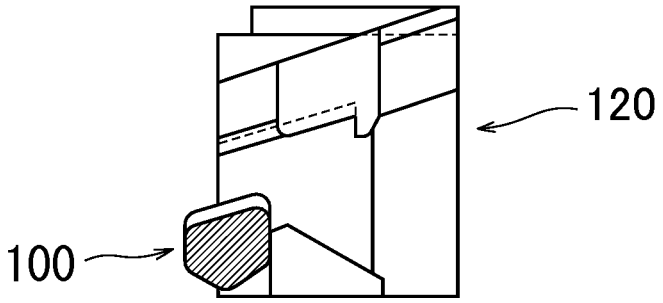
FIGS. 27A to 27C are views for explaining relationships between a projection portion and the engagement body of the operation member at movement times from an unlocked state to a locked state and from the locked state to the unlocked state in a time-series order.
Figure 27B:
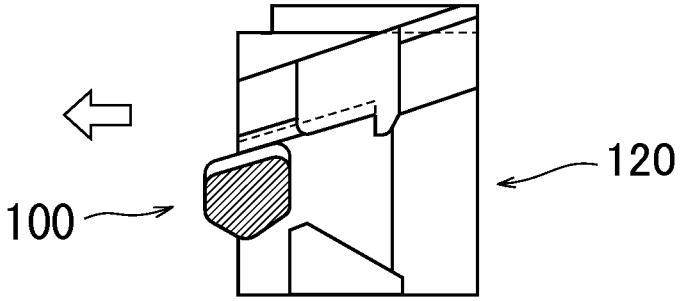
Figure 27C:
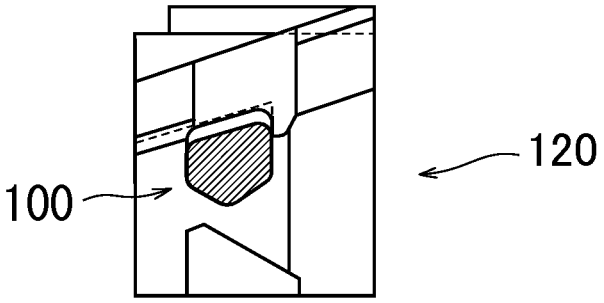

The vicinity of the corner portion between the third face 106 and the fourth face 108 of the projection portion 100 is pressed to the first slope portion 130 to be moved so that the engagement body 120 takes the first state (see FIG. 26A to FIG. 26C).

(2) The first projection passage portion 132 provided to continue to the lower side of the first slope portion 130 extends in a vertical direction such that the second face 104 of the projection portion 100 is caused to hang down while being brought in contact with the far side of the first block 126 on the far side of the engagement body main body 122.

The first projection passage portion 132 is formed with the first projection edge portion 142 above the first projection passage portion 132.

The first projection passage portion 132 is provided with a slope projecting to the operation lever 60 side along a direction from the first slope portion 130 downward and is formed with the first projection edge portion 142 at a lower end of the slope.

The engagement body 120 is slid while the first projection passage portion 132 is in contact with the corner portion between the third face 106 and the fourth face 108, and the projection portion 100 reaches the lower face of the first projection edge portion 142 according to the movement of the engagement body 120. At this time, the bottom face 112 of the projection portion 100 abuts on the first projection edge portion 142 of the engagement body 120 to push the engagement body supporting portion 180, so that the engagement body supporting portion 180 is bent about the supporting portion fixing portion 186 in a direction of separating from the operation lever 60 (see FIGS. 27A, 27B and FIGS. 29A to 29C).

After the projection portion 100 separates from the first projection edge portion 142, the engagement body supporting portion 180 returns to its original state due to the restoring force of the engagement body supporting portion 180.

(3) The lower face of the first projection edge portion 142 is provided with the projection guidance portion 134 having a slope rising toward the near side.

The projection engagement portion 136 connecting to the projection guidance portion 134 on the lower face of the first projection edge portion 142 extend from the vicinity of the central portion of the first projection passage portion 132 in the vertical direction toward the near side.

The projection engagement portion 136 rises toward the near side at the slope connecting to the projection guidance portion 134 on the lower face of the first projection edge portion 142. The inclination angles of the slope of the projection guidance portion 134 of the slope on the lower face of the first projection edge portion 142 and the slope of the projection engagement portion 136 are approximately the same angle.

The projection engagement portion 136 has, on the near side, a projection portion catching portion 136*a* abutting on the second face 104 of the projection portion 100 to stop the engagement body 120 and provided so as to project downward.

The engagement body 120 is guided while the second face 104 of the projection portion 100 is in contact with the wall face of the second block 128 on the far side positioned on the far side of the second slope portion 138, and it rises due to the biasing force of the spring member 50 so that the projection guidance portion 134 and the projection engagement portion 136 reach above the first face 102 of the projection portion 100.

The engagement body 120 abuts on the first face 102 of the projection portion 100 to move to the far side due to the biasing force of the spring member 50.

The projection portion 100 and the projection portion catching portion 136*a* of the engagement body 120 abut on each other and the projection engagement portion 136 of the engagement body 120 is caused to engage with the first face 102 of the projection portion 100, so that the engagement body 120 is put in the locked state (see FIG. 27C and FIGS. 30A to 30C).

(4) The second slope portion 138 is formed just below the projection portion 100 fixed to the projection engagement portion 136 in the locked state.

The second slope portion 138 is formed with a slope descending from the far side toward the near side to reach the second projection passage portion 140.

The second slop portion 138 comes in sliding contact with the fourth face 108 of the projection portion 100 to guide the engagement body 120 such that the second projection passage portion 140 is positioned at the position of the projection portion 100.

(5) Such a configuration is adopted that the second projection passage portion 140 provided so as to connect to the near side of the second slope portion 138 is caused to hang down in parallel to the first projection passage portion 132 and the projection portion 100 rises along the projection passage step difference portion 150 constituting the second projection passage portion 140 and the wall face of the first block 126 on the near side due to the biasing force of the spring member 50.

Figure 28A:
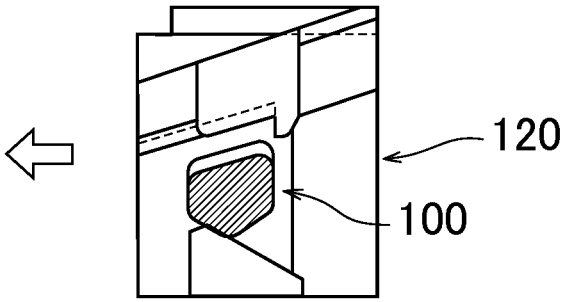
FIGS. 28A to 28C are views for explaining relationships between a projection portion and the engagement body of the operation member at movement times from an unlocked state to a locked state and from the locked state to the unlocked state in a time-series order.
Figure 28B:
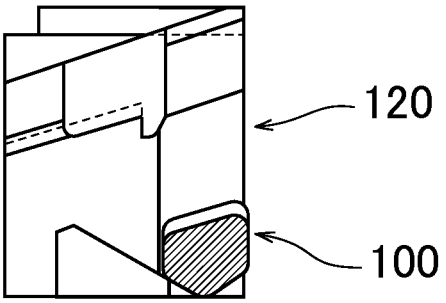
Figure 28C:
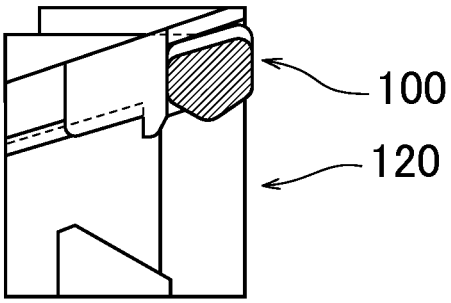
Figure 29A:
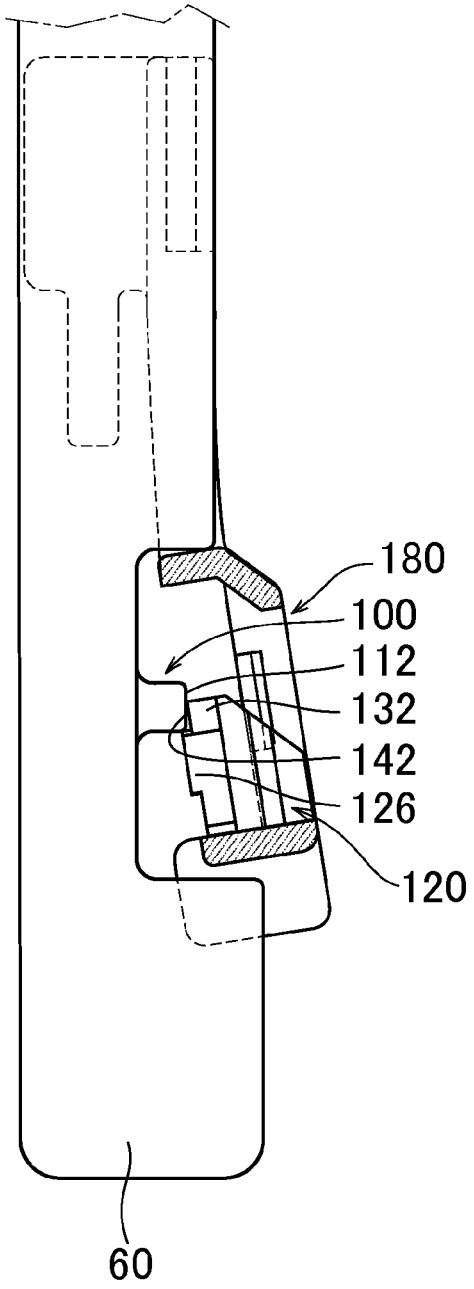
FIGS. 29A to 29C are views for explaining the relationship between the projection portion and the engagement body of the operation member at a movement time from the unlocked state to the lock state.
Figure 29B:
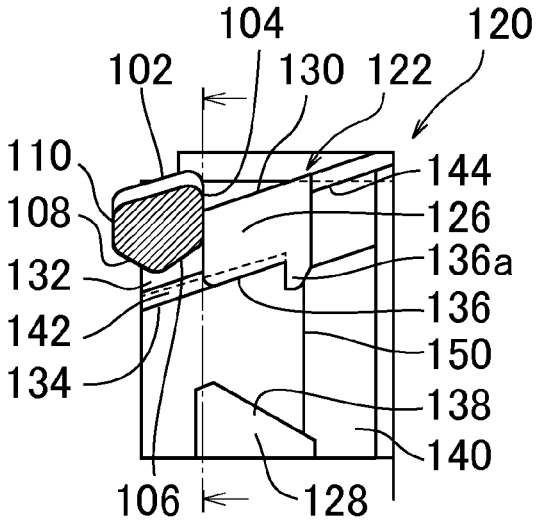
Figure 29C:
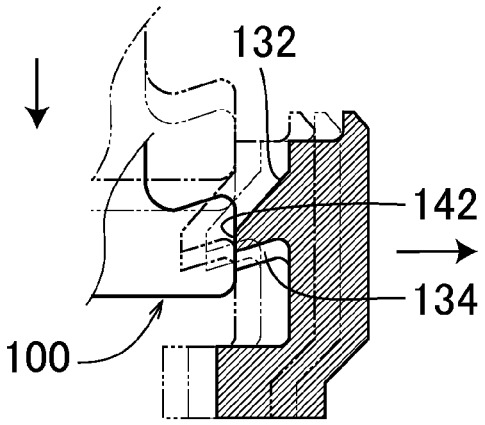
Figure 30A:
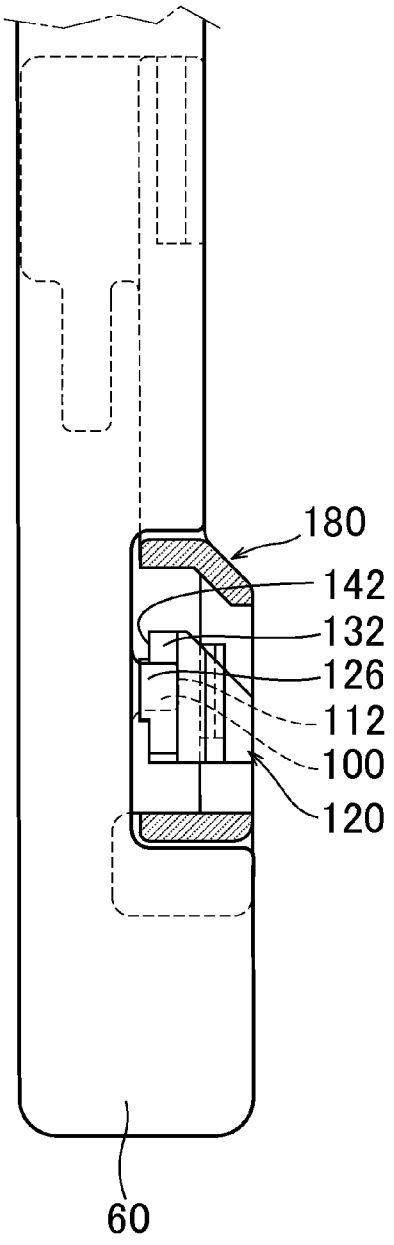
FIGS. 30A to 30C are views for explaining the relationship between the projection portion and the engagement body of the operation member in the locked state.
Figure 30B:
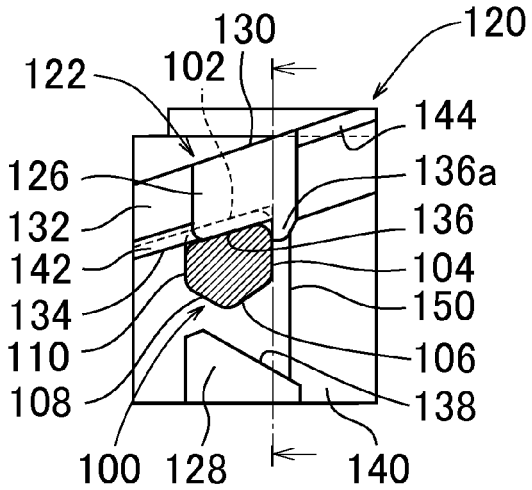
Figure 30C:
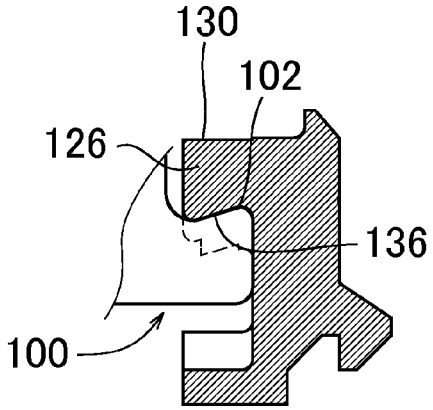

The projection portion 100 is guided outward above the engagement body 120 while the fifth face 110 of the projection portion 100 comes in contact with the face of the first block 126 of the engagement body main body 122 on the side of the second projection passage portion 140 (FIG. 28B and FIG. 28C).

Figure 31A:
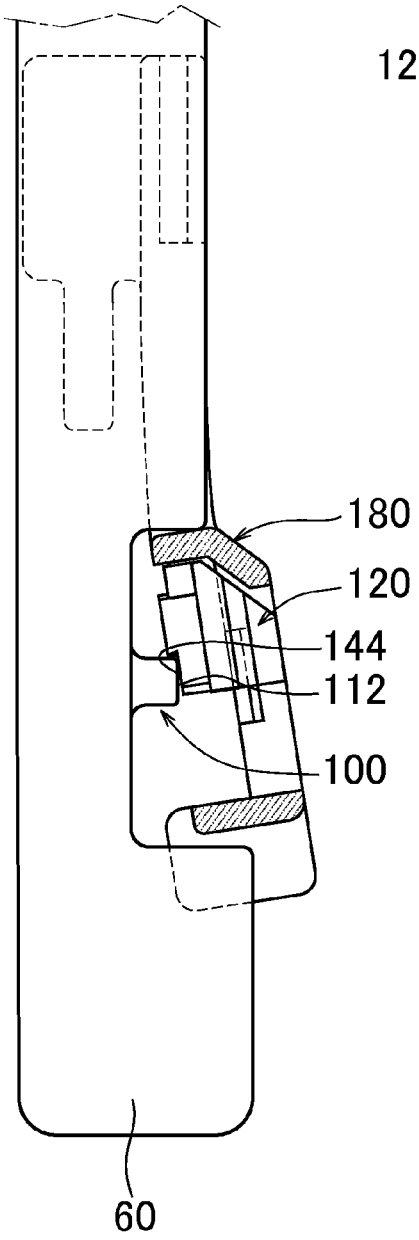
FIGS. 31A to 31C are views for explaining the relationship between the projection portion and the engagement body of the operation member at a movement time from the locked state to the unlock state.
Figure 31B:
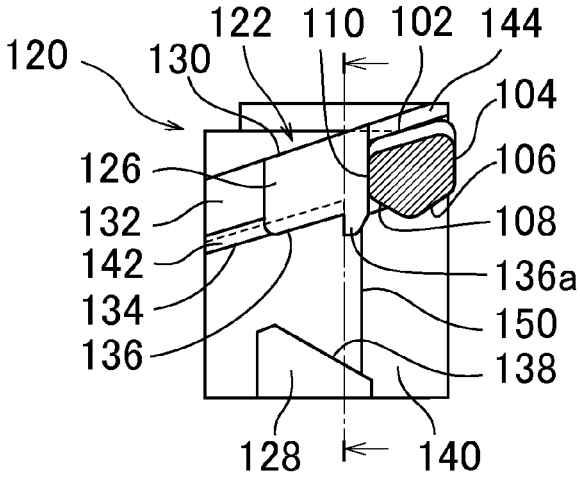
Figure 31C:
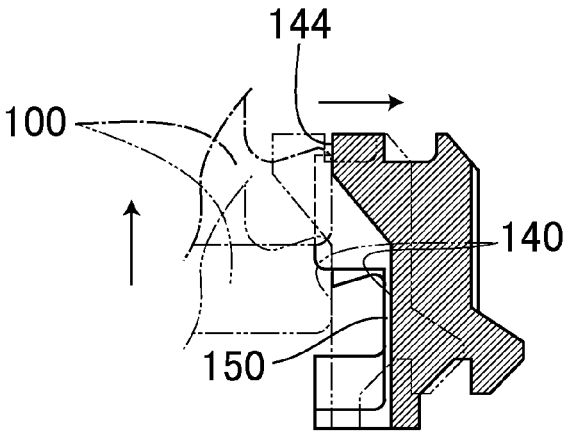

(6) The second projection edge portion 144 formed above the second projection passage portion 140 has an inclined shape projecting on the operation lever 60 side according to arrival from below up to above, and the projection portion 100 gets over the second projection edge portion 144 to go outside when the projection portion 100 goes outside the engagement body main body 122. At this time, the bottom face 112 of the projection portion 100 abuts on the second projection edge portion 144 of the engagement body 120 to push the engagement body supporting portion 180, so that the engagement body supporting portion 180 is bent about the supporting portion fixing portion 186 in a direction of separating from the operation lever 60 (see FIGS. 31A to 31C).

After the projection portion 100 separates from the first projection edge portion 142, the engagement body supporting portion 180 returns to its original state due to the restoring force of the engagement body supporting member 180.

The projection portion 100 gets over the second engagement edge portion 144 to move above the opening portion 198 of the engagement body supporting portion 180, so that unlocking is performed and the operation lever 60 reaches the open state.

The first projection edge portion 142 formed on the first projection passage portion 132 projects to the projection portion 100 when the projection portion 100 passes through the first projection passage portion 132, and when the projection portion 100 passes through the first projection passage portion 132 at a movement time from the unlocked state to the locked state, the projection portion 100 is pushed to the first projection edge portion 142, so that the engagement body supporting portion 180 is swung (bent), and when the projection portion 100 has passed through the first projection edge portion 142, the engagement body supporting portion 180 is restored.

Thereafter, when the projection portion 100 rises due to the biasing force of the spring member 50, the projection portion 100 is pushed to the projection guidance portion 134 of the lower portion of the first projection edge portion 142, so that the projection portion 100 cannot go back through the first projection passage portion 132 due to the first projection edge portion 142.

The second projection edge portion 144 formed on the second projection passage portion 140 projects toward the projection portion 100 when the projection portion 100 passes through the second passage portion 140, and when the projection portion 100 passes through the second projection passage portion 140 at a movement time from the locked state to the unlocked state, the projection portion 100 is pushed to the second projection edge portion 144 so that the engagement body supporting portion 180 is swung (bent), and when the projection portion 100 has passed through the second projection edge portion 144, the engagement body supporting portion 180 is restored.

Thereafter, even if the engagement body 120 is in the third state, the projection portion 100 is pushed to the first slope portion 130 on the upper portion of the second projection edge portion 144 when the operation lever 60 is pressed down, so that the projection portion 100 cannot go back through the second projection passage portion 140 due to the second projection edge portion 144.

Further, the other end side (the near side) of the operation lever 60 in the longitudinal direction is formed with a wide operation portion 60*c*, which provides easy finger operation The operation lever 60 is provided with a first vertical side wall 60*a* serving as the supporting portion fixing portion 186 which is a region fixed to the bearing plate 24, and the bearing plate 24 is formed with a pivot shaft fixing through-hole 26 serving as the operation member fixing portion which is the region coming in contact with the first vertical side wall 60*a* of the operation lever 60 to fix the operation lever 60

It should be noted that a spacer bulging in a semi-circular shape toward the operation lever 60 side may be formed by embossing the periphery of the pivot shaft fixing through-hole 26 serving as the supporting portion fixing portion 186 for the shaft 58 toward the operation lever 60 side. With such a configuration, a clearance is formed between the inner face of the bearing plate 24 and the outer face of the first vertical side wall 60*a* of the operation lever 60 by a length corresponding to the projecting portion of the spacer, and when the operation lever 60 is unlocked and the binding member 70 is pivoted in order to performing opening and closing between the holding state of pressing the material to be bound X and the open state of separating from the material to be bound X, an unnecessary force of the spring member 50 is not imparted to the operation lever 60, so that the operation lever 60 does not rub against the bearing plate 24.

In this embodiment, a spacer is not formed on the bearing plate 24, but a space may be formed on the operation lever 60 side and spacers may be formed on both of the bearing plate 24 and the operation lever 60. For example, a spacer where the periphery of the first vertical side wall 60*a* of the operation lever 60 has bulged toward the bearing plate 24 side in an annular shape may be formed.

The end portions of the first binding member supporting portion 30 and the second binding member supporting portion 34 on the side opposite to the bearing plate 24 form writing paper arranging portions 48 having faces parallel to the face of the bearing plate 24 for arranging the end edges of the materials to be bound X such as documents to be bound.

The first binding member supporting portion 30 and the second binding member supporting portion 34 are formed such that end edges thereof on the side opposite to the bearing plate 24 are arranged on the same plane (supposedly) as the surfaces of the writing paper arranging portions 48 on the side opposite to the bearing plate 24.

Therefore, end edges of the first binding member supporting portion 30 and the second binding member supporting portion 34 serve as guides so that end edges of the materials to be bound X such as documents to be bound are caused to abut on the writing paper arranging portion 48 to be bound.

The present invention is not limited to the above embodiment but can be modified variously.

Figure 33A:
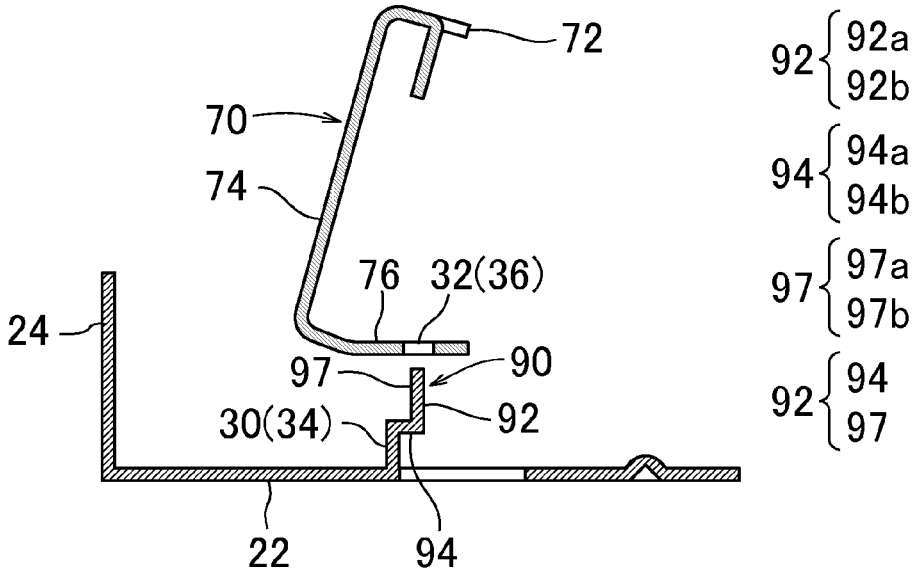
FIGS. 33A to 33C are sectional diagrammatical views for explaining how to assemble a stand member and a binding member in a binding device of a second embodiment.
Figure 33B:
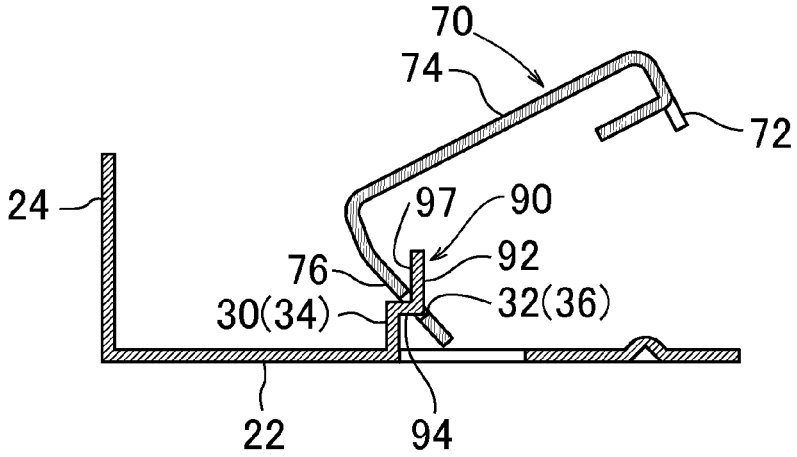
Figure 33C:
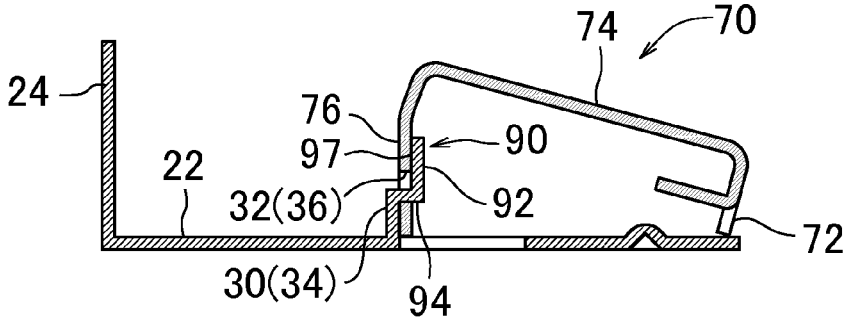
Figure 35:
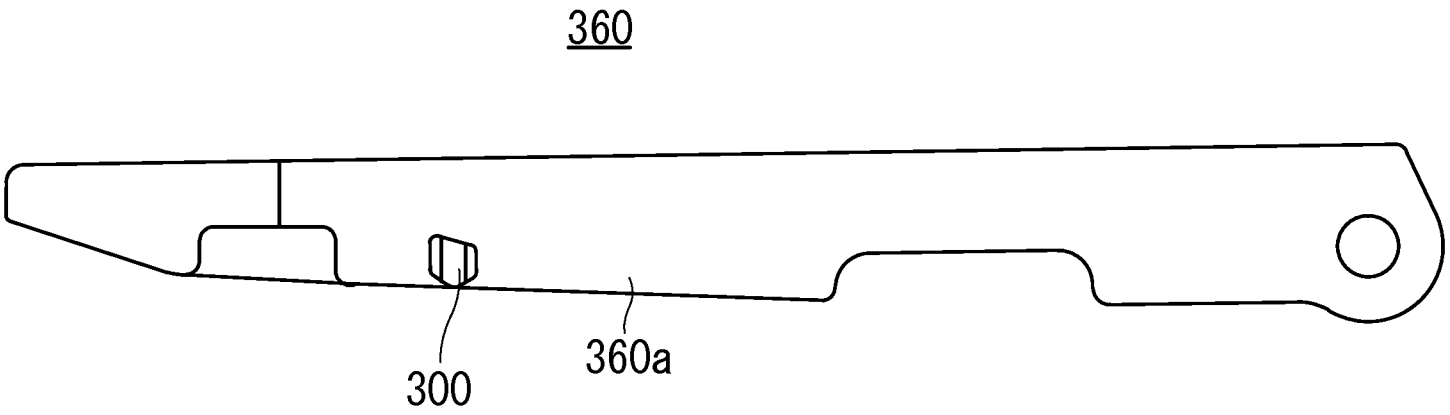
FIG. 35 is a side diagrammatical view of an operation member of a binding device provided with a rotary lock mechanism.
Figure 36A:
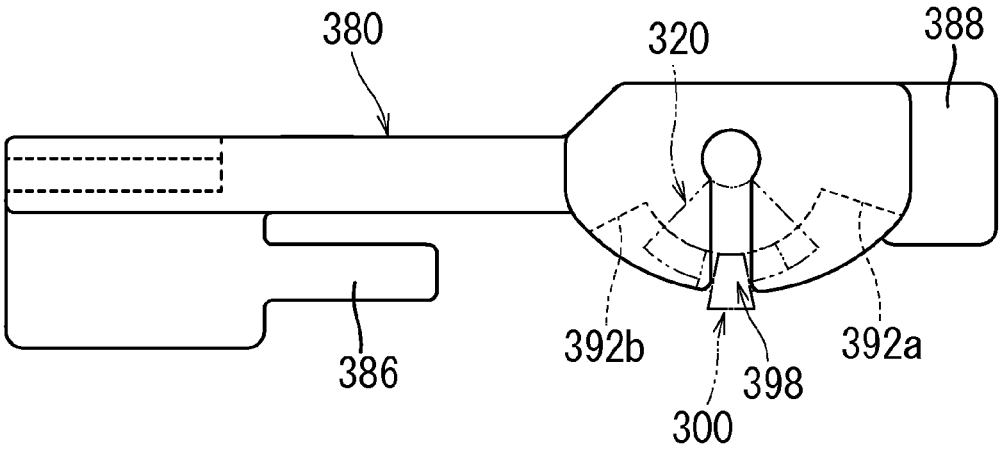
FIGS. 36A and 36B are a plan view and a side diagrammatical view of an engagement body supporting body of a binding device provided with a rotary lock mechanism.
Figure 36B:
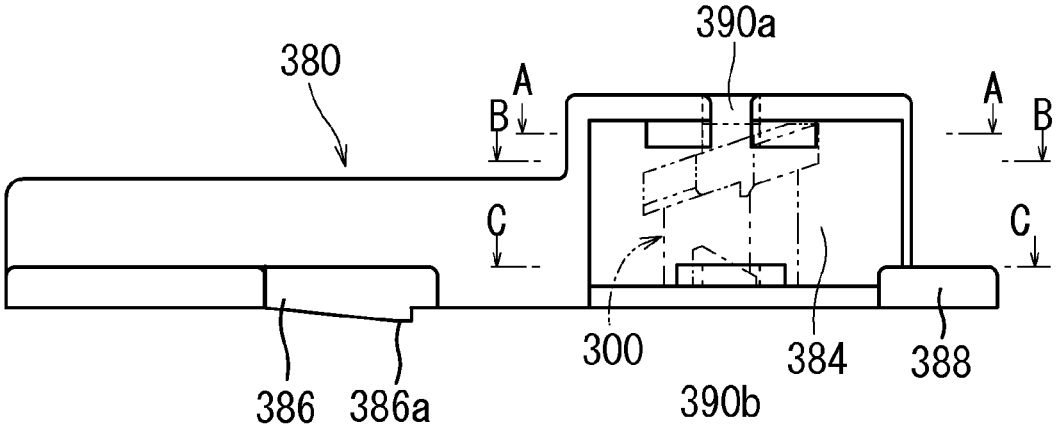
Figure 37A:
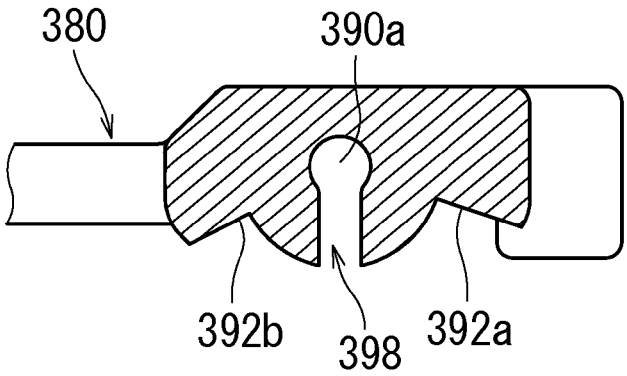
FIGS. 37A to 37C are sectional diagrammatical views of the engagement body supporting portion of the binding device of the third embodiment shown in FIG. 36B.
Figure 37B:
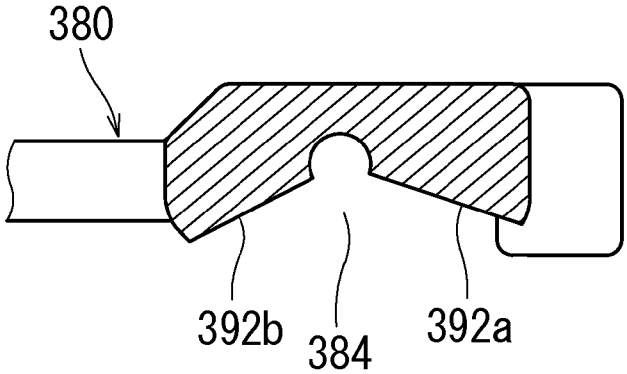
Figure 37C:
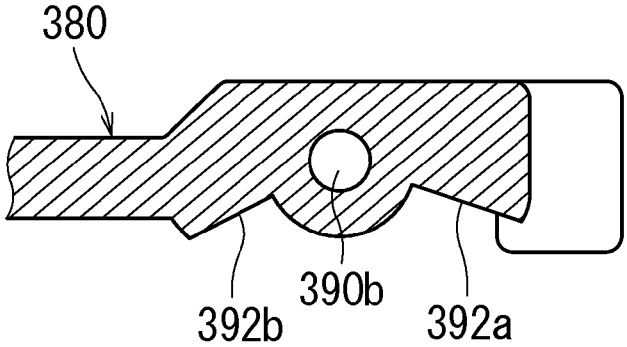

As shown in FIG. 33, the binding member supporting mechanism for pivotally attaching the binding member 70 to the base plate 22 may have such a configuration that the holding hole 32 and the holding hole 36 are formed in the binding member 70 and the supporting projection portions 92 constituting the engagement portions 90 are formed in the first binding member supporting portion 30 and the second binding member supporting portion 34.

The binding member 70 has the pressing portion 72 for pressing the material to be bound X, the bridging portion 74 continuously connected to the pressing portion 72, and the standing portion 76 formed on the side of the bridging portion 74 opposite to the pressing portion 72.

The standing portion 76 is formed with the holding hole 32 and the holding hole 36.

The pair of holding holes 32 and holding hole 36 positioned front and behind are holes rectangular in a front view and extending in the longitudinal direction of the base plate 22 and they are formed at the same height from the upper face of the base plate 22.

The base plate 22 is formed with a first binding member supporting portion 30 and another second binding member supporting portion 34 having a face parallel to a principal face of the first binding member supporting portion 30 in order to support the binding member 70 from the far side to the near side of the operation lever 60.

These first binding member supporting portion 30 and second binding member supporting portion 34 are plate bodies arranged in parallel along the longitudinal direction of the binding member 70. Arrangement is performed such that a line connecting the principal face of the first binding member supporting portion 30 and the principal face of the second binding member supporting portion 34 becomes parallel to the principal face of the bearing plate 24 on the base plate 22 side, and faces of a plurality of binding member supporting portions (the first binding member supporting portion 30 and the second binding member supporting portion 34) are arranged in a parallel to a plane spreading in the longitudinal direction of the binding member 70 toward the side of the binding member 70.

The binding member supporting mechanism for pivotally attaching the binding member 70 to the base plate 22 is composed of the engagement portion 90 provided on the first binding member supporting portion 30 and the second binding member supporting portion 34 so as to project toward the pressing portion 72 side, and the holding hole 32 and the holding hole 36.

As the engagement portion 90, at least two engagement portions 90 are formed with a space from each other in the longitudinal direction on the opposite side to the pressing member 72 for pressing the material to be bound X.

The engagement portions 90 are formed with the supporting projection portions 92 which are caused to engage with the holding hole 32 of the binding member 70 and the holding hole 36 of the binding member 70 to swing the binding member 70.

The supporting projection portions 92 are approximately L-shaped portions in section or approximately clamp-shaped portions in section provided so as to project from the first binding member supporting portion 30 and the second binding member supporting portion 34 toward the standing portion 76 which is the end edge of the binding member 70 on the opposite side to the pressing portion 72. The supporting projection portions 92 are provided with plate-shaped supporting base portions 94 intersecting perpendicularly to the first binding member supporting portion 30 and the second binding member supporting portion 34 and plate-shaped erected portions 97 intersecting perpendicularly to the supporting base portions 94.

The supporting projection portions 92 are held at lower portions of the regions facing the pressing portion 72 of the binding member 70 for pressing the material to be bound X such that the supporting base portions 94 are caused to engage with the upper portions of the holding hole 32 and the holding hole 36 to be capable of swinging the binding member 70

The supporting projection portions 92 rise from upper portions of the holding hole 32 and the holding hole 36 such that the erected portions 97 which are distal end sides extending from the regions (supporting base portions 94) caused to engage with the upper portions of the holding hole 32 and the holding hole 36 do not get off from the holding hole 32 and the holding hole 36 at a swinging time of the binding member 70.

The supporting projection portions 92 are provided to project toward the side of the standing portions 76 with a space from the first binding member supporting portion 30 and the second binding member supporting portion 34 facing the standing portions 76 of the binding member 70 such that the supporting projection portions 92 can be inserted from their distal ends into the holding hole 32 and the holding hole 36 of the binding member 70 in a state where the supporting projection portions 92 have been provided on the base plate 22 serving as the base member so as to project from the first binding member supporting portion 30 and the second binding member supporting portion 34 toward the arrangement side of the binding member 70.

In this embodiment, regarding the supporting projection portions 92, a pair of supporting projection portions 92 positioned front and behind are arranged in parallel along the longitudinal direction of the binding member 70 with a space corresponding to the space between the first binding member supporting portion 30 and the second supporting member supporting portions 34. The supporting projections 92 are plate-shaped bodies with an identical shape composed of the first supporting projection portion 92*a* on the near side and the second supporting projection portion 92*b* on the far side.

Both the first supporting projection portion 92*a* and the second supporting projection portion 92*b* are bent from the end edges of the binding member 70 toward the pressing portion 72 to be formed with the supporting base portions 94 and are bent from the supporting base portions 94 upward to be formed with the erected portions 97.

The first supporting projection portion 92*a* is provided with a plate-shaped first supporting base portion 94*a* intersecting perpendicularly to the standing portion 76 and a plate-shaped first erected portion 97*a* intersecting perpendicularly to the first supporting base portion 94*a* and extending in parallel to the standing portion 76.

The second supporting projection portion 92*b* is provided with a plate-shaped second supporting base portion 94*b* intersecting perpendicularly to the standing portion 76 and a plate-shaped second erected portion 97*b* intersecting perpendicularly to the second supporting base portion 94*b* and extending in parallel to the standing portion 76.

The first supporting projection portion 92*a* and the second supporting projection portion 92*b* are formed such that the first supporting projection portion 92*a* and the second supporting projection portion 92*b* can be inserted from distal ends of the respective erected portions 97 into the respective holes of the holding hole 32 and the holding hole 36 in a state where the binding member supporting portions (the first binding member supporting portion 30 and the second binding member supporting portion 34) have been provided on the base plate 22 serving as the base member so as to project.

The lock mechanism causing the projection portion 100 and the engagement body 120 to engage with each other may be modified such that the engagement body supporting portion 180 constituting the supporting portion is provided on the operation lever 60 and the projection portion 100 is provided in the vicinity of the operation lever 60.

The engagement body 120 may be configured such that it is turned upside down and an opening portion 198 through which the projection portion 100 passes is provided at the lower portion of the operation lever 60.

(First Rotary Lock Mechanism)

As another embodiment of the present invention, a lock mechanism of a binding device where the engagement body has been rotatably attached to the engagement body supporting portion will be described.

The projection portion 300 for fixing, namely, locking the operation lever 360 in the hold state to the base plate 22 is provided in the first vertical side wall 360*a* of the operation lever 360.

The engagement body 320 caused to engage with the projection portion 300 for locking and the engagement body supporting portion 380 attached with the engagement body 320 are provided on the binding member 70 side of the operation lever 360.

The locked state is formed by engagement between the engagement body 320 and the projection portion 300.

The engagement body 320 is rotatably attached to the engagement body supporting portion 380 constituting the supporting portion, and the locking state of pressing the material to be bound X is formed by engagement between the engagement body 320 and the projection portion 300 with a predetermined position and a predetermined orientation of the engagement body 320 to the engagement body supporting portion 380.

The engagement body supporting portion 380 attached with the engagement body 320 has a structure where when the projection portion 300 of the operation lever 360 and the engagement body 320 move from the locked state to the unlocked state and when they move from the unlocked state to the locked state, the engagement body supporting portion 380 is swung to come close to or separate from the projection portion 300 side of the operation lever 360 on a plane parallel to the principal face of the base plate 22.

The engagement body 320 is rotatably attached to the engagement body supporting portion 380, and the engagement body 320 is rotatable to the engagement body supporting portion 380 within a range where the projection portion 300 comes in contact with the engagement body 320 necessarily at a movement time from the unlocked state to the locked state.

The engagement body supporting portion 380 is provided with an engagement body supporting main body 382 having a longitudinal direction extending along the longitudinal direction of the operation lever 360 serving as the operation member and an engagement body receiving portion 384 formed on the engagement body supporting main body 382.

The engagement body supporting main body 382 has a supporting portion fixing portion 386 of the engagement body supporting portion 380 formed at one end thereof in the longitudinal direction and a free end portion 188 formed at the other end of the engagement body supporting portion 380 spaced from the supporting portion fixing portion 386 of the engagement body supporting portion 380.

The engagement body supporting portion 380 is constituted of synthetic resin having an elasticity with a restoring force so as to bend about the supporting portion fixing portion 386 of the fixed engagement body supporting portion 180 to come close to or separate from the projection portion 300 of the operation lever 360 serving as the operation member.

In this embodiment, the engagement body supporting portion 380 is fixed by inserting a fixing projection portion 386*a* of the supporting portion fixing portion 386 formed on a bottom face of the supporting portion fixing portion 386 at one end portion of the engagement body supporting main body 382 into a fixing recessed portion 46*a* formed on an upper face of the base plate 22.

The free end portion 388 of the engagement body supporting portion 380 is configured so as to be slidably inserted into a holding projection portion 46*b* formed on the upper face of the base plate 22 so that the engagement body supporting main body 382 is bent.

In order to make the engagement body supporting portion 380 rotatable to the engagement body supporting portion 380 within a range where the projection portion 300 comes in contact with the engagement body 320 necessarily, the engagement body supporting main body 382 is formed with an engagement pivoting portion 390.

The engagement pivoting portion 390 is provided with a first engagement body pivoting portion 390*a* formed at an upper portion of the engagement body supporting main body 382 and a second engagement body pivoting portion 390*b* formed at a lower portion of the engagement body supporting main body 382.

Further, the engagement body supporting portion 380 is provided with an engagement body rotation restricting portion 392 for limiting a range of rotation of the engagement body 320 in a direction where the engagement body 320 rotates the engagement body pivoting portion 390 in a plan view.

The engagement body rotation restricting portion 392 is provided with a first engagement body rotation restricting portion 392*a* formed toward the engagement body receiving portion 384 on the near side of the engagement body receiving portion 384 and a second engagement body rotation restricting portion 392*b* formed toward the engagement body receiving portion 384 on the far side of the engagement body receiving portion 384.

In this embodiment, the engagement body supporting portion 380 is provided with an engagement body receiving portion 384 for receiving an engagement body in a boring manner.

The engagement body supporting main body 382 has an opening portion 398 allowing passage of the projection portion 300 at an upper portion thereof (namely, a wall face opposite to the base plate 22), and the opening portion 398 communicates with the engagement body 320 receiving portion 384.

When the operation lever 360 is caused to hang down for locking, the projection portion 300 of the operation lever 360 passes through the opening portion 398 to reach above the engagement body 320 of the engagement body receiving portion 384.

When the operation lever 360 is raised for unlocking, the projection portion 300 of the operation lever 360 passes through the opening portion 398 to reach above the engagement body supporting portion 380.

The engagement body 320 is provided with an engagement body main body 322 brought in sliding contact with the engagement body receiving portion 384 of the engagement body supporting portion 380 and a follow-up guidance portion 324 for moving following the projection portion 300 formed on the engagement body main body 322, and the engagement body 320 is configured so as to move from the locked state to the unlocked state along the engagement body receiving portion 384 of the engagement body supporting portion 380 according to movement of the projection portion 300 arranged on the follow-up guidance portion 324.

The follow-up guidance portion 324 of the engagement body 320 is provided with a first slope portion 330 to which the projection portion 300 is pressed at a movement time from the unlocked state to the locked state, a first projection passage portion 332 through which the projection portion 300 passes at the movement time from the unlocked state to the locked state, a projection guidance portion 334 which guides the projection portion 300 at movement time from the unlocked state to the locked state, a projection engagement portion 336 which is caused to engage with the projection portion 300 at a movement time to the locked state, a second slope portion 338 to which the projection portion 300 is pressed at a movement time from the locked state to the unlocked state, and a second projection passage portion 340 through which the projection portion 300 passes at the movement time from the locked state to the unlocked state.

The slope of the first slope portion 330 and the slope of the second slope portion 338 are inclined in directions reversed to each other in a rotation direction of the engagement body 320.

The first slope portion 330 is formed on an upper face of a first block 326 formed above the engagement body main body 322 and an upper portion of a second projection edge portion 344, namely, on the opening portion 398 side.

The first projection passage portion 332 is formed on a side portion of the first block 326, namely along a wall face on the far side.

A first projection edge portion 342 is formed on the first projection passage portion 332 so as to project to the projection portion 300 passing through the first projection passage portion 332.

The second projection edge portion 344 is formed on the second projection passage portion 340 so as to project to the projection portion 300 passing through the second projection passage portion 340.

The first projection passage portion 332 is provided at a lower position on the first slope portion 330 so as to connect to the first slope portion 330, the projection guidance portion 334 is provided so as to connect to a position on the first slope portion 330 separated from the region of the first slope portion 330 provided so as to connect to the first projection passage portion 332, and the projection engagement portion 336 is provided so as to connect subsequently to the projection guidance portion 334.

The projection engagement portion 336 is formed below the first block 326 on the base plate 22 side, namely, below a wall face of the lower portion of the first block 326.

The second slope portion 338 is formed so as to face the projection engagement portion 336, and the second projection passage portion 340 is provided so as to connect to the second slope portion 338 at a lower position on the second slope portion 338.

The second slope portion 338 is formed at an upper portion of the second block 328 formed on a lower portion of the engagement body main body 322, namely, on the opening portion 398 side.

A projection passage step difference portion 350 recessed deeper than a region between the projection engagement portion 336 and the second slope portion 338 is formed between the projection portion 336, the near side of the second slope portion 338, and the second projection passage portion 340.

The second projection passage portion 340 is formed in a region on the near side of the projection passage step difference portion 350 recessed deeper than the region between the projection engagement portion 336 and the second slope portion 338, and it is formed along a wall face of the first block 326 on the near side.

The engagement body 320 is provided with engagement body shaft portions 370 (a first engagement body shaft portion 370*a* and a second engagement body shaft portion 370*b*) attached to the engagement body pivoting portions 390 of the engagement body supporting portion 380.

In this embodiment, the engagement body 320 is configured such that the first engagement body shaft portion 370*a* is rotatably attached to the first engagement body pivoting portion 390*a* formed at the upper portion of the engagement body supporting main body 382 of the engagement body supporting portion 380 and the second engagement body shaft portion 370*b* is rotatably attached to the second engagement body pivoting portion 390*b* formed at the lower portion of the engagement body supporting main body 382, so that the engagement body 320 rotates the engagement body supporting main body 382 about the engagement body shaft portions 370 within the engagement body receiving portion 384 in a plan view.

The engagement body 320 is configured on its face side facing the operation lever 360 side such that the follow-up guidance portion 324 is provided in the engagement body main body 322 in a bored manner and the projection portion 300 inserted into the follow-up guidance portion 324 can be moved. The follow-up guidance portion 324 is formed on a circumferential face of a column-shaped body formed in a fan shape in a sectional view.

The engagement body 120 is configured on its face side facing the operation lever 60 side such that the follow-up guidance portion 124 is provided in the engagement body main body 122 in a bored manner and the projection portion 100 inserted into the follow-up guidance portion 124 can be moved.

The engagement body 320 has engagement body groove portions 372 (a first engagement body groove portion 372*a* and a second engagement body groove portion 372*b*) provided about the engagement body shaft portions 370 in a recessed fashion in order to reduce heights of the engagement body supporting portion 380 and the engagement body 320 thereby reducing a height of the entire binding device 20. Further, the engagement body 320 has the follow-up guidance portion 324 provided to connect to the engagement body groove portion 372 in a direction from the rotation shaft of the engagement body 320 outward rather than the engagement body groove portion 372

The first engagement body groove portion 372*a* of the engagement body 320 and the first engagement body pivoting portion 390*a* of the engagement body supporting portion 380 are configured so as to come in sliding contact with each other, and the second engagement body groove portion 372*b* of the engagement body 320 and the second engagement body pivoting portion 390*b* of the engagement body supporting portion 380 are configured so as to come in sliding contact with each other.

Figure 38A:
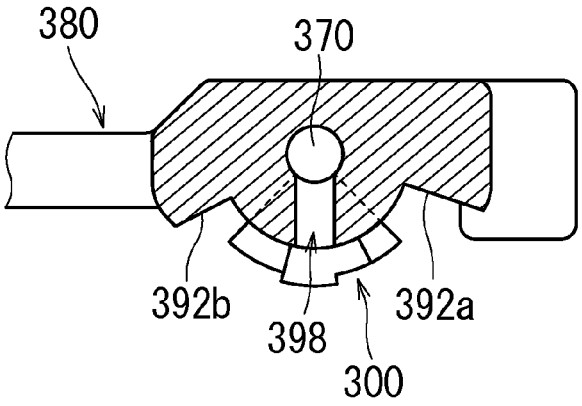
FIGS. 38A to 38C are plan diagrammatical views for explaining an operation state of the engagement body of the engagement body supporting portion of the binding device of the third embodiment shown in FIG. 36B, partially including a sectional view.
Figure 38B:
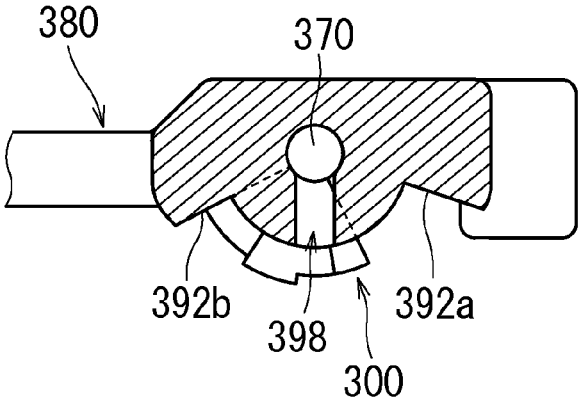
Figure 38C:
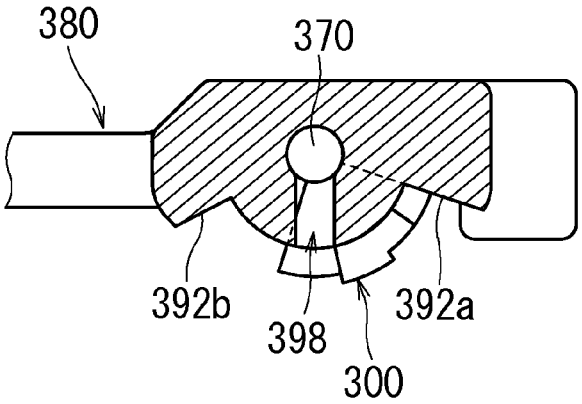

The engagement body 320 can take a first state where the first projection passage portion 332 is positioned on a track of the projection portion 300, a second state where the projection portion 300 and the engagement body 320 are caused to engage with each other and the binding member 70 is put in a locked state, and a third state where the second projection passage portion 340 is positioned on the track of the projection portion 300 (see FIGS. 38A to 38C).

The projection portion 300 is provided with a first face 302 having a slope formed on an upper portion thereof, a second face 304 continuing to a lower portion of the first face 302 via a corner portion, a third face 306 continuing, via a corner portion, to a portion of the second face 304 which does not continue to the first face 302, a fourth face 308 continuing, via a corner portion, to a portion of the third face 306 which does not continue to the second face 304, and a fifth face 310 continuing, via a corner portion, to a portion of the fourth face 308 which does not continue to the third face 306.

The projection portion 300 is formed in a prismatic body with a polygonal shape in section, the above-described side faces constitute side faces of the prismatic body, and is provided with a bottom face 312 of a prismatic body and side faces of the prismatic body.

The first face 302, the second face 304, the third face 306, the fourth face 308, and the fifth face 310 are formed on the side faces of the prismatic body.

The first face 302 is a slope which becomes lower toward the far side of the operation lever 360, the second face 304 is a vertical flat face in a state where the operation lever 360 has made horizontal, the third face 306 is a slope flat face which becomes lower toward the far side of the operation lever 360, the fourth face 308 is a slope flat face which becomes higher toward the far side of the operation lever 360, and the fifth face 310 is a vertical flat face in a state where the operation lever 360 has made horizontal, so that an approximately pentagonal shape is formed.

The first face 302 is of a wave shape in cross section. The bottom face 312 faces the vertical wall face of the engagement body moving portion 384 of the engagement body supporting portion 380, and it is a vertical flat face for sliding contact.

The projection portion 300 is formed such that the bottom face of the prismatic body faces a face of the engagement body 120 facing the operation lever 360 serving as the operation member and the side face of the prismatic body comes in sliding contact with the follow-up guidance portion 324 of the engagement body 320.

Next, explanation about a procedure of changing the operation lever 360 in the open state to the hold state and changing the lock mechanism in the locked state will be made.

When the operation lever 360 serving as the operation member is pressed down toward the base plate 22 in a direction approximately orthogonal to the principal face of the base plate 22 serving as the base member in order to switch the lock mechanism to the locked state, the projection portion 300 of the operation lever 360 reaches below the opening portion 398, namely, above the engagement body 320 positioned on the base plate 22 side through the opening portion 398 at the upper portion of the engagement body supporting portion 380.

A corner portion between the third face 306 and the fourth face 308 of the projection portion 300 which is a leading end when the projection portion 300 advances through the opening portion 398 is pressed to the first slope portion 330, the engagement body 320 is moved from a higher side of the slope of the first slope portion 330 to a lower side thereof by a pressing-down force of the operation lever 360. The engagement body 320 reaches above the first projection passage portion 332 to take the first state.

When the operation lever 360 serving as the operation member is further pressed down, the projection portion 300 passes through the first projection passage portion 332 along the wall face of the first block 326 of the engagement body 320 in the first state to reach the position of the wall face of the second block 328 on the first projection passage portion 332 side.

When a force for pressing down the operation lever 360 is slightly weakened, the projection portion 300 abuts on the lower face of the first projection edge portion 342, namely, the wall face on the side of the base plate 22 due to a restoring force of the spring member 50.

When the projection portion 300 of the operation lever 360 presses down the lower face of the first projection edge portion 342 due to the restoring force of the spring member 50, the engagement body 320 moves to a lower side of the slope of the first projection edge portion 342, and further moves to a lower side of the slope of the projection engagement portion 336.

The first face 302 of the projection portion 300 reaches below the projection engagement portion 336 so that engagement body 320 takes the second state.

The engagement body 320 and the projection portion 300 are caused to engage with each other due to movement of the engagement body 320 to the second state, so that the locked state is formed.

The engagement body 320 is caused to engage with the projection portion 300 due to the restoring force of the spring member 50 in the second state, so that the locked state is maintained.

When the operation lever 360 serving as the operation member in the hold state is pressed down to the base plate 22 side in order to unlock the lock mechanism, the projection portion 300 in the locked state is pressed to the second slope portion 338 so that engagement body 320 is moved to an lower side of the slope of the second slope portion 338 to reach the second projection passage portion 340 side of the second block 328. The engagement body 320 takes the third state.

When the pressing-down force of the operation lever 360 is weakened, the projection portion 300 rises along the projection passage step difference portion 350 guiding the projection portion 300 due to the restoring force of the spring member 50.

The projection portion 300 passes through the second projection portion 340 of the engagement body 320 in the third state to get over the second projection edge portion 344 and move above the opening portion 398 of the engagement body supporting portion 380, so that unlocking is performed and the operation lever 360 is put in the open state.

In this embodiment, the projection portion 300 and the engagement body 320 are formed in the following manner.

(1) The first slope portion 330 stopped at the lower end of the opening portion 398 is provided with a gentle slope lowering from the near side toward the far side.

The second projection edge portion 344 is formed with a slope portion at an upper portion thereof, and is formed with a slope continuing to the slope on the upper face of the first block 326.

Therefore, the upper face of the first block 326 and the continuing slope of the upper portion of the second projection edge portion 344 constitute the first slope portion 330. The slope of the upper face of the first block 326 and the slope of the upper portion of the second projection edge portion 344 which constitute the first slope portion 330 have substantially the same inclination angle.

The vicinity of the corner portion between the third face 306 and the fourth face 308 of the projection portion 300 is pressed to the first slope portion 330 to be moved so that the engagement body 320 takes the first state (see FIGS. 34A(1) to FIGS. 34C(3)).

(2) The first projection passage portion 332 provided to continue to the lower side of the first slope portion 330 extends in a vertical direction such that the second face 304 of the projection portion 300 is caused to hang down while being brought in contact with the far side of the first block 326 on the far side of the engagement body main body 322.

The first projection passage portion 332 is formed with the first projection edge portion 342 above the first projection passage portion 332.

The first projection passage portion 332 is provided with a slope projecting to the operation lever 360 side along a direction from the first slope portion 330 downward and is formed with the first projection edge portion 342 at a lower end of the slope.

The engagement body 320 is slid while the first projection passage portion 332 is in contact with the corner portion between the third face 306 and the fourth face 308, and the projection portion 300 reaches the lower face of the first projection edge portion 342 according to the movement of the engagement body 320. At this time, the bottom face 312 of the projection portion 300 abuts on the first projection edge portion 342 of the engagement body 320 to push the engagement body supporting portion 380, so that the engagement body supporting portion 380 is bent about the supporting portion fixing portion 386 in a direction of separating from the operation lever 360 (see FIGS. 34D(1) to 34D(3)).

(3) The lower face of the first projection edge portion 342 is provided with the projection guidance portion 334 having a slope rising toward the near side.

The projection engagement portion 336 connecting to the projection guidance portion 334 on the lower face of the first projection edge portion 342 extend from the vicinity of the central portion of the first projection passage portion 332 in the vertical direction toward the near side.

The projection engagement portion 336 rises toward the near side at the slope connecting to the projection guidance portion 334 on the lower face of the first projection edge portion 342. The inclination angles of the slope of the projection guidance portion 334 of the slope on the lower face of the first projection edge portion 342 and the slope of the projection engagement portion 336 are approximately the same angle.

The projection engagement portion 336 has, on the near side, a projection portion catching portion 336*a* abutting on the second face 304 of the projection portion 300 to stop the engagement body 320 and provided so as to project downward.

The engagement body 320 is guided while the second face 304 of the projection portion 300 is in contact with the wall face of the second block 328 on the far side positioned on the far side of the second slope portion 338, and it rises due to the biasing force of the spring member 50 so that the projection guidance portion 334 and the projection engagement portion 336 reach above the first face 302 of the projection portion 300 (see FIGS. 34F(1) to 34(3)).

The engagement body 320 abuts on the first face 302 of the projection portion 300 to move to the far side due to the biasing force of the spring member 50.

The projection portion 300 and the projection portion catching portion 336*a* of the engagement body 320 abut on each other and the projection engagement portion 336 of the engagement body 320 is caused to engage with the first face 302 of the projection portion 300, so that the engagement body 320 is put in the locked state (see FIGS. 34G(1) to 34G(3)).

(4) The second slope portion 338 is formed just below the projection portion 300 fixed to the projection engagement portion 336 in the locked state.

The second slope portion 338 is formed with a slope descending from the far side toward the near side to reach the second projection passage portion 340.

The second slop portion 338 comes in sliding contact with the fourth face 308 of the projection portion 300 to guide the engagement body 120 such that the second projection passage portion 340 is positioned at the position of the projection portion 300.

(5) Such a configuration is adopted that the second projection passage portion 340 provided so as to connect to the near side of the second slope portion 338 is caused to hang down in parallel to the first projection passage portion 332 and the projection portion 300 rises along the projection passage step difference portion 350 constituting the second projection passage portion 340 and the wall face of the first block 326 on the near side due to the biasing force of the spring member 50.

The projection portion 300 is guided outward above the engagement body 320 while the fifth face 310 of the projection portion 300 comes in contact with the face of the first block 326 of the engagement body main body 322 on the side of the second projection passage portion 340 (FIGS. 34I(1) to FIGS. 34J(3)).

(6) The second projection edge portion 344 formed above the second projection passage portion 340 has an inclined shape projecting on the operation lever 360 side according to arrival from below up to above, and the projection portion 300 gets over the second projection edge portion 344 to go outside when the projection portion 300 goes outside the engagement body main body 322. At this time, the bottom face 312 of the projection portion 300 abuts on the second projection edge portion 344 of the engagement body 320 to push the engagement body supporting portion 380, so that the engagement body supporting portion 380 is bent about the supporting portion fixing portion 386 in a direction of separating from the operation lever 360 (see FIGS. 34K(1) to 34K(3)).

The projection portion 300 gets over the second engagement edge portion 344 to move above the opening portion 398 of the engagement body supporting portion 380, so that unlocking is performed and the operation lever 360 reaches the open state.

The first projection edge portion 342 formed on the first projection passage portion 332 projects to the projection portion 300 when the projection portion 300 passes through the first projection passage portion 332, and when the projection portion 300 passes through the first projection passage portion 332 at a movement time from the unlocked state to the locked state, the projection portion 300 is pushed to the first projection edge portion 342, so that the engagement body supporting portion 380 is swung (bent), and when the projection portion 300 has passed through the first projection edge portion 342, the engagement body supporting portion 380 is restored.

Thereafter, when the projection portion 300 rises due to the biasing force of the spring member 50, the projection portion 300 is pushed to the projection guidance portion 334 of the lower portion of the first projection edge portion 342, so that the projection portion 300 cannot go back through the first projection passage portion 332 due to the first projection edge portion 342.

The second projection edge portion 344 formed on the second projection passage portion 340 projects toward the projection portion 300 when the projection portion 300 passes through the second passage portion 340, and when the projection portion 300 passes through the second projection passage portion 340 at a movement time from the locked state to the unlocked state, the projection portion 300 is pushed to the second projection edge portion 344 so that the engagement body supporting portion 380 is swung (bent), and when the projection portion 300 has passed through the second projection edge portion 344, the engagement body supporting portion 380 is restored.

Thereafter, even if the engagement body 320 is in the third state, the projection portion 300 is pushed to the first slope portion 330 on the upper portion of the second projection edge portion 344 when the operation lever 360 is pressed down, so that the projection portion 300 cannot go back through the second projection passage portion 340 due to the second projection edge portion 344.

(Second Rotary Lock Mechanism)

As still another embodiment, a lock mechanism of a binding device 20 provided with a plurality of projection portions, the lock mechanism being provided with a first projection portion 400 caused to engage with the engagement body 420 and a second projection portion 401 rotating the engagement body 420 at a movement time from the locked state and the unlocked state, will be described.

Figure 40B:
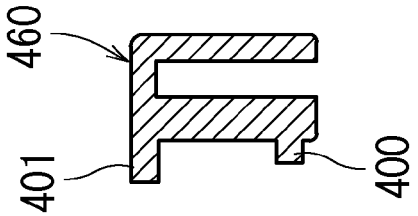
FIGS. 40A and 40B are a side diagrammatical view and a sectional diagrammatical view of the operation member in the binding device provided with a rotary lock mechanism according to the four embodiment.
Figure 40A:
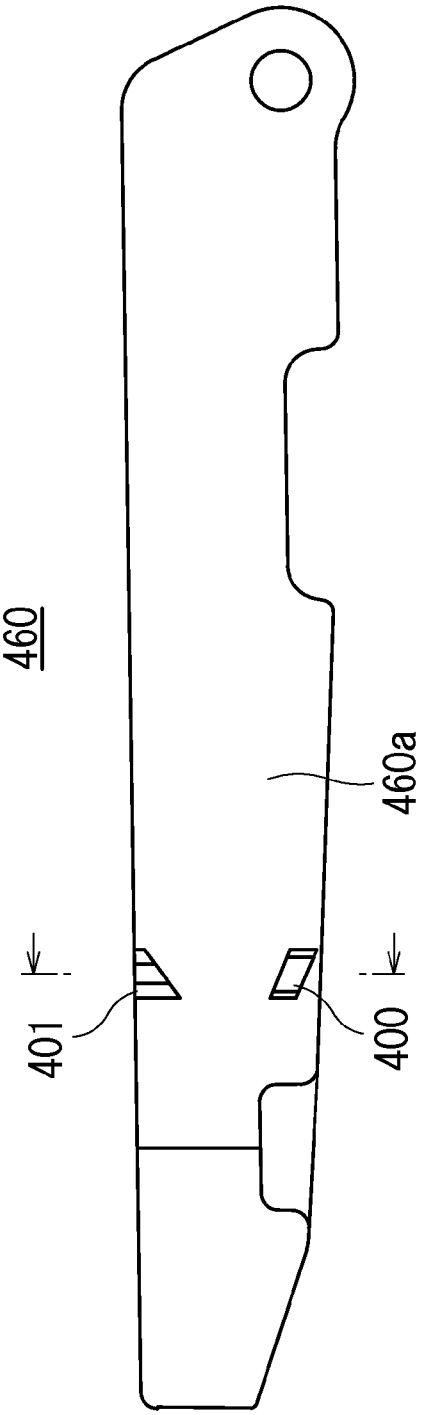
Figure 41A:
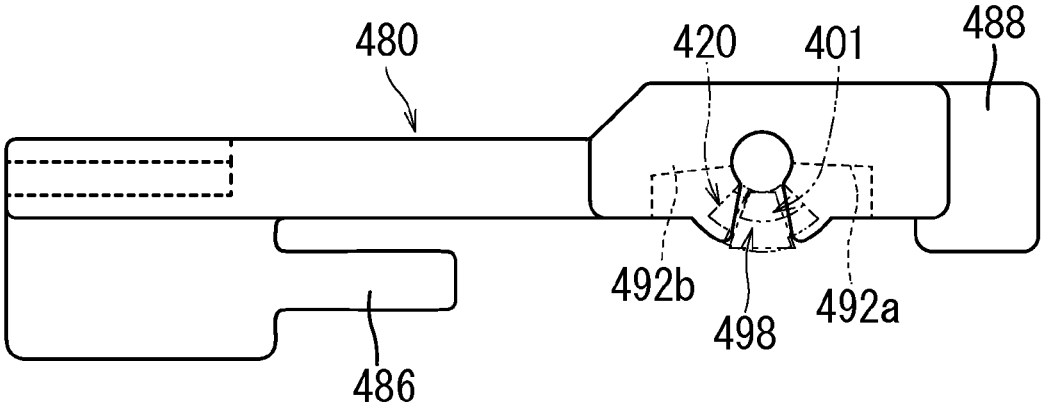
FIGS. 41A and 41B are a plan view and a side diagrammatical view of the engagement body supporting portion of the binding device provided with a rotary lock mechanism according to the fourth embodiment.
Figure 41B:
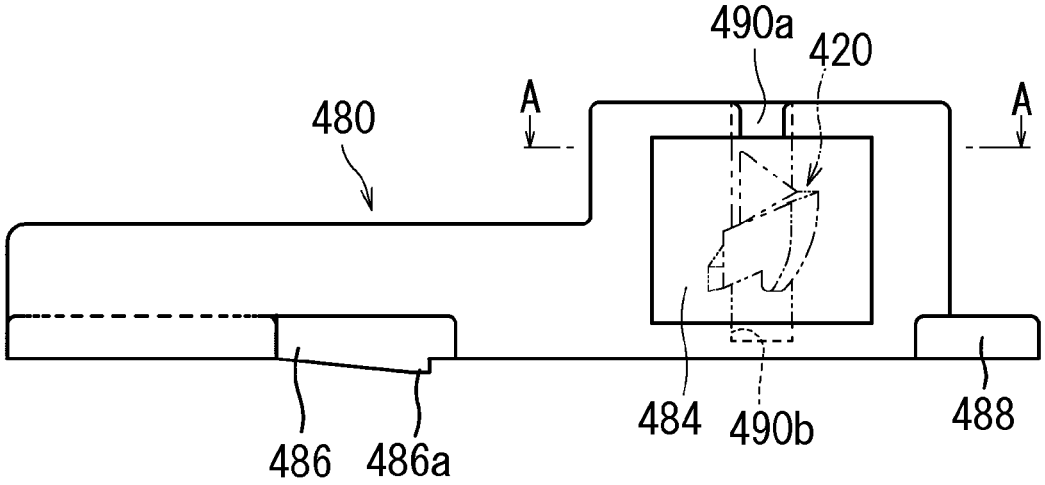
Figure 42A:
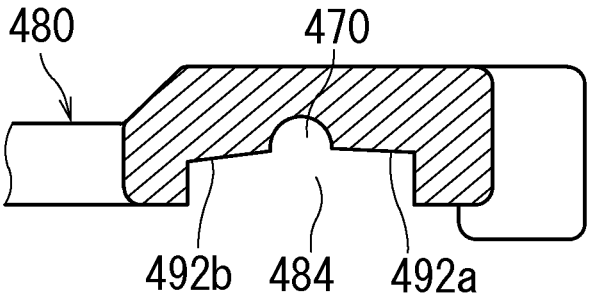
FIGS. 42A to 42C are plan diagrammatical views for explaining an operation state of the engagement body of the engagement body supporting portion of the binding device according to the fourth embodiment shown in FIG. 41B, partially including a sectional view.
Figure 42B:
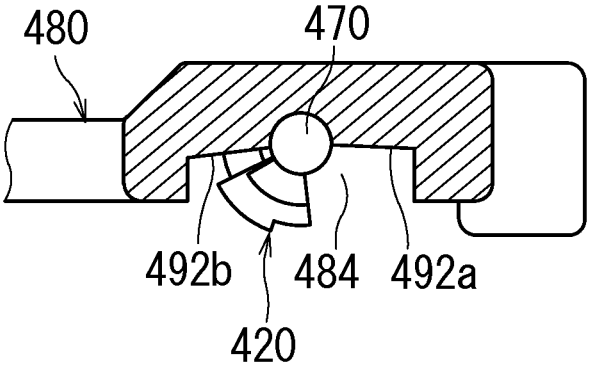
Figure 42C:
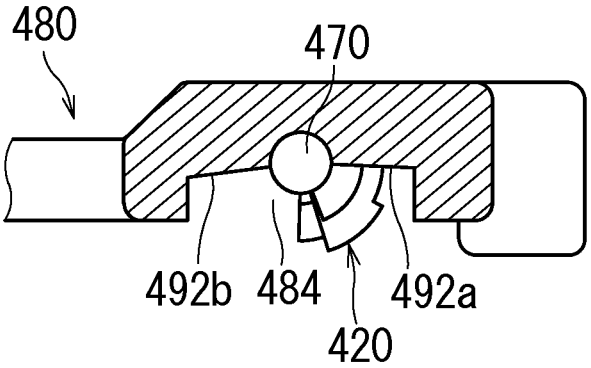

As shown in FIGS. 40A and 40B, a first vertical side wall 460*a* of an operation lever 460 is provided with the first projection portion 400 for fixing the operation lever 460 put in the hold state to the base plate 22, namely, performing locking of the operation lever 460, and the second projection portion 401 for movement from the locked state to the unlocked state.

The first projection portion 400 and the second projection portion 401 are provided on the same track when movement from the unlocked state to the locked state is performed by pressing down the operation lever 460. The first projection portion 400 is provided on the side where the operation lever 460 has been pressed down, namely, on the lower end side, while the second projection portion 401 is provided on the opposite side to the side where the operation lever 460 has been pressed down, namely, on the upper end side.

The engagement body 420 caused to engage with the first projection portion 400 for performing locking and the engagement body supporting portion 480 attached with the engagement body 420 are provided on the binding member 70 side of the operation lever 460.

The locked state is formed by engagement between the engagement body 420 and the first projection portion 400.

The engagement body 420 is rotatably attached to the engagement body supporting portion 480 constituting the supporting portion, and the locking state of pressing the material to be bound X is formed by engagement between the engagement body 420 and the first projection portion 400 with a predetermined position and a predetermined orientation of the engagement body 420 to the engagement body supporting portion 480.

The engagement body supporting portion 480 attached with the engagement body 420 has a structure where when the first projection portion 400 and the second projection portion 401 of the operation lever 460 and the engagement body 420 move from the locked state to the unlocked state and when they move from the unlocked state to the locked state, the engagement body supporting portion 480 is swung to come close to or separate from the projection portion 400 side of the operation lever 460 on a plane parallel to the principal face of the base plate 22.

When the engagement body 420 moves from the unlocked state to the locked state, it is rotatable to the engagement body supporting portion 480 within a range where the first projection portion 400 comes in contact with the engagement body 420 necessarily.

The engagement body supporting portion 480 serving as the supporting portion is provided with an engagement body supporting main body 482 having a longitudinal direction extending along the longitudinal direction of the operation lever 460 serving as the operation member and an engagement body receiving portion 484 formed on the engagement body supporting main body 482.

The engagement body supporting main body 482 has a supporting portion fixing portion 486 of the engagement body supporting portion 480 formed at one end thereof in the longitudinal direction and a free end portion 488 formed at the other end of the engagement body supporting portion 480 spaced from the supporting portion fixing portion 486 of the engagement body supporting portion 480.

The engagement body supporting portion 480 is constituted of synthetic resin having an elasticity with a restoring force so as to bend about the supporting portion fixing portion 486 of the fixed engagement body supporting portion 480 to come close to or separate from the projection portion 400 of the operation lever 460 serving as the operation member.

In this embodiment, the engagement body supporting portion 480 is fixed by inserting a fixing projection portion 486*a* of the supporting portion fixing portion 486 formed on a bottom face of the supporting portion fixing portion 486 at one end portion of the engagement body supporting main body 482 into a fixing recessed portion 46*a* formed on an upper face of the base plate 22.

The free end portion 488 of the engagement body supporting portion 480 is configured so as to be slidably inserted into a holding projection portion 46*b* formed on the upper face of the base plate 22 so that the engagement body supporting main body 482 is bent.

In order to make the engagement body supporting portion 480 rotatable to the engagement body supporting portion 480 within a range where the first projection portion 400 comes in contact with the engagement body 420 necessarily, the engagement body supporting main body 482 is formed with an engagement pivoting portion 490.

The engagement pivoting portion 490 is provided with a first engagement body pivoting portion 490*a* formed at an upper portion of the engagement body supporting main body 482 and a second engagement body pivoting portion 490*b* formed at a lower portion of the engagement body supporting main body 482.

Further, the engagement body supporting portion 480 is provided with an engagement body rotation restricting portion 492 for limiting a range of rotation of the engagement body 420 in a direction where the engagement body 420 rotates the engagement body pivoting portion 490 in a plan view.

The engagement body rotation restricting portion 492 is provided with a first engagement body rotation restricting portion 492*a* formed toward the engagement body receiving portion 484 on the near side of the engagement body receiving portion 484 and a second engagement body rotation restricting portion 492*b* formed toward the engagement body receiving portion 484 on the far side of the engagement body receiving portion 484.

In this embodiment, the engagement body supporting portion 480 is provided with an engagement body receiving portion 484 for receiving an engagement body 420 in a boring manner.

The engagement body supporting main body 482 has an opening portion 498 allowing passage of the first projection portion 400 and the second projection portion 401 at an upper portion thereof (namely, a wall face opposite to the base plate 22), and the opening portion 498 communicates with the engagement body receiving portion 484.

When the operation lever 460 is caused to hang down for locking, the first projection portion 400 of the operation lever 460 passes through the opening portion 498 to reach above the engagement body 420 of the engagement body receiving portion 484.

When the operation lever 460 is raised for unlocking, the first projection portion 400 and the second projection portion 401 of the operation lever 460 passes through the opening portion 498 to reach above the engagement body supporting portion 480.

The engagement body 420 is provided with an engagement body main body 422 brought in sliding contact with the engagement body receiving portion 484 of the engagement body supporting portion 480 and a follow-up guidance portion 424 for moving following the first projection portion 400 and the second projection portion 401 formed on the engagement body main body 422, and the engagement body 420 is configured so as to move from the locked state to the unlocked state along the engagement body receiving portion 484 of the engagement body supporting portion 480 according to movement of the first projection portion 400 and the second projection portion 401 arranged on the follow-up guidance portion 424.

The follow-up guidance portion 424 of the engagement body 420 is provided with a first slope portion 430 to which the projection portion 400 is pressed at a movement time from the unlocked state to the locked state, a first projection passage portion 432 through which the first projection portion 400 passes at the movement time from the unlocked state to the locked state, a projection guidance portion 434 which guides the first projection portion 400 at movement time from the unlocked state to the locked state, a projection engagement portion 436 which is caused to engage with the first projection portion 400 at a movement time to the locked state, a second slope portion 438 to which the second projection portion 401 is pressed at a movement time from the locked state to the unlocked state, and a second projection passage potion 440 through which the first projection portion 400 passes at the movement time from the locked state to the unlocked state.

The slope of the first slope portion 430 and the slope of the second slope portion 438 are inclined in directions reversed to each other in a rotation direction of the engagement body 420.

The engagement body 420 is provided with engagement body shaft portions 470 (a first engagement body shaft portion 470*a* and a second engagement body shaft portion 470*b*) attached to the engagement body pivoting portion 490 of the engagement body supporting portion 480.

The first engagement body shaft portion 470*a* is rotatably attached to a first engagement body pivoting portion 490*a* formed at an upper portion of the engagement body supporting main body 482, while the second engagement body shaft portion 470*b* is rotatably attached to a second engagement body pivoting portion 490*b* formed at a lower portion of the engagement body supporting main body 482.

The engagement body 420 can take a first state where the first projection passage portion 432 is positioned on a track of the first projection portion 400, a second state where the first projection portion 400 and the engagement body 420 are caused to engage with each other and the binding member 70 is put in a locked state, and a third state where the second projection passage portion 440 is positioned on the track of the first projection portion 400.

The engagement body 420 is rotatable to the engagement body supporting portion 480, and when the engagement body 420 does not take the first state where the first projection passage portion 432 is positioned on the track of the first projection portion 400, the engagement body 420 is rotatable to the engagement body supporting portion 480 within such a range that the first slope portion 430 is on the track of the first projection portion 400 necessarily.

The engagement body 420 is provided with a first block 426 having the first slope 430 at an upper portion thereof, a second block 428 having the second slope 438 at the upper portion thereof, a first passage body 427 having a first projection passage portion, and a second passage portion 429 having a second projection passage portion.

The first block 426 is provided on a lower side of the second block 428, and the first block 426, the second block 428, the first passage body 427, and the second passage body 429 are provided in a form where they project from the rotation shaft of the engagement body shaft portion 470 outward.

The first block 426 and the second block 428 are provided on the tracks of the first projection portion 400 and the second projection portion 401 on the engagement body 420, namely, within a range of approximately the same angle from the rotation shafts in a plan view of the engagement body 420.

Further, the first block 426 is provided on the engagement body 420 on a leading side, namely, a lower side, and the second block 428 is provided on the engagement body 420 on a trailing side, namely, an upper side in an advancing direction of the first projection portion 400 from the opening portion 498 to the engagement body receiving portion 484.

The first passage body 427 is provided so as to connect a side portion of the first block 426 positioned on a lower side of a slope of the first slope portion 430.

The second passage body 429 so as to connect a side portion of the first block 426 positioned on a higher side of a slope of the first slope portion 430.

The first passage body 427 has a smooth slope formed so as to project from the rotation shaft of the engagement body 420 toward the advancing side from the opening portion 498 of the first projection portion 400 to the engagement body receiving portion 484, and a first projection edge portion 442 which has projected farthest from the rotation shaft is provided at a distal end of the slope.

The second passage body 429 has a smooth slope formed so as to project from the rotation shaft of the engagement body 420 according to advancing to the trailing side in an advancing direction of the first projection portion 400 from the opening portion 498 to the engagement body receiving portion 484, and a second projection edge portion 444 which has projected farthest from the rotation shaft is provided at a distal end of the slope.

The first block 426 and the first passage body 427 have continuous first slope portions 430 on their upper faces.

In this embodiment, the engagement body 420 is configured such that the first engagement body shaft portion 470*a* is rotatably attached to the first engagement body pivoting portion 490*a* formed at the upper portion of the engagement body supporting main body 482 of the engagement body supporting portion 480, the second engagement body shaft portion 470*b* is rotatably attached to the second engagement body pivoting portion 490*b* formed at the lower portion of the engagement body supporting main body 482, so that the engagement body 420 rotates about the engagement body shaft portion 470 in a plan view of the engagement body supporting main body 482 within a rotatable range restricted by the engagement body rotation restricting portion 492.

The engagement body 420 is configured on its face side facing the operation lever 460 side such that the follow-up guidance portion 424 is provided in the engagement body main body 422 in a bored manner and the projection portion 400 inserted into the follow-up guidance portion 424 can be moved. The follow-up guidance portion 424 is formed on a circumferential face of a column-shaped body formed in a fan shape in a sectional view.

In this embodiment, the engagement body 420 and the engagement body supporting portion 480 are provided on the base plate 22 serving as the base member, while the first projection portion 400 and the second projection portion 401 are provided on the operation lever 460. The first projection portion 400 is provided on the advancing side in the advancing direction when the first projection portion 400 and the second projection portion 401 advance into the opening portion 498, namely, on the lower end side of the operation lever 460, while the second projection portion 401 is provided on the trailing side in the advancing direction when the first projection portion 400 and the second projection portion 401 advance into the opening portion 498, namely, on the upper end side of the operation lever 460.

As a modified example, the engagement body 420 and the engagement body supporting portion 480 may be provided on the operation lever 460, while the first projection portion 400 and the second projection portion 401 may be provided on the base plate 22 serving as the base member.

The first projection portion 400 is provided with a first face 404 having a slope formed on an upper portion thereof, a second face 405 continuing to a lower portion of the first face 404 via a corner portion, a third face 406 continuing, via a corner portion, to a portion of the second face 405 which does not continue to the first face 404, a fourth face 407 continuing, via a corner portion, to a portion of the third face 406 which does not continue to the second face 405.

The first projection portion 400 is formed in a prismatic body with an approximately polygonal shape in section, the above-described side faces constitute side faces of the prismatic body, and it is provided with a bottom face 408 of a prismatic body and side faces of the prismatic body.

The first face 404, the second face 405, the third face 406, the fourth face 407 are formed on the side faces of the prismatic body.

The first face 404 is a slope which becomes lower toward the far side of the operation lever 460, the second face 405 is a slope inclined toward the rotation shaft of the engagement body 420 in a state where the operation lever 460 has been made horizontal, the third face 406 is a slope which becomes lower toward the far side of the operation lever 460, and the fourth face 407 is a slope inclined toward the rotation shaft of the engagement body 420 in a state where the operation lever 460 has been made horizontal, so that an approximately quadrangular prism-shaped body is formed.

The first projection portion 400 is formed such that the bottom face 408 of the prismatic body faces a face of the engagement body 420 facing the operation lever 460 serving as the operation member and the side face of the prismatic body comes in sliding contact with the follow-up guidance portion 424 of the engagement body 420.

The second projection portion 401 is provided with a fifth face 412 formed at a lower portion, a sixth face 413 continuing to a lower portion of the fifth face 412 via a corner portion, a seventh face 414 continuing to a portion of the sixth face 413 which does not continue to the fifth face 412 via a corner portion, and an eighth face 415 continuing to a portion of the seventh face 414 which does not continue to the sixth face 413 via a corner portion.

The second projection portion 401 is formed in a prismatic body with an approximately polygonal shape in section where the above-described faces constitute side faces, and it is provided with a bottom face 416 of the prismatic body and side faces of the prismatic body.

The fifth face 412, the sixth face 413, the seventh face 414, and the eighth face 415 are formed on side faces of the prismatic body.

The fifth face 412 is a slope which becomes higher toward the far side of the operation lever 460, the sixth face 413 is a slope inclined toward the rotation shaft of the engagement body 420 in a state where the operation lever 460 has been made horizontal, the seventh face 414 is a flat face approximately parallel to the upper face of the operation lever 460, and the eighth face 415 is a slope inclined toward the rotation shaft of the engagement body 420 in state where the operation lever 460 has been made horizontal, so that an approximately quadrangular prism-shaped body is formed.

The second projection portion 401 is formed such that the bottom face 416 of the prismatic body faces a face facing the operation lever 460 serving as the operation member for the engagement body 420, and the fifth face 412 which is a side face of the prismatic body comes in sliding contact with the second slope 428 of the engagement body 420.

In the locked state, the first face 404 is inclined upward on the opposite side to the operation lever 460 such that the first face 404 and the fourth face 407 of the first projection portion 400 and the projection engagement portion 436 of the engagement body 420 come in contact with each other and the first projection portion 400 and the projection engagement portion 436 of the engagement body 420 are caused to engage with each other A corner portion formed by the second face 405 and the third face 406 of the first projection portion 400, and the bottom face 408 of the first projection portion 400 is rounded so as to come in sliding contact with the slope of the first projection passage portion 432 of the engagement body 420.

A corner portion formed by the first face 404 and the fourth face 407 of the first projection portion 400, and the bottom face 408 of the first projection portion 400 is rounded so as to come in sliding contact with the slope of the second projection passage portion 440 of the engagement body 420.

An end edge formed by the second face 405 and the third face 406 of the first projection portion 400 is rounded so as to come in sliding contact with the slope of the first slope portion 430 of the engagement body 420.

An end edge formed by the fourth face 407 and the third face 406 of the first projection portion 400 is rounded so as to come in sliding contact with the slope of the first slope portion 430 of the engagement body 420.

An end edge formed by the fifth face 412 and the sixth face 413 of the second projection portion 401 is rounded so as to come in sliding contact with the slope of the second slope portion 438 of the engagement body 420.

An end edge formed by the fifth face 412 and the eighth face 415 of the second projection portion 401 is rounded so as to come in sliding contact with the slope of the second slope portion 438 of the engagement body 420.

The first projection portion 400 is formed so as to project from the rotation shaft of the engagement body 420 outward by a length shorter than the length of the second projection portion 401.

On the other hand, the first block 426 of the engagement body 420 is formed so as to project from the rotation shaft of the engagement body 420 outward beyond the second block 428.

The second block 428 projects from the engagement body shaft portion 470 within such a range that the first projection portion 400 does not abut on the second slope portion 438 of the second block 428 when the operation lever 460 is pressed down at a movement time from the unlocked state to the locked state.

The first block 426 positioned on the lower side of the second block 428 projects from the engagement body shaft portion 470 such that the first block 426 abuts on the first slope portion 436 of the first block 426 positioned on the lower side of the second block 428 when the operation lever 460 is pressed down at a movement time from the unlocked state to the locked state.

The second block 428 projects from the engagement body shaft portion 470 such that the second projection portion 401 projecting beyond the first projection portion 400 abuts on the second slope portion 438 of the second block 428 when the operation lever 460 is pressed down at a movement time from the locked state to the unlocked state.

At the movement time from the unlocked state to the locked state, the first projection portion 400 does not come in contact with the second block 428 but comes in contact with the first block 426 projecting beyond the second block 428 toward the operation lever 460 side. That is, the first projection portion 400 is pressed to the first slope portion 430 on the upper face of the first block 426 when the operation lever 460 is pressed down in the case where the engagement body 420 is not in the first state (see FIGS. 39B(1) to 39C(3)). Thereby, the engagement body 420 moves to the first state.

Since the second projection portion 401 projects toward the engagement body 420 side beyond the first projection portion 400, the second projection portion 401 comes in contact with the second block 428 projecting on the operation lever 460 side to be shorter than the first block 426 at the movement time from the locked state to the unlocked state. That is, the second projection portion 401 is pushed to the second slope portion 438 on the upper face of the second block 428 when the operation lever 460 is pressed down at the movement time from the locked state to the unlocked state (see FIGS. 39G(1) to 39G(3)). Thereby, the engagement body 420 moves from the second state to the third state.

The first projection passage portion 432 is formed on a side portion of the first block 426, namely along a wall face on the far side.

A first projection edge portion 442 is formed on the first projection passage portion 432 so as to project to the first projection portion 400 passing through the first projection passage portion 432.

The second projection edge portion 444 is formed on the second projection passage portion 440 so as to project to the first projection portion 400 passing through the second projection passage portion 440.

The first projection passage portion 432 is provided at a lower position on the first slope portion 430 so as to connect to the first slope portion 430, the projection guidance portion 434 is provided so as to connect to a position on the first slope portion 430 separated from the region of the first slope portion 430 provided so as to connect to the first projection passage portion 432, and the projection engagement portion 436 is provided so as to connect subsequently to the projection guidance portion 434.

The projection engagement portion 436 is formed below the first block 426 on the base plate 22 side, namely, below a wall face of the lower portion of the first block 426.

The locked state is formed by engagement between the engagement body 420 and the first projection portion 400 obtained through such an operation that by pressing down the operation lever 460, the first projection portion 400 is pressed on the first slope portion 430 and the engagement body 420 takes the first state when the engagement body 420 is located at a position other than the first state and by further pressing down the operation lever 460, the first projection portion 400 passes through the first projection passage portion 432 of the engagement body 420 in the first state and the engagement body 420 moves to the second state.

The unlocked state is formed through such an operation that by pressing down the operation lever 460 in the locked state, the second projection portion 401 is pressed on the second slope portion 438 and the engagement body 420 takes the third state, and the first projection portion 400 passes through the second projection passage portion 440 of the engagement body 420 in the third state.

The first projection edge portion 442 formed on the first projection passage portion 432 projects to the first projection portion 400 when the first projection portion 400 passes through the first projection passage portion 432, and when the first projection portion 400 passes through the first projection passage portion 432 at a movement time from the unlocked state to the locked state, the first projection portion 400 is pushed to the first projection edge portion 442, so that the engagement body supporting portion 480 is swung (bent), and when the first projection portion 400 has passed through the first projection edge portion 442, the engagement body supporting portion 480 is restored.

Thereafter, when the first projection portion 400 rises due to the biasing force of the spring member 50, the first projection portion 400 is pushed to the projection guidance portion 434 of the lower portion of the first projection edge portion 442, so that the first projection portion 400 cannot go back through the first projection passage portion 432 due to the first projection edge portion 442.

The second projection edge portion 444 formed on the second projection passage portion 440 projects toward the first projection portion 400 when the first projection portion 400 passes through the second passage portion 440, and when the first projection portion 400 passes through the second projection passage portion 440 at a movement time from the locked state to the unlocked state, the first projection portion 400 is pushed to the second projection edge portion 444 so that the engagement body supporting portion 480 is swung (bent), and when the first projection portion 400 has passed through the second projection edge portion 444, the engagement body supporting portion 480 is restored.

Thereafter, even if the engagement body 420 is in the third state, the first projection portion 400 is pushed to the first slope portion 430 on the upper portion of the second projection edge portion 444 when the operation lever 460 is pressed down, so that the first projection portion 400 cannot go back through the second projection passage portion 440 due to the second projection edge portion 444.

Next, a binding device of a fifth embodiment which is a modified example of the first embodiment shown in FIG. 1 will be described.

The binding device 20 is particularly characterized by a mechanism for pressing a material to be bound X, but it will be described including a binding member supporting mechanism.

Figure 43:
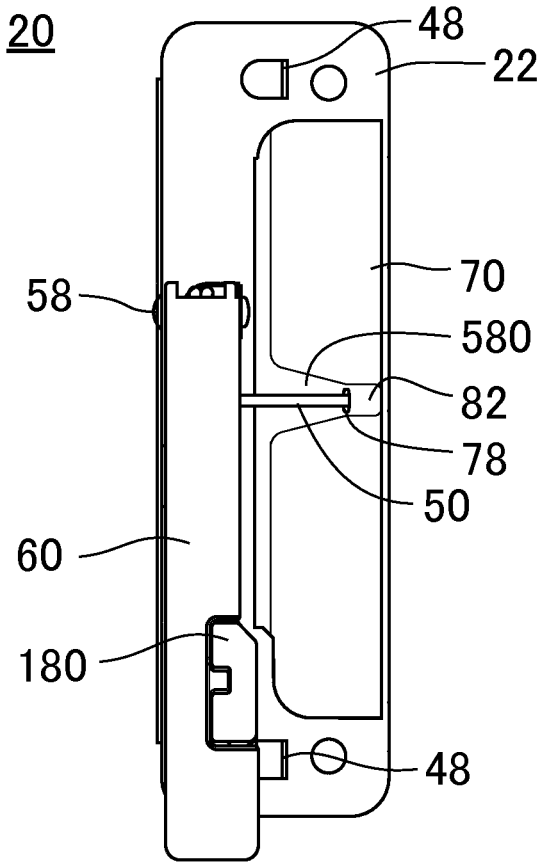
FIG. 43 is a plan diagrammatical view of a binding device according to a fifth embodiment which is a modified example of the binding device shown in FIG. 1.
Figure 44A:
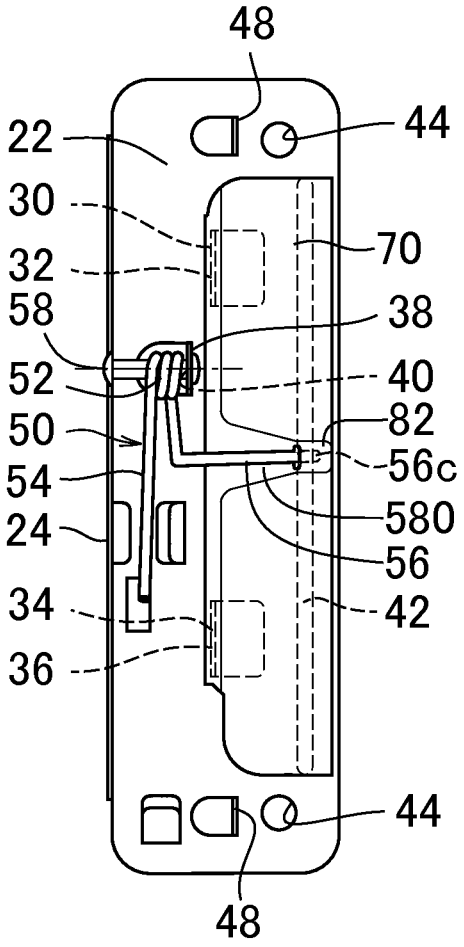
FIGS. 44A and 44B are views for explaining a position relationship of respective members of the binding device according to the fifth embodiment which is the modified example of the binding device shown in FIG. 1.
Figure 44B:
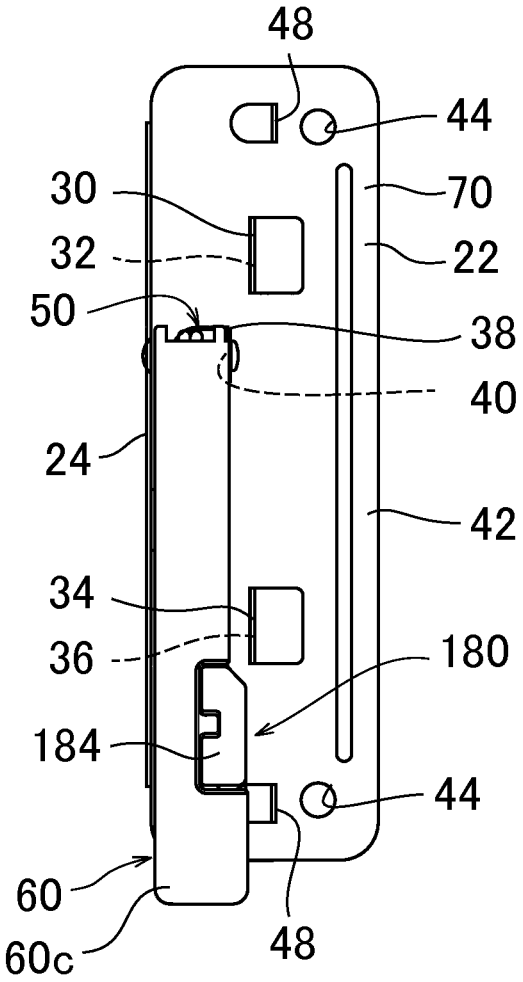
Figure 45:
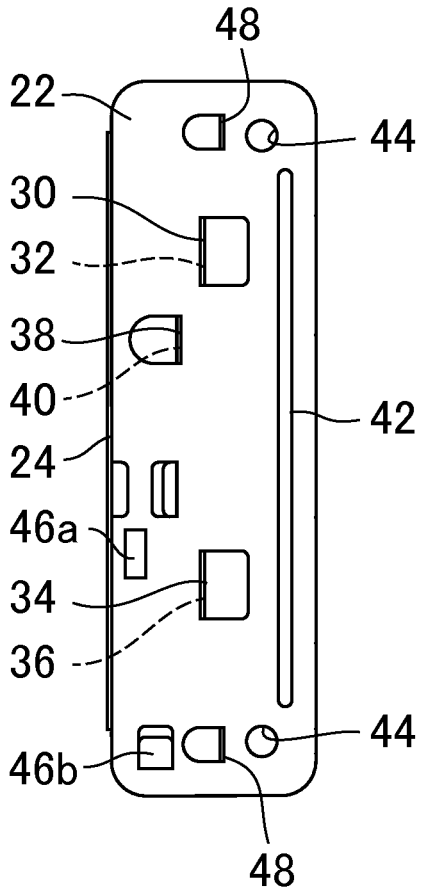
FIG. 45 is a plan view of a stand member of the binding device according to the fifth embodiment which is the modified example of the binding device shown in FIG. 1.
Figure 46:
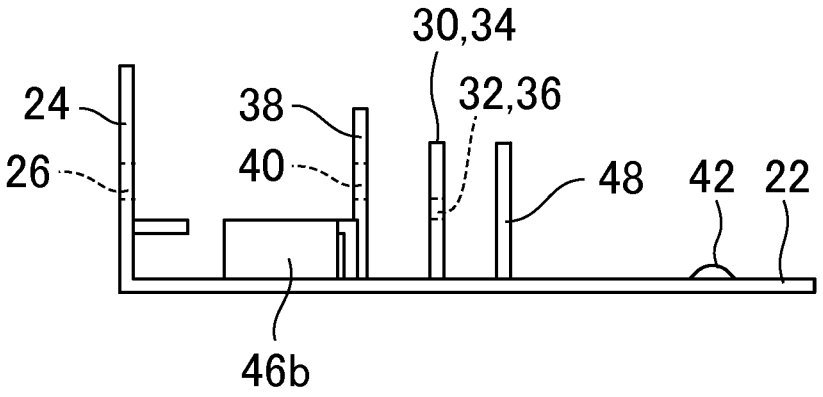
FIG. 46 is a front view of the stand member of the binding device according to the fifth embodiment which is the modified example of the binding device shown in FIG. 1.
Figure 47A:
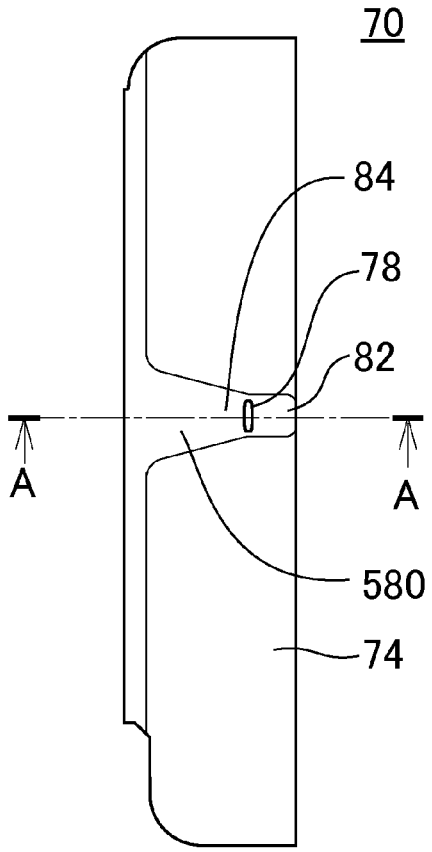
FIGS. 47A and 47B are plan diagrammatical views of a binding member of the binding device according to the fifth embodiment which is the modified example of the binding device shown in FIG. 1.
Figure 47B:
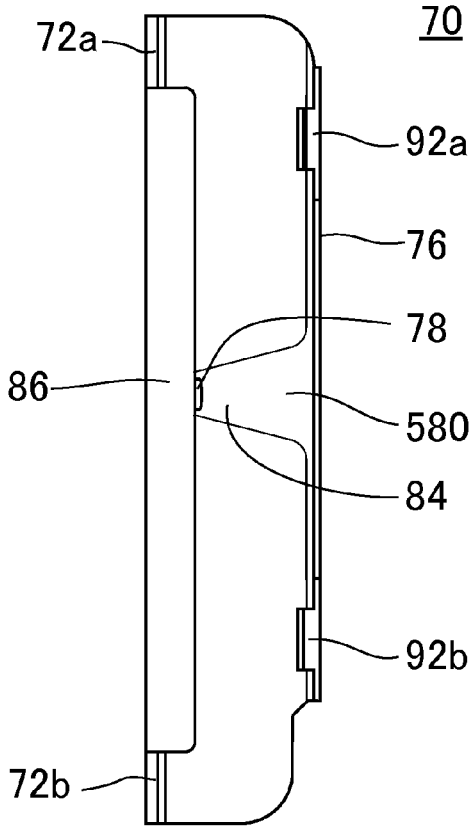
Figure 48A:
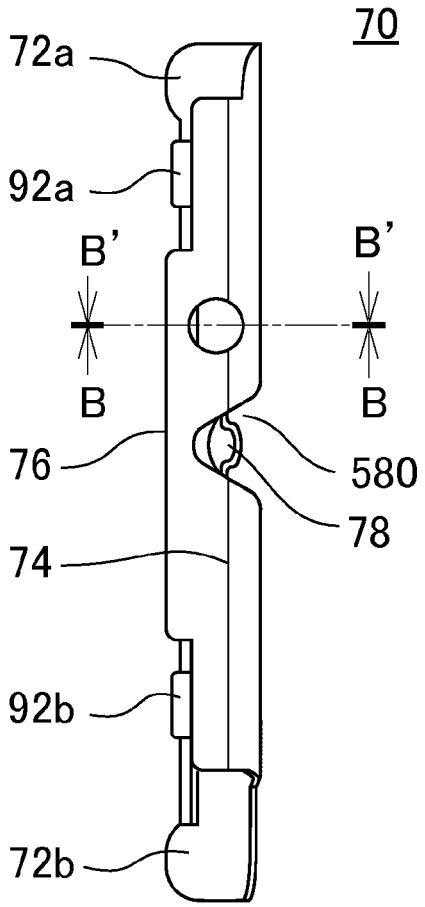
FIGS. 48A and 48B are side diagrammatical views of a binding member of the binding device according to the fifth embodiment which is the modified example of the binding device shown in FIG. 1.
Figure 48B:
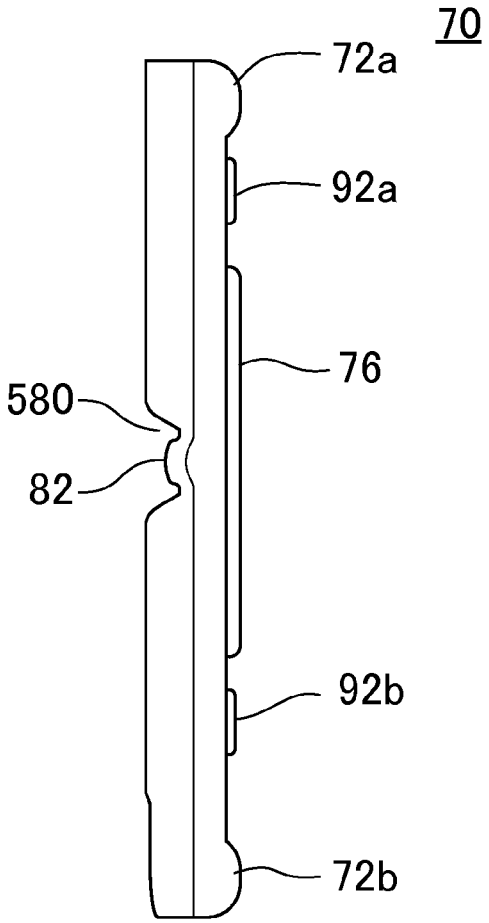
Figure 49A:
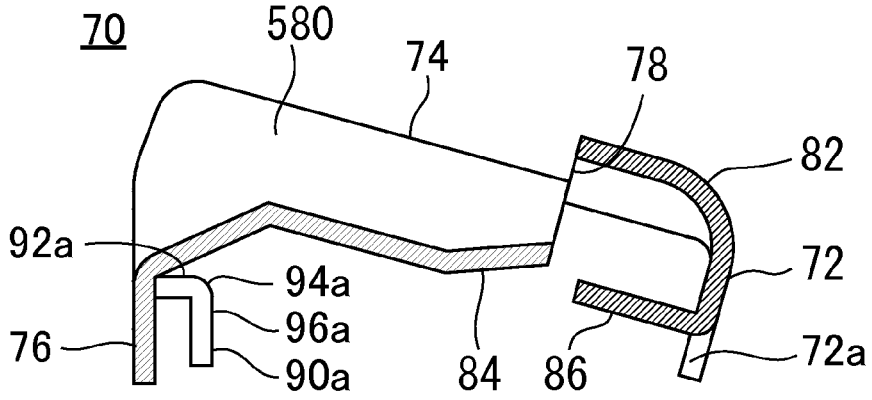
FIG. 49A is a sectional diagrammatical view of the binding member of the binding device shown in FIG. 47A, and FIGS. 49B and 49C are sectional diagrammatical views of the binding member of the binding device shown in FIG. 48A.
Figure 49B:
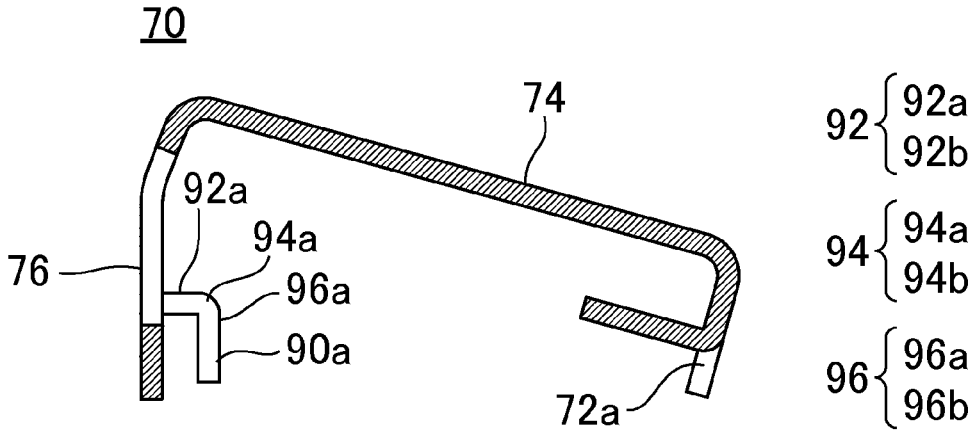
Figure 49C:
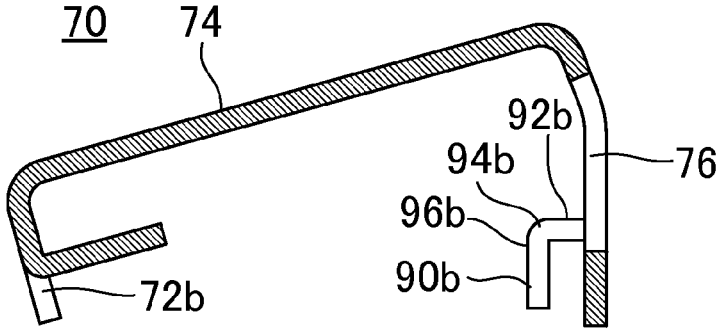
Figure 51A:
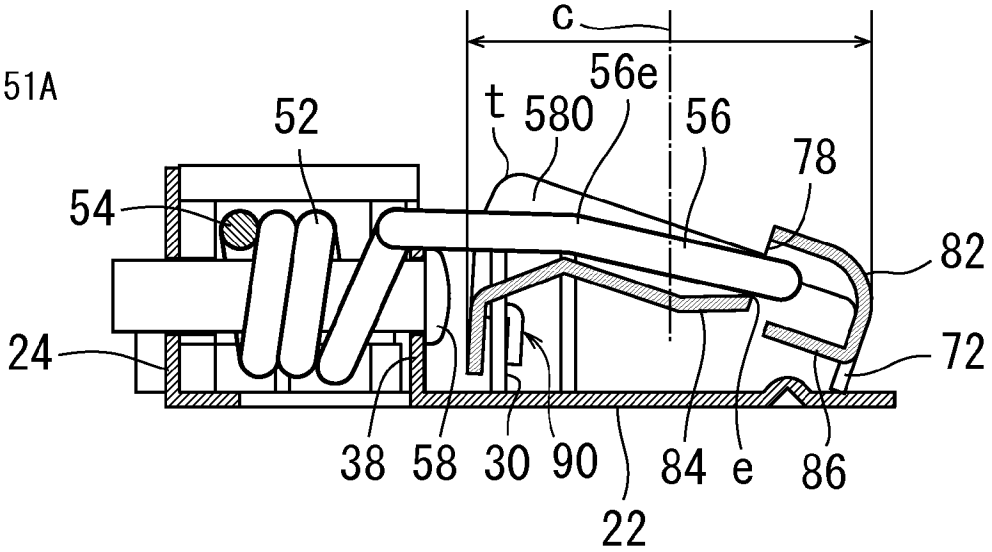
FIGS. 51A and 51B are sectional diagrammatical views for explaining an operation state of the biasing member, the binding member and the operation member of the binding device according to the fifth embodiment.
Figure 51B:
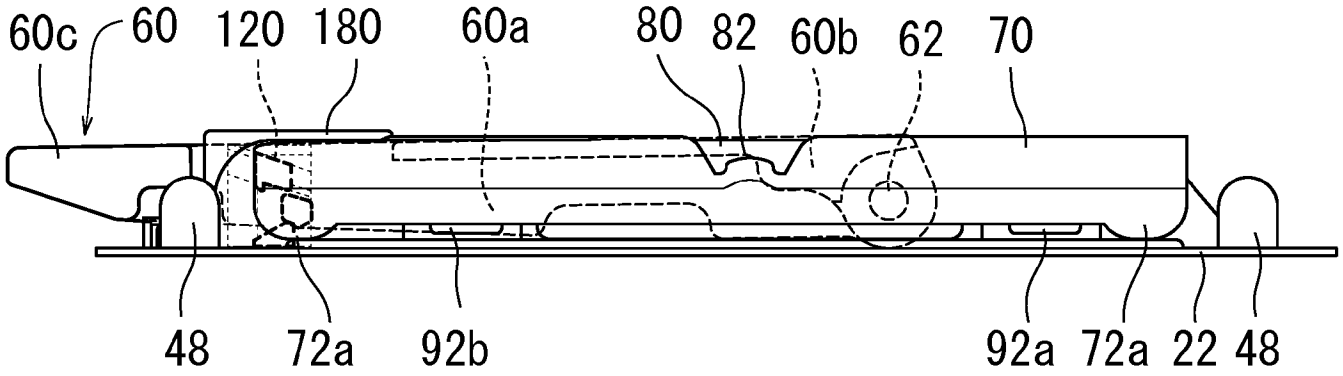
Figure 52A:
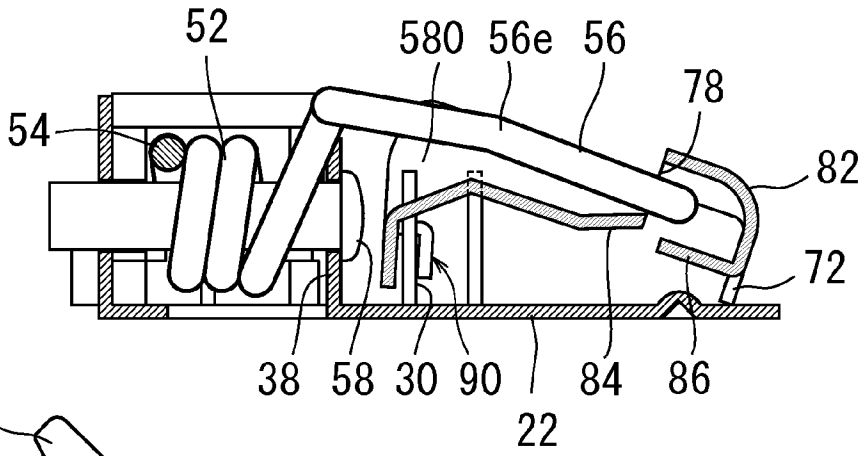
FIGS. 52A and 52B are sectional diagrammatical views for explaining an operation state of the biasing member, the binding member and the operation member of the binding device according to the fifth embodiment.
Figure 52B:
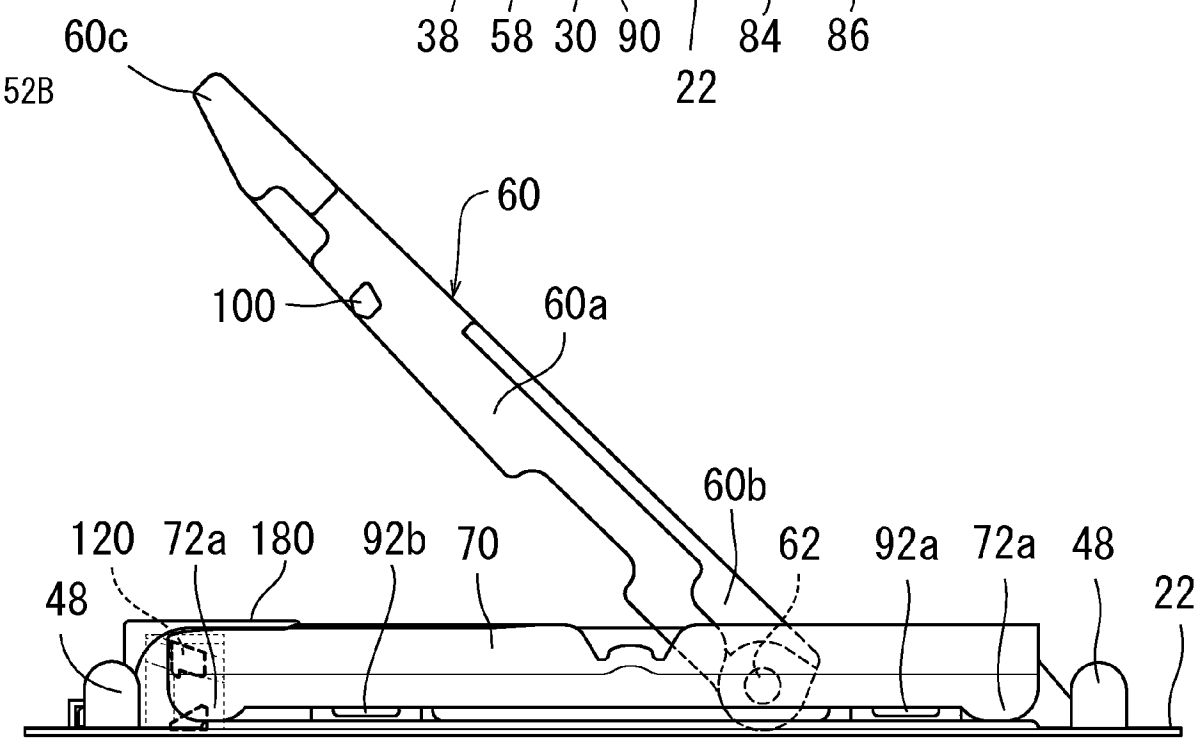
Figures 53A, 53B:
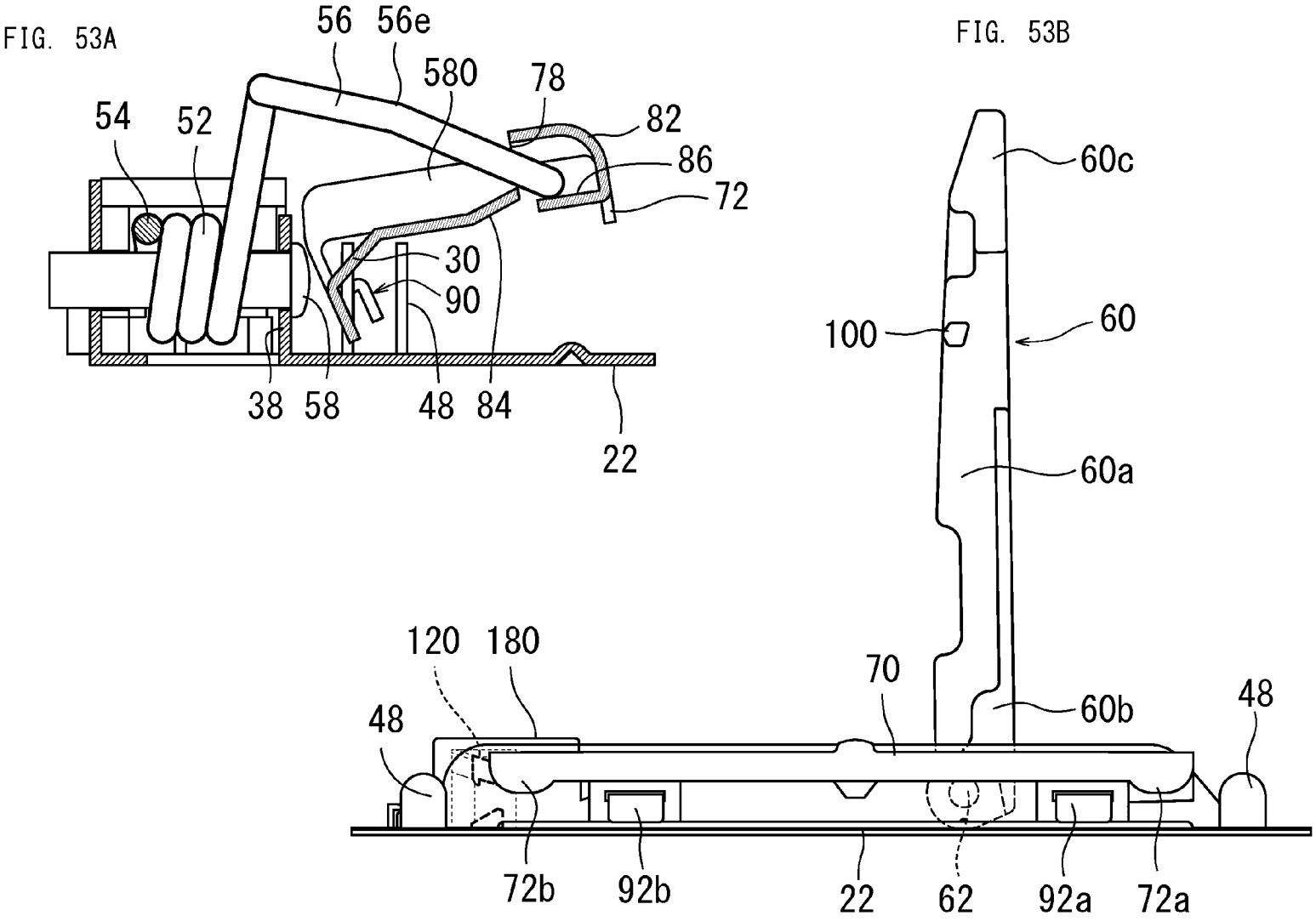
FIGS. 53A and 53B are sectional diagrammatical views for explaining an operation state of the biasing member, the binding member and the operation member of the binding device according to the fifth embodiment.
Figure 54A:
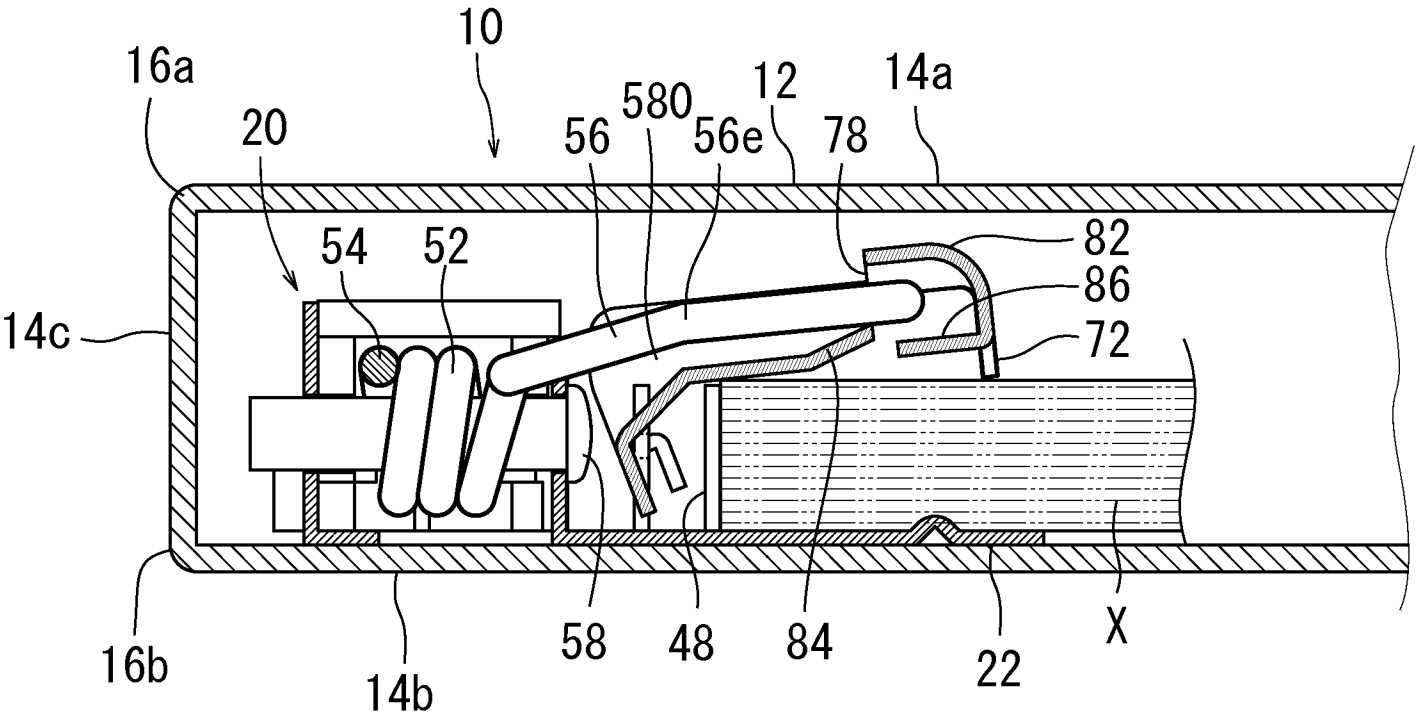
FIG. 54A is a sectional diagrammatical view of a file attached with a binding device in a state where a thick material to be bound has been bound and locked.
Figure 54B:
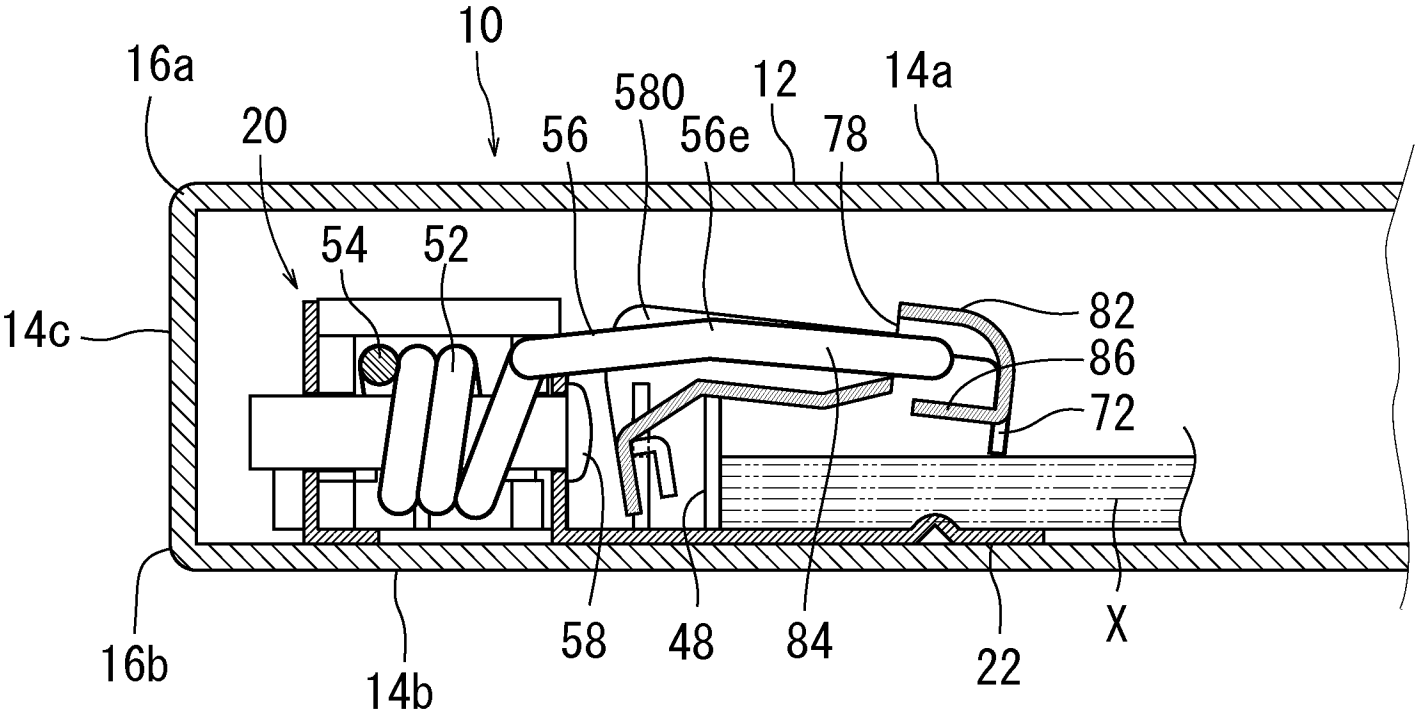
FIG. 54B is a sectional diagrammatical view of a file attached with a binding device in a state where a thin material to be bound has been bound and locked.
Figure 55:
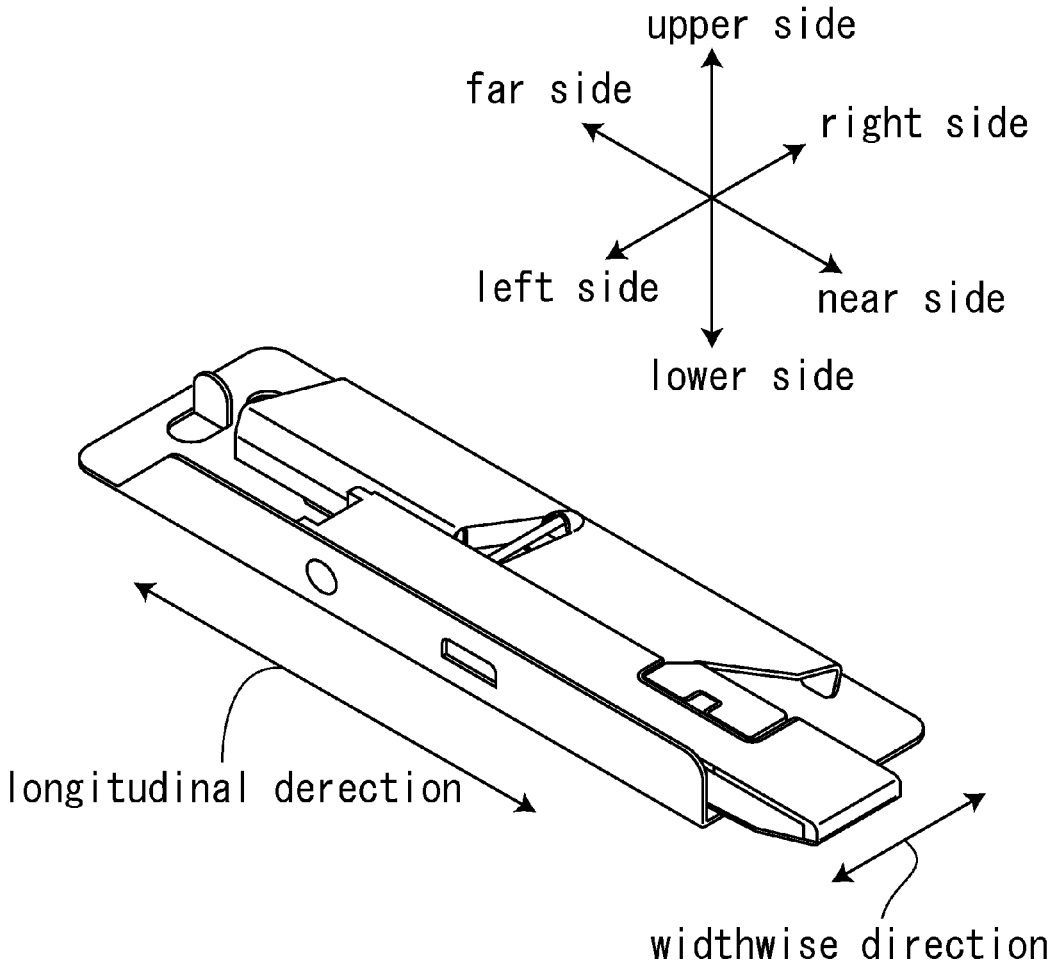
FIG. 55 is a view for explaining directions about a binding device for explanation in the specification of the present application.

FIG. 43 is a plan diagrammatical view of a binding device according to a fifth embodiment which is a modified example of the binding device shown in FIG. 1. FIGS. 44A and 44B are views for explaining a position relationship of respective members of the binding device according to the fifth embodiment which is the modified example of the binding device shown in FIG. 1. FIG. 45 is a plan view of a stand member of the binding device according to the fifth embodiment which is the modified example of the binding device shown in FIG. 1. FIG. 46 is a front view of the stand member of the binding device according to the fifth embodiment which is the modified example of the binding device shown in FIG. 1. FIGS. 47A and 47B are plan diagrammatical views of a binding member of the binding device according to the fifth embodiment which is the modified example of the binding device shown in FIG. 1. FIGS. 48A and 48B are side diagrammatical views of a binding member of the binding device according to the fifth embodiment which is the modified example of the binding device shown in FIG. 1. FIG. 49A is a sectional diagrammatical view of the binding member of the binding device shown in FIG. 47A, and FIGS. 49B and 49C are sectional diagrammatical views of the binding member of the binding device shown in FIG. 48A. FIGS. 50 A to 50C are sectional diagrammatical views for explaining how to assemble the stand member and the binding member of the binding device according to the fifth embodiment which is the modified example of the binding device shown in FIG. 1. FIGS. 51A and 51B are sectional diagrammatical views for explaining an operation state of the biasing member, the binding member and the operation member of the binding device according to the fifth embodiment. FIGS. 52A and 52B are sectional diagrammatical views for explaining an operation state of the biasing member, the binding member and the operation member of the binding device according to the fifth embodiment. FIGS. 53A and 53B are sectional diagrammatical views for explaining an operation state of the biasing member, the binding member and the operation member of the binding device according to the fifth embodiment. FIG. 54A is a sectional diagrammatical view of a file attached with a binding device in a state where a thick material to be bound has been bound and locked. FIG. 54B is a sectional diagrammatical view of a file attached with a binding device in a state where a thin material to be bound has been bound and locked.

In general, a binding device 20 for binding a material to be bound X such as papers is attached to an inner face of a cover body 12 of a file 10.

The cover body 12 is provided with a front cover 14*a*, a back cover 14*b*, and a spine cover 14*c*, and is provided with a folded portion 16*a* formed between the front cover 14*a* and the spine cover 14*c* and a folded portion 16*b* formed between the back cover 14*b* and the spine cover 14*c*.

The binding device 20 is provided with a base plate 22 serving as a plate-shaped base member, and a binding member 70 having a pressing portion for pressing and holding the material to be bound X by a biasing force of a spring member 50 serving as a biasing member on the base member.

The binding device 20 is provided with an operation lever 60 which is an operation member attached to the base member so as to be movable (openable and closable) to a holding state (locked state) where the binding member 70 presses the material to be bound X and to an open state (unlocked state) where the binding member 70 separates from the material to be bound X, and a locking means for putting the operation lever 60 in the locked state Further, the binding device 20 is provided with the spring member 50 serving as the biasing member mounted on the base member, coupled to the operation lever 60 and coupled to the binding member 70, and biasing the binding member 70 in a direction of pressing the material to be bound X.

The base plate 22 is provided with binding member supporting portions (a first binding member supporting portion 30 and a second binding member supporting portion 34) in the vicinity of a region where the operation lever 60 is mounted.

The binding member 70 is provided with an engagement portion 90 for swinging so as to open and close between the hold state (locked state) of pressing the material to be bound X and the open state (unlocked state) of separating from the material to be bound X.

The engagement portion 90 constitutes a binding member supporting mechanism for pivotally attaching the binding member 70 to the base plate 22.

The spring member 50 serving as the biasing member is coupled to the binding member 70 such that one portion (a spring first end portion 56) thereof extends toward a pressing portion 72 of the binding member 70 to operate the binding member 70 to pivot the same about the engagement portion 90 to the hold state of pressing the material to be bound X and to the open state of separating from the material to be bound X.

The spring member 50 and the binding member 70 constitutes a material-to-be-bound pressing mechanism for pressing the material to be bound X.

The base plate 22 which is the plate-shaped main body constituting the base member formed of a thin plate made of metal is provided with a bearing portion constituting an operation member attaching portion at a linear longitudinal end edge at one end portion (left end portion) of the base plate 22 in a widthwise direction thereof, and the bearing portion is composed of a bearing plate 24 having an erected face portion erected to the base plate 22 and a bearing plate 38 having a face parallel to a face of the bearing plate 24, as shown in FIG. 5 to FIG. 7.

The bearing plate 24 is formed integrally with the base plate 22, and the bearing plate 38 is formed to erect from the bearing plate 22.

The bearing plate 24 is formed so as to extend continuously from the near side end edge of the base plate 22 to the far side end edge thereof in the longitudinal direction.

A circular pivot shaft fixing through-hole 26 constituting an operation member attaching portion is formed on one end side (the far side) of the bearing plate 24 in the longitudinal direction.

Regarding the pivot shaft fixing through-hole 26, a periphery of the pivot shaft fixing through-hole 26 on the bearing plate 24 is formed such that the far side thereof projects outward (to a side opposite to a face to which the operation lever 60 is attached) and the near side thereof projects inward (to the side to which the operation lever 60 is attached) in such a manner that the erected face portion of the bearing plate 24 facing the operation lever 60 and an axial direction of a shaft 58 fixing the operation lever 60 to the bearing plate 24 intersect obliquely, so that the operation lever 60 and the erected face portion of the bearing plate 24 are formed to be inclined to each other.

The first binding member supporting portion 30 is arranged in order to support the binding member 70 at a farther side beyond the far side end of the operation lever 60.

Further, a bearing plate 38 having a face parallel to the face of the bearing plate 24 is formed between these first binding member supporting portion 30 and second binding member supporting portion 34 on a side nearer the bearing plate 24 than a line connecting a holding hole 32 of the first binding member supporting portion 30 and a holding hole 36 of the second binding member supporting portion 34 and on a side spaced from the bearing plate 24 by a proper distance. The bearing plate 38 is formed by forming a U-shaped cut in the base plate 22 and raising this portion, and is wholly formed to obliquely intersect the erected face portion of the bearing plate 24 serving as the bearing portion of the operation lever 60. That is, formation is made such that the axial direction of the shaft 58 for fixing the operation lever 60 to the bearing plate 24 obliquely intersects the erected face portion of the bearing plate 24 serving as the bearing portion of the operation lever 60 and becomes parallel to the periphery of the pivot shaft fixing through-hole 26.

A circular through-hole 40 is formed in the bearing plate 38, and the pivot shaft fixing through-hole 26 of the bearing plate 24 and the through-hole 40 of the bearing plate 38 are arranged so as to face each other. That is, the line connecting the holding hole 32 of the first binding member supporting portion 30 and the holding hole 36 of the second binding member supporting portion 34 and the line connecting the pivot shaft fixing through-hole 26 of the bearing plate 24 and the through-hole 40 of the bearing plate 38 are formed so as to intersect each other obliquely.

At least two binding member supporting portions (the first binding member supporting portion 30 and the second binding member supporting portion 34) are provided in a projecting fashion with a proper distance from the bearing plate 24 and with an interval therebetween in the longitudinal direction of the operation member 60 serving as an operation member. The first binding member supporting portion 30 is formed on the far side of a formation portion of the pivot shaft fixing through-hole 26 on the bearing plate 24 such that a principal face of the first binding member supporting portion 30 supporting the binding member 70 becomes parallel to the principal face of the bearing plate 24. The holding hole 32 which is rectangular in a front view is formed in the first binding member supporting portion 30.

Further another second binding member supporting portion 34 having a face parallel to the principal face of the first binding member supporting portion 30 is formed in order to support the binding member 70 on a nearer side than the far side of the operation lever 60. The holding hole 36 which is rectangular in a front view is formed in the second binding member supporting portion 34.

The first binding member supporting portion 30 and the second binding member supporting portion 34 are formed by forming a U-shaped cut in the base plate 22 and raising this portion.

A pair of holding hole 32 and holding hole 36 positioned in front and behind are rectangular in a front view, extend in the longitudinal direction of the base plate 22 and are formed at the same height from the upper face of the base plate 22.

These first binding member supporting portion 30 and second binding member supporting portion 34 are plate-shaped bodies arranged in parallel in the longitudinal direction of the binding member 70. Arrangement is performed such that a line connecting the principal face of the first binding member supporting portion 30 and the principal face of the second binding member supporting portion 34 become parallel to the principal face of the bearing plate 24 positioned on the side of the base plate 22, and faces of a plurality of binding member supporting portions (the first binding member supporting portion 30 and the second binding member supporting portion 34) are arranged in parallel to a plane spreading in the longitudinal direction of the binding member 70 toward the side of the binding member 70.

The binding member 70 has a pressing portion 72 for pressing the material to be bound X, a bridging portion 74 provided to connect to the pressing portion 72, and a standing portion 76 formed on an opposite side of the bridging portion 74 to the pressing portion 72.

[Binding Member Supporting Mechanism]

The binding member supporting mechanism for pivotally attaching the binding member 70 to the base plate 22 is composed of the engagement portion 90 provided on the standing portion 76 so as to project toward the pressing portion 72 side, the first binding member supporting portion 30 and the second binding member supporting portion 34.

As the engagement portion 90 of the binding member 70, at least two portions are formed on the standing portion 76 which is an end edge opposite to the pressing portion 72 for pressing the material to be bound X so as to be spaced from each other in the longitudinal direction.

The engagement portions 90 are formed with supporting projection portions 92 so as to be caused to engage with the holding hole 32 of the first binding member supporting portion 30 and the holding hole 36 of the second binding member supporting portion 34, and be capable of swinging the binding member 70.

The supporting projection portion 92 is an approximately L-shaped portion in section or an approximately J-shaped portion in section provided so as to project from the standing portion 76 which is the end edge of the binding member 70 opposite to the pressing portion 72. The supporting projection portion 92 is provided with a plate-shaped supporting base portion 94 intersecting the standing portion 76 perpendicularly and a plate-shaped hanging portion 96 intersecting the supporting base portion 94 perpendicularly and parallel to the standing portion 76.

The holding hole 32 and the holding hole 36 are positioned at the same height spaced from the principal face of the base plate 22 by the same distance, and all the supporting base portions 94 of a plurality of engagement portions 90 engaged with the holding hole 32 and the holding hole 36 to be supported are constituted so as to be positioned at the same height spaced from the principal face of the base plate 22 by the same distance.

Further, the supporting projection portions 92 are held in a lower portion of a region of the end edge side of the binding member 70 facing the pressing portion 72 for pressing the material to be bound X such that the supporting base portions 94 are caused to engage with lower portions of the holding hole 32 and the holding hole 36 and can swing the binding member 70

The supporting projection portions 92 hang down from the lower portions of the holding hole 32 and the holding hole 36 downward such that the hanging portions 96 which are distal end sides extending from the regions (the supporting base portions 94) caused to engage with the lower portions of the holding hole 32 and the holding hole 36 do not get out of the holding hole 32 and the holding hole 36 at a swinging time of the binding member 70.

The supporting projection portions 92 are provided so as to project toward the side of the pressing portion 72 with a space from the end edge facing the pressing portion 72 of the binding member 70 such that they can be inserted from their distal ends into the holes of the holding hole 32 and the holding hole 36 in a state where the first binding member supporting portion 30 and the second binding member supporting portion 34 have been provided so as to project toward the arrangement side of the binding member 70 in the base plate 22 serving as the base member.

The standing portions 76 of the binding member 70 are formed with the supporting projection portions 92 at lower portions of the left and right ends thereof and are cut in a region formed with the supporting projection portions 92 such that they do not constitute blocks when the supporting projection portions 92 are inserted into and caused to engage with the holding hole 32 of the first binding member supporting portion 30 and the holding hole 36 of the second binding member supporting portion 34. Since spaces obtained by forming a cut between the lower end of the bridging portion 74 and the supporting projection portions 92 are provided, the supporting projection portions 92 can be attached to the first binding member supporting portion 30 and the second binding member supporting portion 34 without abutting on regions erected on the principal face of the base plate 22 in a projecting fashion (see FIG. 44A).

In this embodiment, regarding the supporting projection portions 92, a pair of supporting portions 92 positioned in front and behind are arranged in parallel along the longitudinal direction of the binding member 70 with a space corresponding to the space between the first binding member supporting portion 30 and the second binding member supporting portion 34. The supporting members 92 are plate-shaped bodies where a first supporting projection portion 92*a* on the near side and a second supporting projection portion 92*b* on the far side have the same shape.

The first supporting projection portion 92*a* and the second supporting projection portion 92*b* are both bent from the end edge of the biding member 70 toward the pressing portion 72 to be formed with the supporting base portions 94 and are bent from the supporting base portions 94 downward to be formed with the hanging portions 96. A shape formed by the standing portion 76, the first supporting projection portion 92*a* and the second supporting projection 92*b* is an approximately h-shaped in a front view.

The first supporting projection portion 92*a* is provided with a plate-shaped first supporting base portion 94*a* intersecting the standing portion 76 perpendicularly and a plate-shaped first handing portion 96*a* intersecting the first supporting base portion 94*a* perpendicularly and parallel to the standing portion 76

The second supporting projection portion 92*b* is provided with a plate-shaped second supporting base portion 94*b* intersecting the standing portion 76 perpendicularly and a plate-shaped second hanging portion 96*b* intersecting the second supporting base portion 94*b* perpendicularly and parallel to the standing portion 76.

The first supporting projection portion 92*a* and the second supporting projection portion 92*b* are projected from the standing portion 76 by the same length. The first supporting projection portion 92*a* and the second supporting projection portion 92*b* are formed so as to project in a horizontal direction when the binding member 70 is attached to the first binding member supporting portion 30 and the second binding member supporting portion 34. Therefore, the first supporting projection portion 92*a* and the second supporting projection portion 92*b* are positioned at the same height spaced from the principal face of the base plate 22 by the same distance when they are attached to the first binding member supporting portion 30 and the second binding member supporting portion 34.

The first supporting projection portion 92*a* and the second supporting projection portion 92*b* are formed such that the first supporting base portion 94*a* and the second supporting base portion 94*b* has the same height, and the holding hole 32 of the first binding member supporting portion 30 and the holding hole 36 of the second binding member supporting portion 34 caused to engage with the first supporting projection portion 92*a* and the second supporting projection portion 92*b* are formed to have the same height.

Thus, the binding member 70 attached to the first binding member supporting portion 30 and the second binding member supporting portion 34 is configured such that a grounding portion 72*a* of the pressing portion 72 on the far side and a grounding portion 72*b* on the near side are parallel to the base plate 22 so that they simultaneously press the material to be bound X at the same pressing force.

Further, the first supporting projection portion 92*a* and the second supporting projection portion 92*b* are formed such that the first supporting projection portion 92*a* and the second supporting projection portion 92*b* can be inserted from the distal ends of the respective hanging portions 96 into the respective holes of the holding hole 32 and the holding hole 36 in a state where the binding member supporting portions (the first binding member supporting portion 30 and the second binding member supporting portion 34) have been provided on the base plate 22 serving as the base member in a projecting fashion.

Figure 50A:
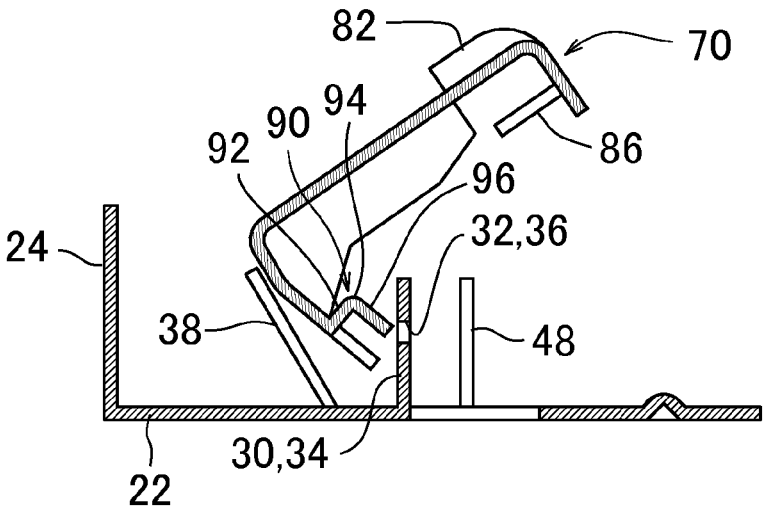
FIGS. 50A to 50C are sectional diagrammatical views for explaining how to assemble the stand member and the binding member of the binding device according to the fifth embodiment which is the modified example of the binding device shown in FIG. 1.

In this embodiment, since spaces between the bearing plate 38, and the first binding member supporting portion 30 and the second binding member supporting portion 34 are made narrow so as to arrange the binding member 70 so as to be nearer the operation lever 60 side, the bearing plate 38 is slightly fallen toward the first binding member supporting portion 30 side so as to be spaced from the first binding member supporting portion 30 and the second binding member supporting portion 34 before the first supporting projection portion 92*a* and the second supporting projection portion 92*b* are inserted into the holding hole 32 and the holding hole 36, respectively (see FIG. 50A).

The first binding member supporting portion 30 and the second binding member supporting portion 34 are erected from the base plate 22 toward the arrangement side of the binding member 70 to be provided to be perpendicular to the principal face of the base plate 22 in a standing fashion (see FIG. 50A).

Figure 50B:
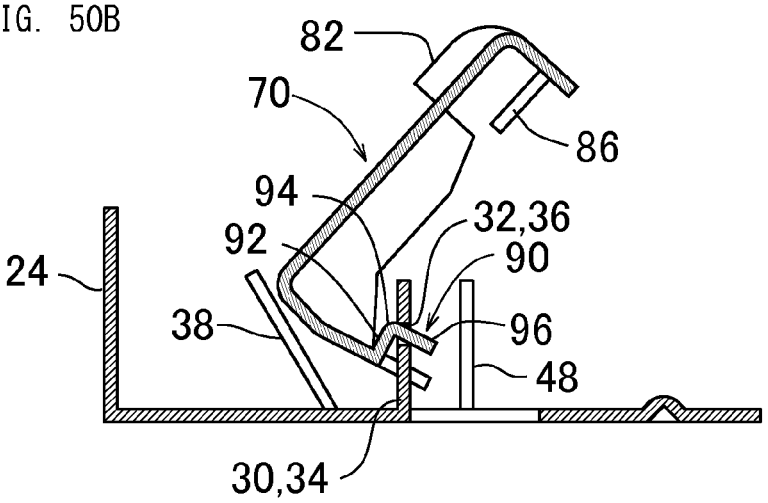

The first supporting projection portion 92*a* and the second supporting projection portion 92*b* are respectively inserted into the holding hole 32 and the holding hole 36 by allocating the lower end of the first hanging portion 96*a* which is the distal end of the first supporting projection portion 92*a* to a hole edge of the holding hole 32 of the first binding member supporting portion 30 and allocating the lower end of the second hanging portion 96*b* which is the distal end of the second supporting projection portion 92*b* to a hole edge of the holding hole 36 of the second binding member supporting portion 34 and pulling the pressing portion 72 in a direction separating from the first binding member supporting portion 30 and the holding hole 32 (a direction of separating from the bearing plate 24) (see FIG. 50B).

Figure 50C:
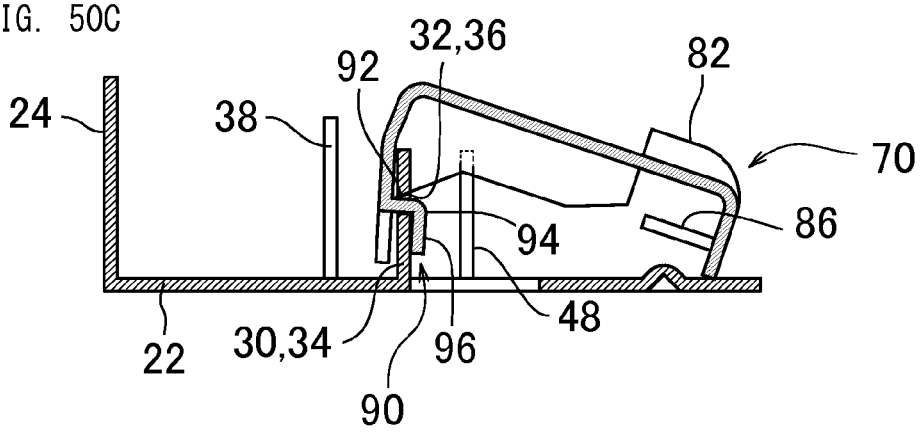

The bearing plate 38 which has been slightly inclined is caused to stand up to be perpendicular to the principal face of the base plate 22 after the binding member 70 has been coupled to the first binding member supporting portion 30 and the second binding member supporting portion 34 (see FIG. 50C).

Further, a ridge 42 is formed on the other end side (the right end portion) of the base plate 22 in the widthwise direction. The ridge 42 is formed in parallel with a proper distance in the widthwise direction of the base plate 22. A pair of base plate-fixing through-holes 44 for attaching the binding device 20 to a file or the like are formed on both sides of the base plate 22 in the longitudinal direction on the far side and the near side, so that the binding device 20 is attached to the file or the like by inserting and fitting rivets into the base plate-fixing through-holes 44.

[Material-to-be-Bound Pressing Mechanism]

A shaft 58 is inserted into the pivot shaft-fixing through-hole 26 of the bearing plate 24 and the through-hole 40 of the bearing plate 38, and the spring member 50 composed of a torsion coil spring and the operation lever 60 serving as the operation member are attached to the shaft 58.

The operation lever 60 is provided with a lock mechanism for obtaining a locked state on the base plate 22.

The lock mechanism is provided with an engagement body 120 provided on the side of the operation lever 60 (the side opposite to the bearing plate 24), an engagement body supporting portion 180 attached with the engagement body 120, and a projection portion 100 provided on the operation lever 60.

The spring member 50 serving as the biasing member is configured such that one portion thereof extends from the side of the operation lever 60 serving as the operation member toward the pressing portion 72 of the binding member 70 to operate the pressing portion 72 of the binding member 70 so as to move the same to a hold state of pressing the material to be bound X and to an open state of separating from the material to be bound X about the side of the operation lever 60 serving as the operation member of the binding member 70.

The binding member 70 has the pressing portion 72 having a widthwise direction extending from the side of the operation lever 60 serving as the operation member and has the pressing portion 72 on approximately the same straight line as a straight line SL1 including an end edge of the binding member 70 on the opposite side to the operation lever 60 serving as the operation member in a plan view of the binding member 70, and the one portion of the spring member 50 serving as the biasing member extends in the widthwise direction of the binding member 70 to be positioned in the vicinity of the straight line SL1 including the end edge of the binding member 70 and be positioned in the vicinity of the central portion m of the binding member 70 in the longitudinal direction.

The spring member 50 has a winding portion 52 wound on an outer periphery of the shaft 58, a first end portion 56 extending from one end (right end portion) of the winding portion 52 to the side of the binding member 70, and a second end portion 54 extending from the other end (left end portion) of the winding portion 52 on the side of the bearing plate 24 to the side of the operation lever 60 straightly.

The shaft 58 and the winding portion 52 of the spring member 50 are bridged between the bearing plate 24 and the bearing plate 38 so as to intersect the bearing plate 24 obliquely.

The one portion (the spring first end portion 56) of the spring member 50 serving as the biasing member is formed so as to move in the up direction, namely, in a direction where the bearing plate 24 stands up, when the operation lever 60 serving as the operation member is operated such that the binding member 70 moves from the holding state of pressing the material to be bound X to the open state of separating from the material to be bound X in an opening and closing manner.

The spring member 50 is configured such that the one portion (the spring the first end portion 56) extends toward the pressing portion 72 of the binding member 70 so that the spring member 50 pivots the binding member 70 about the engagement portion 90 in order to open and close the binding member 70 to the hold state of pressing the material to be bound X and to the open state of separating from the material to be bound X.

The spring second end portion 54 of the spring member 50 is formed such that it extends straightly from the upper end on the rear side to the near side on the side of the bearing plate 24 of the winding portion 52, and when the distal end of the spring second end portion 54 is not subjected to an external force, the distal end extends obliquely upwardly to the near side.

The spring first end portion 56 is provided with a spring standing portion 56*a* extending from the lower end of the spring first end portion 56 on the near side on the bearing plate 38 side of the winding portion 52 to the opposite side to the bearing plate 24, a spring bridging portion 56*b* extends from an upper end of the spring standing portion 56*a* extending upward obliquely downward such that when the spring first end portion 56 is not subjected to an external force, the spring bridging portion 56*b* forms an approximately L shape, and a spring catching portion 56*c* is formed on the side of a free end of the spring bridging portion 56*b*. Further, the spring first end portion 56 is formed with a spring bent portion 56*e* obtained by folding the spring bridging portion 56*b* by only a slight angle.

The spring first end portion 56 which is not subjected an external force and the spring second end portion 54 (particularly, the spring standing portion 56*a*) which is not subjected to an external force are formed in an approximately V shape extending in directions where they separate from each other to expand from the winding portion 52 to the distal ends thereof.

The shaft 58 for fixing the operation lever 60 and the spring member 50 to the base plate 22 is disposed in a section from the central portion m of the binding member 70 in the longitudinal direction to the far side end edge, and the shaft 58 is disposed to be closer to the central portion m, namely, in the vicinity of a first biasing member receiving portion 80, than the far side end edge of the binding member 70 in the longitudinal direction. The central portion m of the binding member 70 in the longitudinal direction means the center of a line connecting the far side end edge and the near side end edge of the binding member 70.

Further, the spring member 50 has a corner portion 56*d* bent approximately at a right angle in the first end portion 56 extending from the winding portion 52 to the binding member 70. When the binding device 20 is put in the hold state, the spring standing portion 56*a* extending from the winding portion 52 of the spring member 50 to the corner portion 56*d* is parallel to the longitudinal direction of the binding device 20, and the spring bridging portion 56*b* from the spring catching portion 56*c* which is the distal end of the spring 50 to the corner portion 56*d* is parallel to the widthwise direction of the binding device 20.

A length L1 from the corner portion 56*d* to the center of the winding member 52 (namely, a length approximately equal to the length of the spring standing portion 56*a*) is approximately equal to a length L2 between a straight line SL2 extending in the extension direction of the shaft 58 and the central line of the binding member 70 in the longitudinal direction (see FIG. 12B).

The central line of the binding member 70 in the longitudinal direction indicates a straight line SL4 running through the central portion m (the central portion of the line connecting the far side end edge and the near side end edge of the binding member 70) in the widthwise direction of the binding member 70.

The base plate 22 has the bearing plate 24 serving as a shaft fixing portion pivotally supporting one end of the shaft 58 and the bearing plate 38 formed at a position slightly shifted toward the far side beyond the pivot shaft fixing through-hole 26 of the bearing plate 24 and serving as the shaft fixing portion pivotally supporting the other end of the shaft 58.

Regarding the shaft 58 bridged between the pivot shaft fixing through-hole 26 of the bearing plate 24 and the through-hole 40 of the bearing plate 38 to be fixed, a portion thereof on the side of the bearing plate 38 which is the binding member 70 side thereof is fixed to the through-hole 40 of the bearing plate 38 at a position rotated on a horizontal plane about the bearing plate 24 side of the shaft 58 in a direction of separating from the free end of the operation lever 60.

The shaft 58 fixing the operation lever 60 and the spring member 50 to the base plate 22 can change the slope of the straight line SL2 extending in the extension direction of the shaft 58 to the straight line on the center axis SL3 of the winding portion 52 of the spring member 50 between the hold state and the open state (see FIGS. 12A(1) and 12A(2)).

That is, an inner diameter of the winding portion 52 is provided with a slight clearance between the same and an outer diameter of the shaft 58. Further, a length from the bearing plate 24 of the base plate 22 to the bearing plate 38 is set to be sufficient to the width of the winding portion 52 (a width of the winding portion 52 in the widthwise direction of the binding device 20) in the center axis SL3 direction of the winding portion 52. With such a configuration, the winding portion 52 can be inclined to the extension direction of the shaft 58.

In the spring member 50, the winding portion 52 is mounted about the shaft 58 between the bearing plate 24 serving as the shaft fixing portion and the bearing plate 38 so as to be approximately parallel to the base plate 22, and the spring second end portion 54 which is not subjected to the external force extends in the longitudinal direction of the base plate 22 along the inside of the bearing plate 24 and is fixed to the operation lever 60 approximately in parallel to the longitudinal direction of the operation lever 60.

That is, the spring second end portion 54 which is not subjected to the external force is fixed to the operation lever 60 in a direction of pivoting the operation lever 60 so as to perform unlocking from the locked state in order to transition from the hold state of pressing the material to be bound X and to the open state of separating from the material to be bound X, namely, along the pivoting track face of the operation lever 60. Therefore, the spring member 50 can move smoothly without being subjected to undesirable interference so that movement of the operation lever 60 such as an upward movement and a downward movement also becomes smooth.

When transition to the hold state (locked state) where the binding member 70 presses the material to be bound X is performed according to pivoting of the operation lever 60 and when transition to the open state (unlocked state) where the binding member 70 separates from the material to be bound X is performed according thereto, namely, when opening and closing are performed, the spring first end portion 56 of the spring member 50 is pivoted, but the winding portion 52 is shrunk and loosened accordingly. Therefore, the inner diameter of the winding portion 52 is configured such that a slight clearance between the same and the outer diameter of the shaft 58 is provided. The winding portion 52 is mounted on an outer peripheral face of the shaft 58.

That is, the winding portion 52 extends from the spring second end portion 54 side toward the spring first end portion 56 side so as to intersect the longitudinal direction of the operation lever 60 obliquely, and the side of the spring first end portion 56 of the spring member 50 is fixed to the base plate 22 at a position near the far side beyond the side of the spring second end portion 54.

When an external force does not act on the spring member 50, the spring second end portion 54 is formed so as to push up the free end of the operation lever 60 about the shaft 58 serving as a pivot shaft portion, and the spring first end portion 56 is formed so as to bring the binding member 70 near the surface of the base plate 22.

Since the spring second end portion 54 is fixed to the operation lever 60 so as to be approximately parallel to the longitudinal direction of the operation lever 60, when the operation lever 60 is pressed down toward a fallen-down state, the spring member 50 performs pressing-down in a direction approximately parallel to the bearing plate 24, namely, in the vertical direction to being capable of causing the projection portion 100 constituting the lock mechanism to engage with the engagement body 120.

The binding member 70 which is approximately rectangular in a plan view is formed to extend on the base plate 22 in the longitudinal direction of the base plate 22 to be attached to the base plate 22 in parallel to the bearing plate 24 such that the longitudinal end edge of the binding member 70 opposite to the bearing plate 24 comes close to and separates from the surface of the base plate 22.

The binding member 70 is formed of, for example, a sheet of metal plate. The binding member 70 has, for example, a length shorter than the distance between the first binding member supporting portion 30 and the second binding member supporting portion 34, and it is formed to have such a bent shape as to expand upward in the widthwise direction (approximately L shape in section).

The binding member 70 is bifurcated to both sides of the binding member 70 in the longitudinal direction on the bearing plate 24 side of the binding member 70 in the widthwise direction so that the engagement portions 90 projecting toward the side opposite to the bearing plate 24 side are formed.

These engagement portions 90 are fitted into the holding hole 32 of the first binding member supporting portion 30 serving as a pivot shaft portion receiver and the holding hole 36 of the second binding member supporting portion 34 serving as a pivot shaft portion receiver.

The holding hole 36 of the second binding member supporting portion 34 on the near side is formed to have the same height as the holding hole 32 of the first binding member supporting portion 30 on the far side from the base plate 22, and the first supporting projection portion 92*a* on the far side caused to engage with the holding hole 32 on the far side and the second supporting projection portion 92*b* on the near side caused to engage with the holding hole 36 on the near side are caused to engage with each other at the same height position.

Therefore, the binding member 70 can be pivoted about the line connecting the pair of first supporting projection portion 92*a* and second supporting projection portion 92*b* positioned front and behind and serving as a rotation center.

The operation lever 60 extends between the bearing plate 24 and the engagement portion 90 along the bearing plate 24 and the line connecting the first supporting projection portion 92*a* and the second supporting projection 92*b*.

Further, when the operation lever 60 is locked by pressing the free end of the operation lever 60 on the near side and causing the projection portion 100 to engage with the engagement body 120 of the engagement body supporting portion 180, the second supporting projection portion 92*b* of the binding portion 70 on the near side and the first supporting projection portion 92*a* on the far side are positioned at the same height, so that presses to the material to be bound X are simultaneously started regarding the relationship with a position where the spring engagement portion 56*c* of the spring member 50 presses the bridging portion 74 of the binding member 70 (in the vicinity of the central portion m of the binding member 70 in the longitudinal direction), so that forces of pressing the material to be bound X on the far side and that on the near side are balanced to become equivalent.

It should be noted that the engagement portions 90 are formed so as to bend in the widthwise direction such that the strength of the engagement portions 90 is enhanced and the engagement portions 90 are easily rotated within the holding hole 32 and the holding hole 36. By fitting the engagement portions 90 projecting from the binding member 70 into the holding hole 32 of the first binding member supporting portion 30 and the holding hole 36 of the second binding member supporting portion 34 in this manner, the number of parts can be reduced as compared with the case where the binding member 70 is pivotally held using rotation shafts which are separate parts.

As shown in FIG. 47A to FIG. 49C, the binding member 70 is formed with the standing portion 76 extending from the engagement portion 90 side obliquely upward on the opposite side to the bearing plate 24, the plate-shaped bridging portion 74 extending from an upper end of the standing portion 76 obliquely downward (an angle of about 22 degrees to the horizontal plane), and the pressing portion 72 formed at the free end of the bridging portion 74 by folding a portion from the near side end edge of the bending member 70 to the far side end edge obliquely downward (an angle of about 15 degrees to the vertical plane). The pressing portion 72 is formed such that when pressing the material to be bound X such as a document, the pressing portion 72 can press the material to be bound X such as a document while slightly bending to the bridging portion 74 side.

The pressing portion 72 is formed so as to continue from the near side end edge of the bridging portion 74 up to the far side end edge. The pressing portion 72 is formed such that a grounding region grounded on the material to be bound X and formed at the free end is separated to a grounding portion 72*a* on the far side and a grounding portion 72*b* on the near side and the grounding portion 72*a* on the far side and the grounding portion 72*b* on the near side have approximately the same grounding area.

The binding member 70 is formed such that the entire thereof is a plate-shaped body approximately rectangular in a plan view and curved in an approximately trapezoidal shape in a front view, the pressing portion 72 is formed on one end side portion of the binding member 70 in the widthwise direction so as to extend downward, and a pair of engagement portions 90 are formed on the other end side portion in the widthwise direction (the bearing plate 24 side portion) so as to be parallel to each other on the other end side portion and extend toward the pressing portion 72 direction. The pressing portion 72 extends in the longitudinal direction of the base plate 22.

The binding member 70 has a widthwise direction extending from the side of the operation lever 60 serving as the operation member, has the pressing portion 72 in the vicinity of a reference plane Pxz passing through the end edge of the binding member 70 opposite to the operation lever 60 serving as the operation member in a plan view of the binding member 70, and the spring first end portion 56 which is the one portion of the spring member 50 serving as the biasing member extends in the widthwise direction of the binding member 70 to be positioned in the vicinity of the reference plane Pxz passing through the end edge of the binding member 70.

The reference plane Pxz is a vertical plane orthogonal to the principal face of the base plate 22.

The binding member 70 has the through-hole 78 for inserting the spring first end portion 56 of the spring member 50 serving as the biasing member 50 at the central portion m of the binding member 70 in the longitudinal direction and in the vicinity of the reference plane Pxz passing through the end edge of the binding member 70 opposite to the spring member 50 serving as the biasing member in a plan view of the binding member 70.

The binding member 70 further has a first biasing member receiving portion 580 formed so as to be recessed at the central portion m in the binding member 70 in the longitudinal direction and between an end edge of the binding member 70 on the side of the spring member 50 serving as the biasing member in a plan view of the binding member 70 and the through-hole 78.

The first biasing member receiving portion 580 is formed with a receiving recessed portion further recessed from the bridging portion 74 on the side of a face thereof such that the spring first end portion 56 of the spring member 50 does not come in contact with the binding member 70 during movement between the open state and the hold state. The first biasing member receiving portion 580 is formed in a U-valley shape which is wide on the standing portion 76 side and is narrowed toward the pressing portion 72 side, and a bottom portion thereof is curved in a rounded shape.

Further, the spring member 50 is formed by bending the spring first end portion 56 by a slight angle in the spring bent portion 56*e* such that the spring first end portion 56 of the spring member 50 does not come in contact with the binding member 70 during movement between the open state and the hold state (see FIG. 51A).

The spring member 50 is configured so as to press the binding member 70 in the vicinity of a reference plane Pxz passing through an end edge of the binding member 70 positioned on the opposite side to the operation lever 60 serving as the operation member in a plan view of the binding member 70 both at a locking time in the case that the material to be bound X is thick and at a locking time in the case that the material to be bound is thin (see FIG. 54A and FIG. 54B).

The binding member 70 has the second biasing member receiving portion 82 formed so as to expand upward at the center m of the binding member 70 in the longitudinal direction and between the end edge of the binding member 70 opposite to the spring member 50 serving as the biasing member and the through-hole 78 in a plan view of the binding member 70.

The binding member 70 has, in a region facing the first biasing member receiving portion 580, a biasing member end portion holding portion 86 formed in order to engage the spring first end portion 56 of the spring member 50 serving as the biasing member and cover the same by recessing the binding member 70 downward.

The biasing member end portion holding portion 86 is a plate-shaped body provided at the lower end of the second biasing member receiving portion 82 to project toward the standing portion 76 side, and it is configured so as to engage the spring first end portion 56 of the spring member 50 in the open state while it is formed so as to cover the spring first end portion 56 of the spring member 50 in the hold state.

The biasing member end portion holding portion 86 is configured so as to become approximately parallel to the principal face of the base plate 22 at locked times when the thickness of the material to be bound X is thick and when the thickness is thin (see FIG. 54A and FIG. 54B).

The biasing member end portion holding portion 86 is configured so as not to be engaged with the spring first end portion 56 of the spring member 50 at locked times when the thickness of the material to be bound X is thick and when the thickness is thin (see FIG. 54A and FIG. 54B).

The binding member 70 has a biasing member end portion catching portion 84 for catching the spring first end portion 56 of the spring member 50 in the locked state nearer to the standing portion 76 side than the biasing member end portion holding portion 86 above the biasing member end portion holding portion 86.

The biasing member end portion catching portion 84 is a plate-shaped body provided in a section from the pressing portion 72 side end of the first biasing member receiving portion 580 to the through-hole 78. The biasing member end portion catching portion 84 is formed between the first biasing member receiving portion 580 and the through-hole 78 and it is formed integrally with the first biasing member receiving portion 580.

The biasing member end portion catching portion 84 is configured so as to become approximately parallel to the principal face of the base plate 22 at the locked time when the thickness of the material to be bound X is thin and catch the spring first end portion 56 of the spring member 50 (see FIG. 54B).

The biasing member end portion catching portion 84 is configured so as to intersect the principal face of the base plate 22 obliquely at the locked time when the thickness of the material to be bound X is thick and catch the spring first end portion 56 of the spring member 50 (see FIG. 54A).

The biasing member end portion catching portion 84 is configured so as to be recessed downward and hold the spring first end portion 56 of the spring member 50.

The standing portion 76 is recessed downward (in a down direction) at the central portion m of the binding member 70 in the longitudinal direction (a direction from the near side end to the far side end), so that the first biasing member receiving portion 580 is formed.

The bridging portion 74 is recessed downward (in a downward direction) at the central portion m of the bridging portion 70 in the longitudinal direction (a direction from the near side end to reach the far side end), so that the first biasing member receiving portion 580 for receiving the first end portion 56 of the spring member 50 is formed.

Formation is performed such that a bottom portion of the first biasing member receiving portion 580 in a region of the standing portion 76 is low and a bottom portion of the first biasing member receiving portion 580 in a region of the bridging portion 74 rises slightly highly at a central portion, and a bottom portion of the first biasing member receiving portion 580 is low on the biasing member end portion catching portion 84 side.

The spring member 50 is provided such that the spring first end portion 56 is formed in a shape similar to an inner face of the binding member 70, the spring standing portion 56*a* of the spring member 50 stands up along the standing portion 76 of the binding member 70, and the spring bridging portion 56*b* of the spring member 50 extends along the first biasing member receiving portion 580 of the binding member 70 so that the spring catching portion 56*c* of the spring member 50 is caught by and fixed to the biasing member end portion catching portion 84 or the biasing member end portion holding portion 86 of the binding member 70.

The second biasing member receiving portion 82 is formed with a fan-shaped, rectangular, semi-circular, or circular through-hole 78, the spring first end portion 56 of the spring member 50 is loosely fitted into the through-hole 78 from the biasing member end portion holding portion 86 side and a distal end portion (spring catching portion 56*c*) of the spring first end portion 56 of the spring portion 50 is prevented from coming off from the through-hole 78.

The through-hole 78 is formed to have a size slightly larger than the outer shape of the spring first end portion 56 of the spring member 50 and a shape where the spring first end portion 56 of the spring member 50 can be loosely fitted into the through-hole 78, and it is configured such that a clearance where the spring member 50 can slightly move in the through-hole 78 is provided.

In this embodiment, the binding member 70 is formed with a top portion t where the standing portion 76 and the bridging portion 74 have been connected to each other nearer to the bearing plate 24 side than the central portion c of the binding member 70 in the widthwise direction, it is formed with the biasing member end portion catching portion 84 and the biasing member end portion holding portion 86 nearer to the pressing portion 72 side than the top portion t, and it is bored with the through-hole 78 approximately at the central of the binding member 70 in the widthwise direction (a front-back direction) of the biasing member end portion catching portion 84 and the biasing member end portion holding portion 86 (see FIGS. 48A, 45B, 51A and 51B).

The through-hole 78 has a lower edge e formed below the top portion t and above the biasing member end portion holding portion 86.

The pressing portion 72 is formed above the engagement portion 90 in the height direction (a vertical direction) (see FIG. 48 and FIG. 51).

The through-hole 78 is formed at a position near the pressing portion 72 in the vicinity of the central portion m of the binding member 70 in the longitudinal direction between the engagement portions 90 formed at the front end and the back end of the binding member 70 (between the first supporting projection portion 92*a* and the second supporting projection portion 92*b* on the far side)

It should be noted that a linear rib may be formed in the pressing portion 72 continuously in the longitudinal direction in order to prevent deformation due to a force generated when the pressing member 72 presses the material to be bound X such as a document, or a linear rib may also be formed in the bridging portion 74 in order to prevent deformation due to a force generated when the pressing member 72 presses the material to be bound X such as a document.

As shown in FIGS. 51A and 51B, the spring member 50 is arranged such that the spring standing portion 56*a* faces in a direction close to a horizontal direction and the spring catching portion 56*c* faces in a direction close to the horizontal direction in a state where the binding device 20 has been closed (the hold state). The spring standing portion 56*a* is not higher than the height of the spine cover 14*c* (namely, a length between the folded portion 16*a* and the folded portion 16*b*) (see FIGS. 54A and 54B).

As shown in FIGS. 52A to 53B, the spring first end portion 56 of the spring member 50 comes in contact with the lower end of the through-hole 78 in the locked time.

As shown in FIGS. 52A and 52B, the spring member 50 is disposed such that the near side of the spring standing portion 56*a* slightly rises, the spring standing portion 56*a* faces obliquely upward, and the spring catching portion 56*c* faces slightly downward in a state where the binding device 20 has been slightly opened (open state).

As shown in FIGS. 53A and 53B, the spring member 50 takes such a state that the spring standing portion 56*a* faces in the vertical direction, and the spring catching portion 56*c* rotates toward the far side so that the spring catching portion 56*c* has been stood approximately obliquely in the state where the binding device 20 has been fully opened (the open state).

As shown in FIGS. 54A and 54B, the spring first end portion 56 of the spring member 50 comes in contact with the upper edge of the through-hole 78 and/or the inner face of the second biasing member receiving portion 82 at a transition time to the open state.

EXPLANATION OF REFERENCES

10 file
12 cover body

14*a* front cover
14*b* back cover
14*c* spine cover
16*a*, 16*b* folded portion
20 binding device
22 base plate
24 bearing plate
26 pivot shaft fixing through-hole
30 first binding member supporting portion
32, 36 holding hole
34 second binding member supporting portion
38 bearing plate
42 ridge
44 base plate fixing through-hole
46*a* fixing recessed portion
46*b* holding projection portion
48 writing paper arranging portion
50 spring member
52 winding portion
54 spring second end portion
56 spring first end portion
56*a* spring standing portion
56*b* spring bridging portion
56*c* spring catching portion
58 shaft
60, 360, 460 operation lever
60*a*, 360*a*, 460*a* first vertical side wall
60*b*, 360*b*, 460*b* second vertical side wall
60*c*, 360*c*, 460*c* operation portion
62 lever through-hole
70 binding member
72 pressing portion
72*a* grounding portion on the far side
72*b* grounding portion on the near side
74 bridging portion
76 standing portion
78 through-hole
80, 580 first biasing member receiving portion
82 second biasing member receiving portion
84 biasing member end portion catching portion
86 biasing member end portion holding portion
90 engagement portion (of binding member)
92 supporting projection portion
92*a* first supporting projection portion
92*b* second supporting projection portion
94 supporting base portion
94*a* first supporting base portion
94*b* second supporting base portion
96 hanging portion
96*a* first hanging portion
96*b* second handing portion
97 erected portion
97*a* first erected portion
97*b* second erected portion
100, 300, 400 projection portion
102, 302, 404 first face
104, 304, 405 second face
106, 306, 406 third face
108, 308, 407 fourth face
110, 310, 412 fifth face
112, 312, 408, 416 bottom face
120, 320, 420 engagement body (of lock mechanism)
122, 322, 422 engagement body main body
124, 324, 424 follow-up guidance portion
126, 326, 426 first block
128, 328, 428 second block
130, 330, 430 first slope portion
132, 332, 432 first projection passage portion
134, 334, 434 projection guidance portion
136, 336, 436 projection engagement portion
136*a*, 336*a*, 436*a* projection portion catching portion
138, 338, 48 second slope portion
140, 340, 440 second projection passage portion
142, 342, 442 first projection edge portion
144, 344, 444 second projection edge portion
146 first guidance coupling portion
148 second guidance coupling portion
150, 350, 450 projection passage step difference portion
180, 380, 480, engagement body supporting portion (of lock mechanism)
182, 382, 482 engagement body supporting main body
184 engagement body moving portion
186 supporting portion fixing portion
186*a* fixing projection portion
188 free end portion
190 guidance supporting portion
190*a* first guidance supporting portion
190*b* second guidance supporting portion
192 engagement body movement restricting portion
192*a* first engagement body movement restricting portion
192*b* second engagement body movement restricting portion
198, 398, 498 opening portion
370, 470 engagement body shaft portion
370*a*, 470*a* first engagement body shaft portion
370*b*, 470*b* second engagement body shaft portion
372 engagement body groove portion
372*a* first engagement body groove portion
372*b* second engagement body groove portion
384, 484 engagement body receiving portion
390, 490 engagement body pivoting portion
390*a*, 490*a* first engagement body pivoting portion
390*b*, 490*b* second engagement body pivoting portion
392, 492 engagement body rotation restricting portion
392*a*, 492*a* first engagement body rotation restricting portion
392*b*, 492*b* second engagement body rotation restricting portion
413 sixth face
414 seventh face
415 eighth face
427 first passage body
429 second passage body
c central portion
e lower edge
t top portion
X material to be bound

The invention claimed is:

1. A binding device comprising:

a binding member having a pressing portion for pressing and holding a material to be bound;

an operation member provided for pivoting the binding member between a locked state of pressing a material to be bound, and an unlocked state in which the binding member is separated from the material;

a base member provided with the binding member and the operation member;

a biasing member biasing the binding member in a direction of pressing the material to be bound;

the binding device is provided with an engagement body, one or plural projection portions movable to engage with the engagement body, and an engagement body supporting portion, the engagement body supporting portion being provided with the engagement body, the engagement body supporting portion being separate from the one or more plural projection portions, or the binding device is provided with an engagement body, one or plural projection portions caused to engage with the engagement body, and an engagement body supporting portion provided with the one or plural projection portions, the engagement body supporting portion being separate from the engagement body;

the operation member is provided on the base member so as to rotate in a direction approximately orthogonal to a principal face of the base member;

the engagement body supporting portion comprises an engagement body supporting main body having a longitudinal direction along a longitudinal direction of the operation member, and an engagement body moving portion formed on the engagement body supporting main body, or an engagement body receiving portion formed on the engagement body supporting main body;

the engagement body supporting main body has a fixing portion of the engagement body supporting portion formed at one end of the engagement body supporting main body in a longitudinal direction thereof, and a free end portion formed at the other end of the engagement body supporting main body in the longitudinal direction thereof so as to be separated from the fixing portion of the engagement body supporting portion;

the engagement body supporting portion is configured such that the engagement body supporting portion bends toward a side of the one or plural projection portions or the engagement body in order to cause the engagement body and at least one of the one or plural projection portions to engage with each other and bends about the fixing portion of the engagement body supporting portion which is fixed in a direction of separating from the engagement body or the at least one projection portion in order to disengage the engagement body and the at least one projection portion from each other;

the engagement body is provided with an engagement body main body coming in sliding contact with the engagement body moving portion or the engagement body receiving portion of the engagement body supporting portion, and a follow-up guidance portion for following up the one or plural projection portions formed on the engagement body main body;

the locked state is formed by engagement between the engagement body and the one or plural projection portions; and the engagement body is configured so as to move from the locked state to the unlocked state along the engagement body moving portion or the engagement body receiving portion of the engagement body supporting portion according to movement of one of the one or plural projection portions arranged on the follow-up guidance portion.

2. The binding device according to claim 1, wherein the engagement body is pivotally or slidably attached to the operation member or the supporting portion or the engagement body supporting portion;

the engagement body is pivotable or slidable within a range where the projection portion necessarily comes in contact with the engagement body at a movement time from the unlocked state to the locked state; and the locked state is formed by engagement between the engagement body and the projection portion at a predetermined position and a predetermined orientation of the projection portion relative to the engagement body.

3. The binding device according to claim 1, wherein a first projection edge portion projects to the projection portion when the projection portion passes through the first projection passage portion;

when the one projection or one projection of the plural projection portions passes through the first projection passage portion at a movement time from the unlocked state to the locked state, the one projection or one projection of the plural projection portions is pressed to the first projection edge portion and the engagement body supporting portion swings, and when the projection portion has passed through the first projection edge portion, the engagement body supporting portion is restored;

thereafter, the projection portion cannot return reversely through the first projection passage portion;

a second projection edge portion projects to the projection portion when the projection portion passes through the second projection passage portion;

when the projection portion passes through the second projection passage portion at a movement time from the locked state to the unlocked state, the projection portion is pressed to the second projection edge portion and the engagement body supporting portions swings, and when the projection portion has passed through the second projection edge portion, the engagement body supporting portion is restored; and thereafter, the projection portion cannot return reversely through the second projection passage portion.

4. A binding device comprising:

a binding member having a pressing portion for pressing and holding a material to be bound;

an operation member provided for pivoting the binding member between a locked state of pressing a material to be bound, and an unlocked state in which the binding member is separated from the material;

a base member provided with the binding member and the operation member;

a biasing member biasing the binding member in a direction of pressing the material to be bound;

an engagement body;

an engagement body supporting portion attached with the engagement body;

one or plural projection portions movable to engage with the engagement body;

the engagement body supporting portion comprises an engagement body supporting main body having a longitudinal direction along a longitudinal direction of the operation member, and an engagement body moving portion formed on the engagement body supporting main body, or an engagement body receiving portion formed on the engagement body supporting main body;

the engagement body supporting portion is provided with a guidance supporting portion or an engagement body pivoting portion formed in the engagement body supporting main body;

the engagement body is provided with an engagement body main body coming in sliding contact with the engagement body moving portion or the engagement body receiving portion of the engagement body supporting portion, and a follow-up guidance portion for following up the one or plural projection portions formed on the engagement body main body;

the engagement body is configured so as to move from the locked state to the unlocked state along the engagement body moving portion or the engagement body receiving portion of the engagement body supporting portion according to movement of one of the one or plural projection portions arranged on the follow-up guidance portion, the engagement body and the engagement body supporting portion are provided on one of the operation member and the base member and the one or plural projection portions are provided on the other of the operation member and the base member;

the engagement body supporting portion is provided between the operation member and the binding member, and the engagement body supporting portion has such a structure that the supporting portion comes close to the operation member at a movement time from the locked state to the unlocked state and separates from the operation member at a movement time from the unlocked state to the locked state; and the locked state is formed by engagement between the engagement body and the one or plural projection portions according to a relative movement therebetween.

5. The binding device according to claim 4, wherein the engagement body is pivotally or slidably attached to the operation member or the supporting portion or the engagement body supporting portion;

the engagement body is pivotable or slidable within a range where the projection portion necessarily comes in contact with the engagement body at a movement time from the unlocked state to the locked state; and the locked state is formed by engagement between the engagement body and the projection portion at a predetermined position and a predetermined orientation of the projection portion relative to the engagement body.

6. The binding device according to claim 4, wherein the engagement body is configured such that a follow-up guidance portion moves in response to movement of the projection portion;

the follow-up guidance portion is provided with a first slope portion to which the projection portion is pressed at a movement time from the unlocked state to the locked state, a first projection passage portion through which the projection portion passes at a movement time from the unlocked state to the locked state, a projection engagement portion engaging with the projection portion when the locked state is achieved, a second slope portion to which the projection portion is pressed at a movement time from the locked state to the unlocked state, and a second projection passage portion though which the projection portion passes at a movement time from the locked state to the unlocked state;

the first projection passage portion is provided to connect to the first slope portion at a lower position on the first slope portion;

a projection engagement portion is provided to connect to the first projection passage portion at a position separating from a region provided to connect to the first slope portion of the first projection passage portion;

the second slope portion is formed so as to face the projection engagement portion, the second projection passage portion is provided to connect to the second slope portion at a lower position on the second slope portion; and the engagement body can take a first state where when the operation member is pressed down toward the base member in a direction orthogonal to a principal face of the base member, the first projection passage portion is positioned on a track of the projection portion, a second state where when the projection portion moves, the projection portion and the projection engagement portion of the engagement body are caused to engage with each other and the binding member is in the locked state, and a third state where when the operation member is pressed down toward the base member in a direction orthogonal to the principal face of the base member and the projection portion is pressed to the second slope portion so that the engagement body moves in contact with the second slope portion, the second projection passage portion is positioned on the track of the projection portion.

7. The binding device according to claim 4, wherein a first projection edge portion projects to the projection portion when the projection portion passes through the first projection passage portion;

when the one projection or one projection of the plural projection portions passes through the first projection passage portion at a movement time from the unlocked state to the locked state, the one projection or one projection of the plural projection portions is pressed to the first projection edge portion and the engagement body supporting portion swings, and when the projection portion has passed through the first projection edge portion, the engagement body supporting portion is restored;

thereafter, the projection portion cannot return reversely through the first projection passage portion;

a second projection edge portion projects to the projection portion when the projection portion passes through the second projection passage portion;

when the projection portion passes through the second projection passage portion at a movement time from the locked state to the unlocked state, the projection portion is pressed to the second projection edge portion and the engagement body supporting portions swings, and when the projection portion has passed through the second projection edge portion, the engagement body supporting portion is restored; and thereafter, the projection portion cannot return reversely through the second projection passage portion.

8. The binding device according to claim 4, wherein the engagement body supporting portion comprises an engagement body supporting main body having a longitudinal direction extending along a longitudinal direction of the operation member, and an engagement body moving portion or an engagement body receiving portion formed on the engagement body supporting main body;

the engagement body supporting main body has a fixing portion of the engagement body supporting portion formed at one end of the engagement body supporting main body in a longitudinal direction thereof, and a free end portion formed at the other end separated from the fixing portion of the engagement body supporting portion, and the engagement body supporting main body is configured so as to bend about the fixing portion of the engagement body supporting portion which is fixed to the engagement body to come close to and separate from the operation member;

the engagement body is provided with an engagement body main body coming in sliding contact with the engagement body moving portion or the engagement body receiving portion of the engagement body supporting portion and a follow-up guidance portion for following up the projection portion formed on the engagement body main body;

the engagement body is configured so as to move from the locked state to the unlocked state along the engagement body moving portion or the engagement body receiving portion of the engagement body supporting portion according to movement of a projection portion arranged on the follow-up guidance portion; and the engagement body supporting portion is provided with a guidance supporting portion or an engagement body pivoting portion formed in the engagement body supporting main body.

9. A binding device comprising:

a binding member having a pressing portion for pressing and holding a material to be bound;

an operation member provided pivoting the binding member between a locked state of pressing a material to be bound, and an unlocked state in which the binding member is separated from the material;

a base member provided with the binding member and the operation member; and a biasing member biasing the binding member in a direction of pressing the material to be bound;

the binding device is provided with an engagement body, one or plural projection portions movable to engage with the engagement body, and an engagement body supporting portion, the engagement body supporting portion being provided with the engagement body, or the binding device is provided with an engagement body, one or plural projection portions caused to engage with the engagement body, and a engagement body supporting portion provided with the one or plural projection portions;

the operation member is provided on the base member so as to rotate in a direction approximately orthogonal to a principal face of the base member;

the engagement body is provided with an engagement body main body coming in sliding contact with the engagement body moving portion or the engagement body receiving portion of the engagement body supporting portion, and the binding device further includes a follow-up guidance portion for following up the one or plural projection portions formed on the engagement body main body;

the engagement body is configured such that the follow-up guidance portion moves in response to movement of the one or plural projection portions;

the follow-up guidance portion is provided with a first projection passage portion through which the one or plural projection portions passes at a movement time from the unlocked state to the locked state, a projection engagement portion engaging with the one or plural projection portions when the locked state is achieved, a second slope portion to which the one or plural projection portions is pressed at a movement time from the locked state to the unlocked state, and a second projection passage portion through which the one or plural projection portions passes at a movement time from the locked state to the unlocked state;

the engagement body can take a first state where when the operation member is pressed down toward the base member in a direction orthogonal to a principal face of the base member, the first projection passage portion is positioned on a track of the one or plural projection portions, a second state where when the one or plural projection portions move, the one or plural projection portions and the projection engagement portion of the engagement body are caused to engage with each other and the binding member is in the locked state, and a third state where when the operation member is pressed down toward the base member and the one or plural projection portions is pressed to the second slope portion so that the engagement body moves in contact with the second slope portion, the second projection passage portion is positioned on the track of the one or plural projection portion; and the locked state is formed by engagement between the engagement body and the one or plural projection portions.

10. A binding device comprising:

a binding member having a pressing portion for pressing and holding a material to be bound;

an operation member provided for pivoting the binding member between a locked state of pressing a material to be bound, and an unlocked state in which the binding member is separated from the material;

a base member provided with the binding member and the operation member;

a biasing member biasing the binding member in a direction of pressing the material to be bound;

an engagement body;

an engagement body supporting portion attached with the engagement body;

one or plural projection portions movable to engage with the engagement body;

the engagement body and the engagement body supporting portion are provided on one of the operation member and the base member and the one or plural projection portions are provided on the other of the operation member and the base member;

the engagement body is provided with an engagement body main body coming in sliding contact with an engagement body moving portion of the engagement body supporting portion or an engagement body receiving portion of the engagement body supporting portion, and the binding device includes a follow-up guidance portion for following up the one or plural projection portions formed on the engagement body main body;

the engagement body is configured such that the follow-up guidance portion moves in response to movement of the one or plural projection portions;

the follow-up guidance portion is provided with a first projection passage portion through which the one or plural projection portions passes at a movement time from the unlocked state to the locked state, a projection engagement portion engaging with the one or plural projection portions when the locked state is achieved, a second slope portion to which the one or plural projections portions is pressed at a movement time from the locked state to the unlocked state, and a second projection passage portion through which the one or plural projection portions passes at a movement time from the locked state to the unlocked state;

the engagement body can take a first state where when the operation member is pressed down toward the base member in a direction orthogonal to a principal face of the base member, the first projection passage portion is positioned on a track of the one or plural projection portions, a second state where when the one or plural projection portions move, the one or plural projection portions and the projection engagement portion of the engagement body are caused to engage with each other and the binding member is in the locked state, a third state where when the operation member is pressed down toward the base member and the one or plural projection portions is pressed to the second slope portion so that the engagement body moves in contact with the second slope portion, the second projection passage portion is positioned on the track of the one or plural projection portions, and the locked state is formed by engagement between the engagement body and the one or plural projection portions according to a relative movement therebetween.

* * * * *